US007854648B2

(12) United States Patent
Satoh et al.

(10) Patent No.: US 7,854,648 B2
(45) Date of Patent: Dec. 21, 2010

(54) CLEANING MEDIUM AND DRY CLEANING APPARATUS USING THE SAME

(75) Inventors: Tatsuya Satoh, Tokyo (JP); Yoichi Okamoto, Kanagawa (JP); Akihiro Fuchigami, Kanagawa (JP); Yuusuke Taneda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/956,039

(22) Filed: Dec. 13, 2007

(65) Prior Publication Data

US 2008/0141484 A1 Jun. 19, 2008

(30) Foreign Application Priority Data

Dec. 15, 2006 (JP) ..... 2006-339126
Jul. 25, 2007 (JP) ..... 2007-192888
Nov. 16, 2007 (JP) ..... 2007-297415

(51) Int. Cl.
*B24B 31/02* (2006.01)

(52) U.S. Cl. ..... 451/330; 451/326

(58) Field of Classification Search ..... 134/7; 451/326–330

See application file for complete search history.

(56) References Cited

U.S. PATENT DOCUMENTS 1,133,368 A * 3/1915 DeVilbiss ..... 451/330
2,328,998 A * 9/1943 Radford ..... 451/536
2,440,656 A * 4/1948 Huntington ..... 51/303
3,613,317 A * 10/1971 Kittredge et al. ..... 451/330
5,123,967 A * 6/1992 Arneson ..... 134/6
5,140,783 A * 8/1992 Hoffman ..... 451/32
5,617,609 A 4/1997 Bently
2007/0107752 A1 5/2007 Fuchigami et al.

FOREIGN PATENT DOCUMENTS

| | | |
|---|---|---|
| JP | 60-188123 | 9/1985 |
| JP | 4-59087 | 2/1992 |
| JP | 4-256477 | 9/1992 |
| JP | 7-88446 | 4/1995 |
| JP | 2515833 | 8/1996 |
| JP | 10-034100 | 2/1998 |
| JP | 2889547 | 2/1999 |
| JP | 3288462 | 3/2002 |
| JP | 2003-122123 | 4/2003 |
| JP | 3468995 | 9/2003 |
| JP | 2004-106100 | 4/2004 |
| JP | 2005-329292 | 12/2005 |
| JP | 2007-29945 | 2/2007 |

OTHER PUBLICATIONS

May 20, 2008 European search report in connection with corresponding European Patent Application No. EP 07 25 4854.

* cited by examiner

*Primary Examiner*—Maurina Rachuba
(74) *Attorney, Agent, or Firm*—Cooper & Dunham LLP

(57) ABSTRACT

A cleaning medium flies with an air current in a cleaning tank to collide with an object to be cleaned so as to remove an extraneous substance attached to the object. The cleaning medium includes an outer surface that comes into contact with the object and an inner surface that remains out of contact with the object. The cleaning medium is flexible and formed in a shape that allows the air current to flow from the outside onto the inner surface of the cleaning medium.

16 Claims, 56 Drawing Sheets

| θ | CIRCULATION |
|---|---|
| 30° | × |
| 45° | × |
| 60° | × |
| 75° | △ |
| 90° | △ |
| 105° | △ |
| 120° | ○ |
| 135° | ○ |
| 150° | ○ |

41
3
4
431a
431b 41
431a
3
4
431b 41
3
431a
431b

CLEANING MEDIUM AND DRY CLEANING APPARATUS USING THE SAME

BACKGROUND

1. Technical Field

This disclosure generally relates to a solid cleaning medium that removes, without using water or solvent, dust and fine particles attached to an object used in an electrophotographic apparatus (such as a copier and a laser printer), such as toner particles attached to a component of a complex shape; and a dry-type cleaning apparatus using the solid cleaning medium; and particularly relates to solid cleaning medium and a thy-type cleaning apparatus that achieve higher cleaning efficiency by allowing continuous introduction of objects to be cleaned.

2. Description of the Related Art

Office equipment makers that manufacture copiers, facsimile machines, printers, and the like are actively engaged in recycling activities in which used products and component units are collected from users and then disassembled, cleaned, and assembled again for recycle use as components or as resin material in order to bring about a resource-recycling society. In order to recycle the components used in these products and component units, there is a need for a process that removes fine toner particles attached to the disassembled components and units for the cleaning purpose. The important issue is to reduce the cost and environmental impact associated with such cleaning.

In the case of a wet-type cleaning method that uses water or solvent to remove contaminants such as toner attached to components and units, the need for processing the waste fluid containing toner and energy consumption associated with a drying process after cleaning may lead to a cost increase in terms of environmental measures and energy conservation measures.

In the case of a dry-type cleaning method that uses air blowing forced air, the cleaning power is not high enough to remove highly adhesive toner, so that subsequent process steps are required such as manual wiping. Thus, cleaning is recognized as one of the bottleneck process steps in recycling and reusing the products. In the case of blast cleaning using dry ice, use of a large amount of dry ice may result in high running costs and a significant environmental impact.

As a solution to these problems, Patent Document 1 discloses a dry cleaning apparatus that discharges a charged object to be cleaned through stirring with an elastically deformable contact member in a rotating cylinder so as to lower the adhesion of dust attached to the object, and thus removes the dust from the object.

Patent Document 2 discloses a cleaning method using a dry cleaning medium. In this method, a developer (carrier) used in electrophotographic processes is used as a cleaning medium, and toner particles adhering to the object to be cleaned are removed by being attaching to the cleaning medium, thereby achieving dry cleaning.

Shot blasting techniques as disclosed in Patent Document 3 and Patent Document 4 are also used. The technique disclosed in Patent Document 3 is to remove extraneous substances from an object to be cleaned by blasting stainless microspheres or small stainless pieces onto the object. The technique disclosed in Patent Document 4 is to remove dirt from a resin container by causing granular solids to collide with the surface of a resin container with a high-speed air current.

Patent Document 5 discloses a dry cleaning apparatus. According to Patent Document 5, particulate cleaning media that attract particles are introduced into a vessel to be cleaned, and then a cleaning nozzle is inserted into an opening of the vessel. The cleaning nozzle provides a high-speed air current in the cleaning vessel to propel the cleaning media, which remove particles adhering to the inner surface of the cleaning vessel. The cleaning media collide with a mesh attached to an end of the cleaning nozzle, so that the mesh separates the particles adhering to the cleaning media by filtering and thus regenerates the cleaning media. The air blows up the regenerated median thereby cleaning the vessel repeatedly.

The apparatus of Patent Document 5 performs the process of blowing up the cleaning media and the process of regenerating the cleaning media by suction at the same time.

Further, Patent Documents 6 though 10 disclose blast cleaning techniques that use flexible cleaning media in order to prevent damage to or deformation of objects to be cleaned during cleaning.

Patent Document 11 discloses a cleaning method using thin cleaning media for higher cleaning efficiency.

Patent Document 1: Japanese Patent Registration No. 3288462

Patent Document 2: Japanese Patent Laid-Open Publication No. 2003-122123

Patent Document 3: Japanese Patent Registration No. 2889547

Patent Document 4: Japanese Patent Registration No. 3468995

Patent Document 5: Japanese Patent Laid-Open Publication No. 2005-329292

Patent Document 6: Japanese Patent Laid-Open Publication No. 2004-106100

Patent Document 7: Japanese Patent Laid-Open Publication No. 60-188123

Patent Document 8: Japanese Patent Laid-Open Publication No. 04-059087

Patent Document 9: Japanese Utility Model Registration No. 2515833

Patent Document 10: Japanese Patent Laid-Open Publication No. 07-088446

Patent Document 11: Japanese Patent Laid-Open Publication No. 2007-29945

In the dry cleaning apparatus of Patent Document 1, the impact power of the contact member on the object due to stirring is not high enough to remove highly adhesive dust.

The dry cleaning apparatus of Patent Document 2 needs to improve the cleanliness of the cleaning medium in order to improve the cleaning quality. The centrifugal separation effect of air circulation (cyclone method) is not sufficient for this purpose in terms of separation power. Further, in order to improve cleaning quality, there is a need to replace the cleaning media again and again after the cleaning media attract and hold toner, resulting in cleaning inefficiency and the need for a large amount of cleaning media.

The dry cleaning apparatuses of Patent Document 3 and 4 use metal microspheres, small metal pieces, or granular solids as cleaning media, which scrape and roughen the surface of the objects to be cleaned while removing dirt from the objects, and therefore cannot be used in the case damage to the objects to be cleaned is not allowed.

The dry cleaning apparatus of Patent Document 5 that performs the process of blowing up the cleaning media and the process of regenerating the cleaning media by suction at the same time is effective for cleaning a small vessel. However, in the case of cleaning in a large cleaning tank such as one in which the cleaning media are introduced and moved, the cleaning media do not fly around but stay in the same place because of dispersed energy of flying the cleaning media.

Thus the performance of flying and regenerating the cleaning media is lowered, which results in a lower cleaning performance.

The dry cleaning apparatuses of Patent Documents 6 through 10 require long time for cleaning, and have difficulty in removing highly adhesive particles.

In the dry cleaning apparatus of Patent Document 11, the cleaning media adhere to the wall of the cleaning tank, so that the amount of cleaning media available for cleaning is reduced, which results in lower cleaning efficiency. Further, in the step of removing cleaning media from the object after the cleaning process, the cleaning media adhering to the object increase the time required for removal of the cleaning media. Moreover, the cleaning media are often stuck in joints and seams in the object or in joints and seams in the cleaning tank, which also increases the time required for removal of the cleaning media.

SUMMARY

This disclosure describes means and method to improve cleaning quality and cleaning efficiency by improving the motion speed and degree of cleanliness of a dry cleaning medium. In an aspect of this disclosure, there is provided a cleaning medium for use in dry cleaning that is capable of cleaning a component without damaging the component and without leaving unclean areas even if the component has a complex shape; and a dry cleaning apparatus using the cleaning medium.

This disclosure also describes means and method to facilitate removal of the cleaning medium attached to the cleaned component so as to reduce time required for operations associated with the cleaning process.

In an aspect of this disclosure, there is provided a cleaning medium that flies in an air current in a cleaning tank to collide with an object to be cleaned so as to remove an extraneous substance attached to the object. The cleaning medium comprises an outer surface that comes into contact with the object and an inner surface that remains out of contact with the object. The cleaning medium is flexible and formed in a shape that allows the air current to flow from the outside onto the inner surface of the cleaning medium.

In another aspect of this disclosure, there is provided a dry cleaning apparatus that uses the above-described cleaning medium and comprises a circulating air current generating unit to generate a high-speed air current to cause the cleaning medium to fly in a cleaning tank; a cleaning medium accelerating unit to deliver a high-speed air current to cause the flying cleaning medium to collide with an object to be cleaned so as to remove an extraneous substance such as dust or a particle attached to the object; and a cleaning medium regenerating unit to take suction on and remove the extraneous substance attached to the cleaning medium that has collided with the object.

In still another aspect of this disclosure, there is provided a cleaning medium that flies with an air current to collide with an object to be cleaned so as to remove an extraneous substance attached to the object. The cleaning medium comprises a flexible thin piece including an upright portion extending from a flat base portion.

In an embodiment of this disclosure, a flexible cleaning medium is caused to fly with an air current in a cleaning tank to collide with an object to be cleaned so as to remove an extraneous substance attached to the object. The collision of the cleaning medium with the object is an inelastic collision, and therefore a single collision can cover a wide contact area. Further, when the impact force upon collision with the object is large, the cleaning medium is bent along the shape of the object. Thus, the cleaning medium can clean the object even if the object has a complex shape, resulting in improving the cleaning quality and cleaning efficiency.

Further, when the impact force upon collision with the object is large, the cleaning medium is bent to absorb the energy. Thus, the cleaning medium does not damage the object, thereby achieving stable cleaning, reuse of the object, and contribution to energy saving.

BRIEF DESCRIPTION OF THE DRAWINGS

FIGS. 54A-1 through 54B-2 are diagrams showing other examples of a cleaning medium according to an embodiment of the present invention;

DETAILED DESCRIPTION OF THE PREFERRED EMBODIMENT

Figure 1:
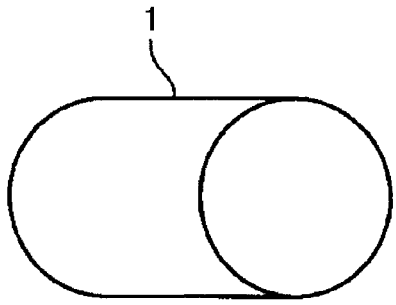
FIG. 1 is a perspective view showing the configuration of a cleaning medium according to an embodiment of the present invention.
Figure 2A:
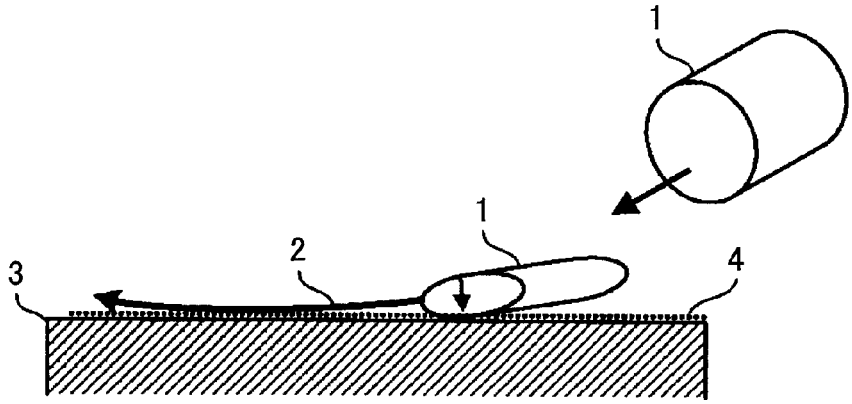
FIGS. 2A and 2B are diagrams for explaining how a flexible tubular cleaning medium removes extraneous substances adhering to an object to be cleaned.
Figure 2B:
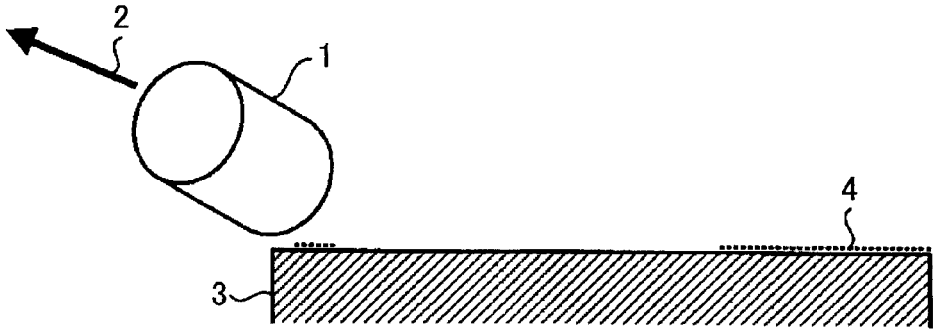

FIG. 1 is a perspective view showing the configuration of a cleaning medium 1 according to an embodiment of the present invention. Referring to FIG. 1, the cleaning medium 1 is flexible and formed in a tubular shape. As shown in FIGS. 2A and 2B, the cleaning medium 1 flies with a high-seed air current 2 to remove extraneous substances 4, such as dust including toner, attached to an object 3 to be cleaned. The material, weight, size, shape, etc., of the cleaning medium 1 may be determined according to the properties of the object 3 (e.g., shape and material) and the properties of the extraneous substances 4 on the object 3 (e.g., the particle size and adhesion force).

An air blowing unit that provides the air current to propel the cleaning medium 1 to fly is disposed in a position spaced away from the fixed position of the object 3 by a predetermined distance. Examples of the air blowing unit include a blower, a compressed air source, air tube, an air blowing nozzle, and a spray device. Any method may be used to propel the cleaning medium 1 to fly in the air current 2 provided by the air blowing unit. For example, the cleaning medium 1 may be mixed with the air in advance so as to be blown out with the air current 2. Alternatively, the cleaning medium 1 may be placed at the outlet of the air blowing unit.

Thus a number of cleaning media 1 in the passage of the air current 2 fly with the air current 2. Many of the cleaning media 1 come into contact or collide with the object 3 to scrape off the extraneous substances 4, thereby cleaning the surface of the object 3. Unlike stationary cleaning units such as a brush, wire, and scraper, the cleaning media 1 can move around and enter every corner of the object 3, resulting in an improved cleaning effect.

An air blowing nozzle connected to the compressed air source may be used as the air blowing unit that generates the air current 2 for propelling the cleaning media 1. The use of such an air blowing nozzle makes it possible to provide a high-speed air current 2 and improve the cleaning performance of the cleaning media 1. The higher the speed of the air current 2, the more frequently the cleaning media 1 come into contact with the object 3, resulting in a reduction of time required for cleaning the object 3 and an increase of the cleaning efficiency.

As described above, since the cleaning medium 1 for cleaning the object 3 is flexible and therefore bendable upon contact or collision with the object 3, it is possible to reduce the impact concentration on the object 3 and improve the cleaning efficiency. Further, if the force of the impact on the object 3 is large, the cleaning medium 1 can bend to absorb a shock due to its flexibility as shown in FIG. 2A. Unlike common blast shot material or barreling media material, it is possible to minimize risks such as damage to the object 3 due to collision with an excessive force. The cleaning medium 1 bends rather than bounces back upon contact or collision, which results in an inelastic collision. Thus the cleaning medium 1 has a greater contact area with the object 3 and removes a greater amount of the extraneous substances 4 from the object 3, achieving higher cleaning efficiency.

The use of the tubular cleaning medium 1 can significantly increase the cleaning performance compared with the cleaning media of other shapes. This is because the tubular cleaning medium 1 is superior over the cleaning media of other shapes in terms of the capacity to follow the air current 2 (i.e., the capacity to fly at high speed and the capacity to perform complex motions) and the behavior at the time of contact or collision (e.g., the effect of the edges, sliding contact, bending effect).

In the following, the capacity to follow the air current 2 is described. The flexible tubular cleaning medium 1 flies at high speed when receiving the force of an air current in the direction in which its projected area is large. This is because its weight is extremely small with respect to the air force. Further, the flexible tubular cleaning medium 1 has a small air resistance in the direction in which its projected area is small. When flying in such a direction, high-speed motion can be maintained for a long distance. The higher the speed of the cleaning medium 1, the greater the energy of the cleaning medium 1, resulting in a larger force being applied to the object 3 upon contact and a higher cleaning quality. Further, the higher the speed of the cleaning medium 1, the greater the frequency of contact with the object 3, resulting in improved cleaning efficiency. Moreover, because the air resistance of the flexible tubular cleaning medium 1 varies significantly depending on its orientation, the flexible tubular cleaning medium 1 can not only move along with the air current 2 but also perform complex motions such as a sudden change in the flight direction. Due to the effect of the high-speed air current 2, air turbulence is generated around the object 3. Further, the flexible tubular cleaning media 1, which are rather susceptible to air resistance for their weights, rotate around themselves and revolve due to the eddies of the air turbulence to contact the object 3 repeatedly. Therefore the cleaning media 1 can provide high cleaning performance and high cleaning efficiency even when the object 3 has a relatively complex shape.

In the following, behavior upon contact or collision is described. When the flexible tubular cleaning medium 1 collides at its end first as shown in FIG. 2A, the force of the impact is concentrated on the end, so that a sufficient force is exerted to remove extraneous substances 4 despite the small weight of the cleaning medium 1. Further, since the flexible tubular cleaning medium 1 bends to absorb a shock if the force of the impact is large, viscosity resistance due to the air largely affects the collision, which results in an inelastic collision. Thus, the time that the cleaning medium 1 is in contact with the object 3 is increased, so that the cleaning performance can be improved. The flexible tubular cleaning medium 1 is not likely to bounce back upon collision. When the cleaning medium 1 collides at an angler the cleaning medium 1 slides on the object 3 as shown in FIG. 2A. Thus the cleaning medium 1 has a greater contact area with the object 3 and removes a greater amount of the extraneous substances 4 from the object 3, thereby achieving higher cleaning efficiency.

On the other hand, typical shot material or elastic sponge material is likely to bounce back upon collision, which means that the contact efficiency with the object 3 upon collision is not as high as that of the flexible tubular cleaning medium 1. Further, in the case of the flexible tubular cleaning medium 1, its wiping motion and scraping motion associated with the sliding contact at the time of contact or collision tend to exert a force on the extraneous substances 4 in the direction parallel to the contact surface. It is known that, in general, a small force can remove the extraneous substances 4 if the force is applied in the direction parallel to the surface on which the extraneous substances 4 are attached rather than if the force is applied in the direction perpendicular to the surface on which the extraneous substances 4 are attached. Conventional granular sponge and granular foam are deformable due to their flexibilities and therefore can have a greater contact area with the object 3 upon collision, but are likely to bounce back or roll over and fail to provide wiping motion and scraping motion associated with sliding contact. Therefore, shear force for removing the extraneous substances 4 is not produced, which makes the cleaning performance of the granular sponge and the granular foam for highly adhesive extraneous substances 4 lower than that of the flexible tubular cleaning medium 1.

What is described above are believed to be the reasons why the flexible tubular cleaning media 1 exhibit higher cleaning performance and higher cleaning efficiency with respect to components of relatively complex shapes compared with the cleaning media of other shapes. These are outstanding features that are not provided by the conventional blast shot materials, barreling media materials, granular sponge, or granular foam.

The shape suitable for the flexible tubular cleaning medium 1 may be of a lateral area of 1 through 1000 $mm^2$ and a tube wall thickness of 1 to 500 μm. Examples of the material suitable for cleaning medium 1 include a resin tube, a thermoplastic elastomer tube, a rubber tube, a cloth tube, a paper tube, and a metal tube. However, without being limited thereto, as mentioned above, the material, weight, size, shape, etc., of the cleaning medium 1 may be determined according to the properties of the object 3 (e.g., shape and material) and the properties of the extraneous substances 4 on the object 3 (e.g., the particle size and adhesion force).

Although various flexible materials may be used as the cleaning medium 1, the Young's modulus according to ASTM D882 of the materials may preferably be 4 GPa or less in terms of enhancing the cleaning efficiency due to inelastic collision resulting from bending motion. In terms of overcoming the resistance during wiping motion resulting from sliding contact, the Young's modulus may preferably be 0.2 GPa or greater. For example, the use of general resin proves flexibility and durability, ensuring that the cleaning medium 1 can be used repeatedly for a long time without damaging the object 3. The use of polyethylene is cost-effective, allowing cost reduction. In the case where plural types of extraneous substances 4 are present on the object 3, plural materials may used for cleaning the plural types of extraneous substances 4. For example, a resin tube is not suitable for adsorbing and removing greasy dirt, but is easily regenerated by dry cleaning because of its low adsorption performance. On the other hand, cloth is suitable for adsorbing and removing greasy dirt, but is not easily regenerated by dry cleaning and cannot withstand repeated use. Especially in the case of repeatedly using the cleaning medium 1, because mechanical strength is required, resin and metal materials are advantageous over paper and cloth materials. Metal materials are plastically deformed by repetitive application of strains, and therefore compounds of micro polymers linked or connected together such as resin tubes, thermoplastic elastomer tubes, and rubber tubes are advantageous over the metal materials. Especially, resin tubes are more likely to cause inelastic collision with the object 3 compared with thermoplastic elastomer tubes and rubber tubes and are therefore advantageous in terms of the cleaning efficiency. As can be understood from the above, because the performance of cleaning the object 3 varies depending on the material, the total cleaning performance can be enhanced by using cleaning media 1 made of various different materials.

Figure 3:
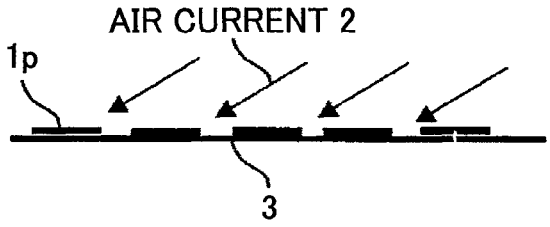
FIG. 3 is a diagram illustrating plate-shaped cleaning media attached to an object to be cleaned.

One problem with the cleaning medium 1 configured to fly with the air current 2 is that the cleaning medium 1 is charged due to friction with the wall of a cleaning tank, the object 3 to be cleaned, or other cleaning media 1 during cleaning. Especially, when the cleaning medium 1 is flying at higher speed for reducing cleaning time, more friction is produced, so that the amount of charge is increased in a short time. As a result, the cleaning media 1 are often attached to the wall of the cleaning tank or the object 3 to be cleaned due to the electrostatic effect. Especially in the case of flexible plate-shape cleaning media 1*p*, the shapes of the cleaning media 1*p* can follow the shape of the object 3 in contact therewith, and the cleaning media 1*p* can come into tight contact with the wall of the cleaning tank or the surface of the object 3 as shown in FIG. 3. Once the cleaning media 1*p* are in tight contact with the wall of the cleaning tank or the surface of the object 3, the space where the air current 2 can enter is reduced between the cleaning media 1*p* and the wall of the cleaning tank or the surface of the object 3. This makes it difficult to discharge the cleaning media 1*p* using a corona discharging unit, because ions can hardly enter the space between the cleaning media 1*p* and the wall of the cleaning tank or the surface of the object 3. As a result, the cleaning media 1*p* remain attached to the wall of the cleaning tank or the surface of the object 3.

Figure 4A:
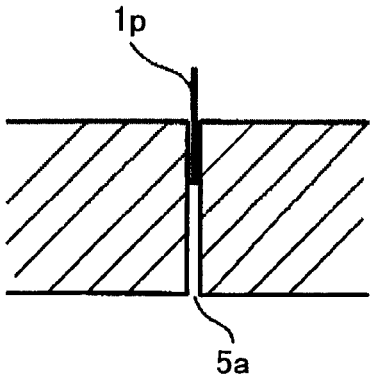
FIGS. 4A and 4B are diagram each illustrating plate-shaped cleaning media stuck in a gap in an object to be cleaned.
Figure 4B:
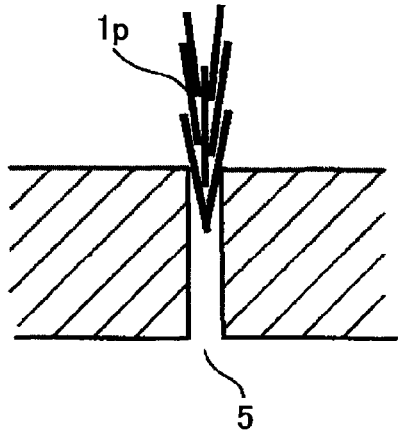
Figure 5:
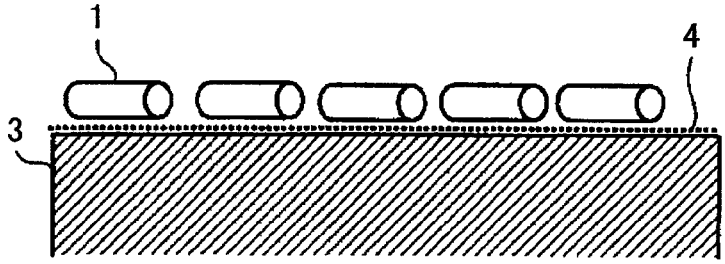
FIG. 5 is a diagram illustrating tubular cleaning media attached to an object to be cleaned.

With reference to FIGS. 4A and 4B, another problem with the cleaning media 1 is that the cleaning media 1*p* can be stuck in joints and seams in the object 3 to be cleaned or in joints and seams in the cleaning tank.

The amount of the cleaning media 1*p* available for cleaning in the cleaning process is therefore reduced, which results in lower cleaning efficiency and longer cleaning time. Moreover, in the process of removing the cleaning media 1*p* from the cleaned object 3, more time is required to remove the cleaning media 1*p*.

To solve these problems, the tubular cleaning medium 1 is used. Since the air current can flow onto the inner surface of the cleaning medium 1, the cleaning medium can fly again with the air current that has flowed onto the inner surface of the cleaning medium 1 even if the cleaning medium 1 is attached to or stuck in the object 3 to be cleaned or the cleaning tank as described above.

Figure 15:
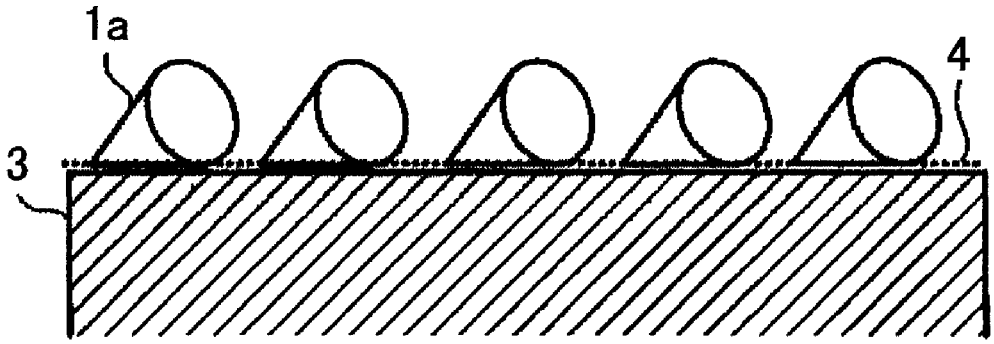
FIG. 15 is a diagram illustrating bag-shaped cleaning media attached to an object to be cleaned.

More specifically, in the cleaning process, even if the tubular cleaning medium 1 is attached to the cleaning tank (or the object 3 as shown in FIG. 15), the air current 2 can flow onto the inner surface of the tubular cleaning medium 1. When the air current 2 flows onto the inner surface of the tubular cleaning medium 1 and the force of the air current separating the cleaning medium 1 from the wall of the cleaning tank is greater than the electrostatic attraction force, the cleaning medium 1 is separated from the wall of the cleaning tank and thus can fly again. Thus, it is possible to prevent a reduction in the amount of cleaning media 1 that contributes to cleaning, thereby maintaining a constant cleaning efficiency. A corona discharging unit may be used in conjunction to provide ions on the surface of the cleaning medium 1 in contact with the wall of the cleaning tank so as to discharge the cleaning medium 1, thereby enhancing the effect of making the cleaning medium 1 fly repeatedly.

Figure 6:
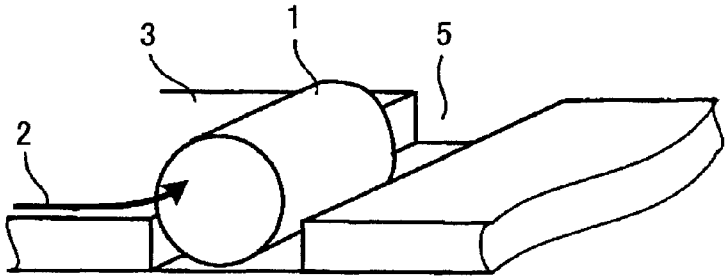
FIG. 6 is a diagram illustrating a tubular cleaning medium stuck in a gap in an object to be cleaned.

Even if the tubular cleaning medium 1 is stuck in a gap 5 as shown in FIG. 6 at a joint or a seam in the object 3 or at a joint or a seam in the cleaning tank, the air current 2 hits the inner surface of the cleaning medium 1 exposed outside the gap 5 to make the cleaning medium fly again, thereby preventing accumulation of the cleaning media 1.

Further, in the process of removing the cleaning medium 1 from the cleaned object 3, when an air current is generated to flow onto the inner surface of the tubular cleaning medium 1 and the force of the air current separating the cleaning medium 1 from the surface of the object 3 is greater than the electrostatic attraction force, the cleaning medium 1 is separated from object 3 and thus can be easily removed. A corona discharging unit may be used in conjunction to provide ions on the surface of the cleaning medium 1 in contact with the object 3 so as to discharge the cleaning medium 1, thereby enhancing the effect of removing the cleaning medium 1.

Thus, in the cleaning process it is possible to prevent a reduction in the amount of the cleaning media 1 that contribute to cleaning and to allow new contact of the cleaning media 1 with the object 3 due to prevention of accumulation of the cleaning media 1 in the gaps in the object 3, thereby maintaining a constant cleaning efficiency. Further, in the process of removing the cleaning media 1 from the cleaned object 3, when an air current is generated to flow into the cleaning medium 1 and hit the cleaning medium 1 the cleaning medium 1 flies again and thus can easily be removed.

To facilitate the repeated flight of the cleaning medium 1, the width of the cleaning medium 1 is not especially limited as long as it is greater than the widths and depths of the gaps at the joints and seams in the object 3 and the joints and seams of the cleaning tank. The cleaning medium 1 may be produced by cutting a tube into a segment of a predetermined length.

Figure 7A:
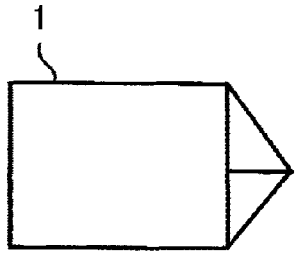
FIGS. 7A through 7C are perspective views each showing a prismatic tubular cleaning medium.
Figure 7B:
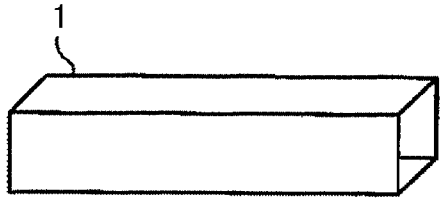
Figure 7C:
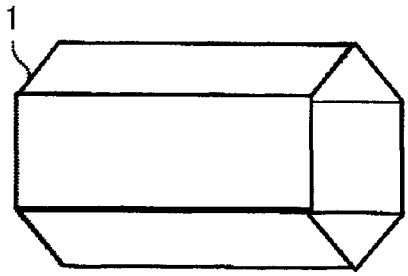

The tubular cleaning medium 1 may have any shape as long as it provides flexibility. Examples of the shape of the tubular cleaning medium 1 include, in addition to the cylindrical shape as shown in FIG. 1, a triangular prism shape, a quadrangular prism shape, and a hexagonal prism shape as shown in FIGS. 7A through 7C. In the case of the tubular cleaning medium 1 having a cylindrical shape, because the posture of the cleaning medium 1 at the time of collision with the object 3 is constant, variation of the cleaning result is reduced. In the case of the tubular cleaning medium 1 having a prismatic shape, because the cleaning medium 1 includes long straight edges and therefore has a greater contact area with the object 3, the cleaning performance is enhanced.

Figure 8A:
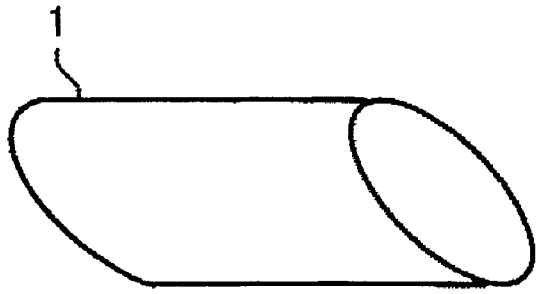
FIGS. 8A through 8C are perspective views each showing a cleaning medium having an acute angle at an end.
Figure 8B:
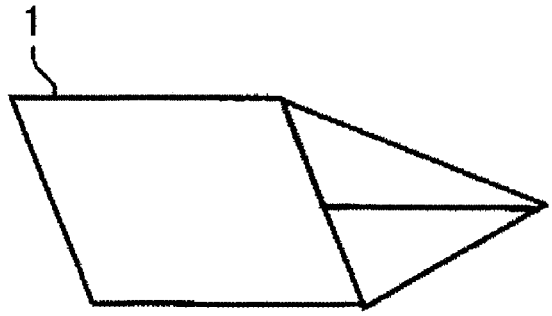
Figure 8C:
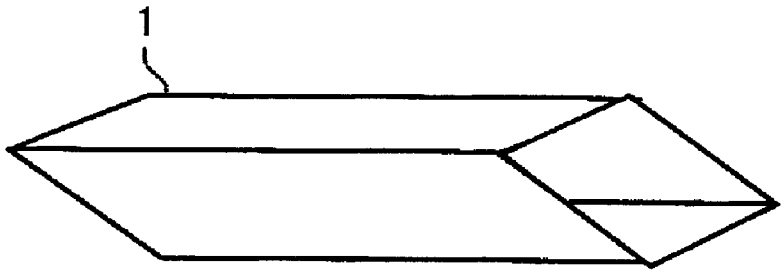

In an embodiment, as shown in FIGS. 8A through 8C, the tubular cleaning medium 1 may be formed such that its side surface and at least an open end surface form an acute angle as shown in FIGS. 8A through 8C. The acute angle portion can reach raised and recessed portions and grooves in the object 3, resulting in reduced residual extraneous substances 4. As can be understood from the above, because the performance of cleaning the object 3 varies depending on the shape of the cleaning medium 1, the total cleaning performance can be enhanced by using cleaning media 1 of various different shapes.

Figure 9A:
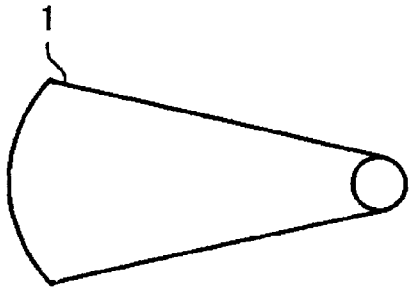
FIGS. 9A and 9B are perspective views each showing a cleaning medium having two openings with different diameters.
Figure 9B:
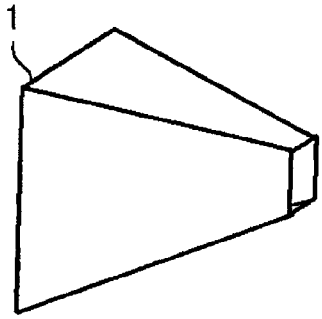

In an embodiment, as shown in FIGS. 9A and 98, the cleaning medium 1 may have an open end having a smaller diameter than the other open end. The cleaning medium 1 having different diameter open ends can clean the raised and recessed portions with the smaller open end and can clean a wide area with the larger open end. Accordingly, the total cleaning performance can be enhanced by using a single type of the cleaning medium 1. This cleaning medium 1 may be produced by, for example, cutting a heat-shrinkable tube into a segment of a predetermined length and then locally heating one of the open ends of the segment to reduce the diameter.

Figure 10:
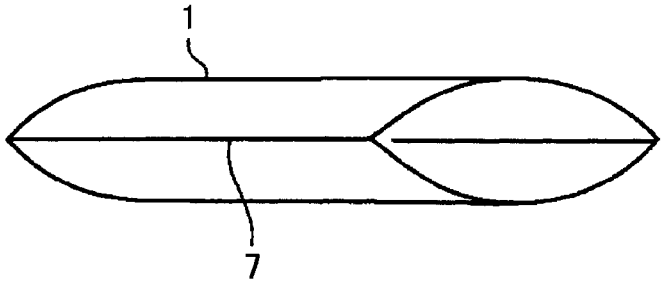
FIG. 10 is a perspective view showing a cleaning medium with folds.

In an embodiment, as shown in FIG. 10, the cleaning medium 1 may have folds 7 on the side surface. The cleaning medium 1 having folds 7 can clean the raised and recessed portions and the grooves with the folds 7. Further, the cleaning medium 1 is easily collapsed due to the folds 7, upon collision with the object 3, thereby preventing damage to the object 3 and enhancing the cleaning efficiency due to inelastic collision. This cleaning medium 1 may be produced by, for example, folding a tube to make folds and then cutting the tube into a segment of a predetermined length.

Figure 11A:
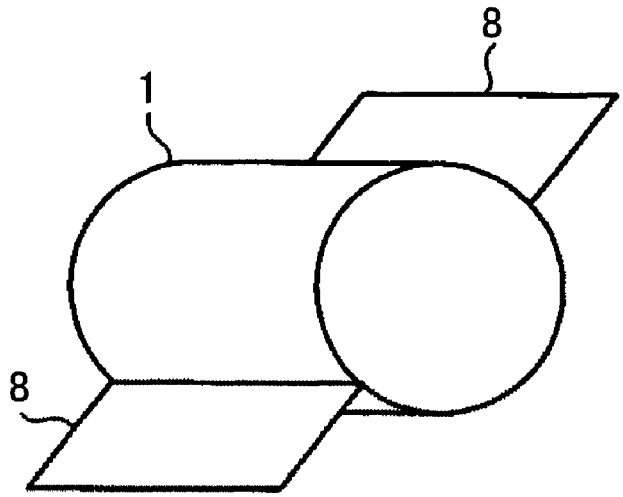
FIGS. 11A and 11B are perspective views each showing a cleaning medium having thin pieces.
Figure 11B:
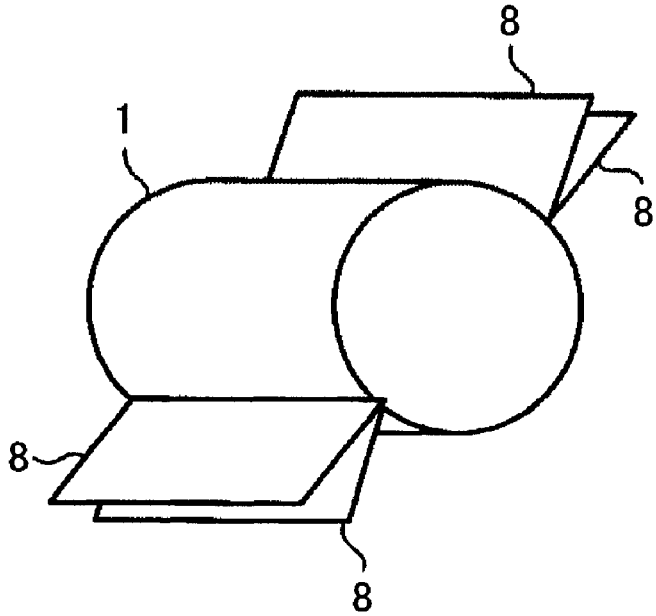
Figure 12A:
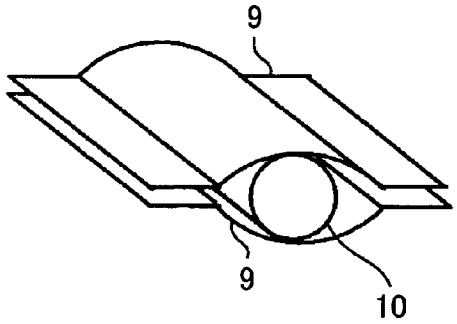
FIGS. 12A and 12B are views for explaining a method of producing a cleaning medium having thin pieces.
Figure 12B:
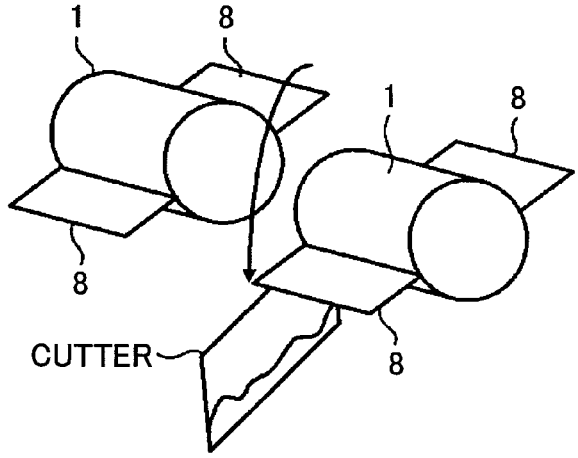

In an embodiment, as shown in FIGS. 11A and 11B, the cleaning medium 1 may include flexible thin pieces 8 on the side surface. The cleaning medium 1 including the flexible thin pieces 8 on the side surface can clean the raised and recessed portions and the grooves with the flexible thin pieces 8. The shapes, sizes and positions of the thin pieces 8 may be suitably determined so as not to reduce the flexibility of the entire cleaning medium 1. This cleaning medium 1 may be produced by, for example, welding the opposing sides of a pair of tapes 9 with a spacer 10 therebetween as shown in FIG. 12A and then cutting the tube into segments of predetermined lengths as shown in FIG. 12B.

Although the embodiments described above are directed to the case where the tubular cleaning media 1 are used for removing the extraneous substances 4 attached to the object 3, a cleaning medium 1*a* formed in the shape of a bag having an opening at one end may be used for removing the extraneous substances 4 attached to the object 3.

Figure 13:
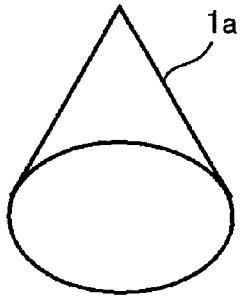
FIG. 13 is a perspective view showing a bag-shaped tubular cleaning medium.
Figure 14A:
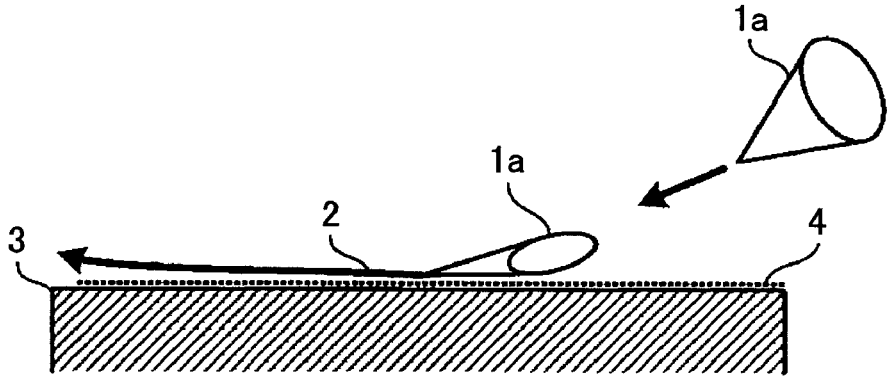
FIGS. 14A and 14B are diagrams for explaining how a flexible bag-shaped cleaning medium removes extraneous substances adhering to an object to be cleaned.
Figure 14B:
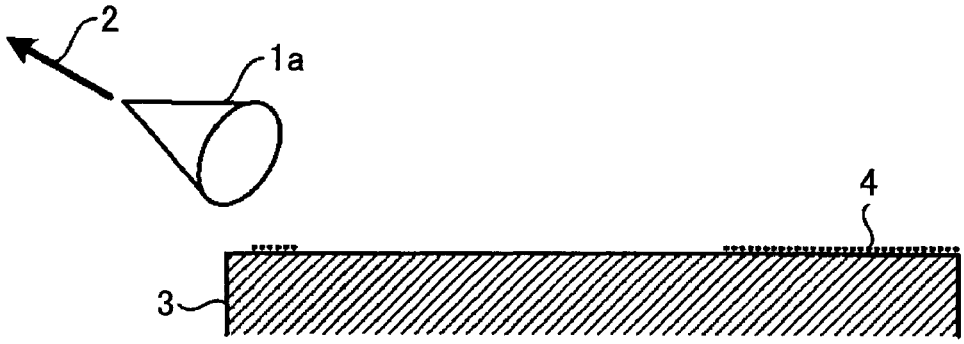

FIG. 13 is a perspective view showing a flexible bag-shaped cleaning medium 1*a*. The cleaning medium 1*a* is formed in a conical shape having an opening at one end. As shown in FIGS. 14A and 14B, the cleaning medium 1*a* flies with a high-speed air current 2 to remove extraneous substances 4, such as dust including toner, attached to the object 3 to be cleaned. The material, weight, size, shape, etc., of the cleaning medium 1*a* may be determined according to the properties of the object 3 (e.g., shape and material) and the properties of the extraneous substances 4 on the object 3 (e.g., the particle size and adhesion force). Because the air current that has flowed into the cleaning medium 1 from the open end cannot flow out of the cleaning medium 1, the cleaning medium 1 flies more easily compared to the tubular cleaning medium 1.

An air blowing unit that provides the air current to propel the cleaning medium 1*a* is disposed in a position spaced away from the fixed position of the object 3 by a predetermined distance. Examples of the air blowing unit include a blower, a compressed air source, air tube, an air blowing nozzle, a spray device. Any method may be used to propel the cleaning medium 1*a* with the air current 2 provided by the air blowing unit. For example, the cleaning medium 1*a* may be mixed with the air in advance so as to be blown out with the air current 2. Alternatively, the cleaning medium 1*a* may be placed at the outlet of the air blowing unit.

Thus a number of cleaning media 1*a* in the passage of the air current 2 fly with the air current 2. Many of the cleaning media 1*a* come into contact with or collide with the object 3 to scrape off the extraneous substances 4, thereby cleaning the surface of the object 3. Unlike stationary cleaning units such as a brush, wire, and scraper, the cleaning media 1*a* can move around and enter every corner of the object 3, resulting in improved cleaning effect.

An air blowing nozzle connected to the compressed air source may be used as the air blowing unit that generates the air current 2 for flying the cleaning media 1*a*. The user of such an air blowing nozzle makes it possible to provide a high-speed air current 2 and improve the cleaning performance of the cleaning media 1*a*. The higher the speed of the air current 2, the more frequently the cleaning media 1*a* come into contact with the object 3, resulting in a reduction of time required for cleaning the object 3 and an increase of the cleaning efficiency.

As described above, since the cleaning medium 1*a* for cleaning the object 3 is flexible and therefore bendable upon contact or collision with the object 3, it is possible to reduce the impact concentration on the object 3 and improve the cleaning efficiency. Further, if the force of the impact on the object 3 is large, the cleaning medium 1*a* can bend to absorb a shock due to its flexibility as shown in FIG. 14A. Unlike common blast shot material or barreling media material, it is possible to minimize risks such as damage to the object 3 due to collision with an excessive force. The cleaning medium 1*a* bends rather than bounces back upon contact or collision, which results in an inelastic collision. Thus the cleaning medium 1*a* has a greater contact area with the object 3 and removes a greater amount of the extraneous substances 4 from the object 3, achieving higher cleaning efficiency.

The use of the bag-shaped cleaning medium 1*a* can significantly increase the cleaning performance compared with the cleaning media of other shapes. This is because the bag-shaped cleaning medium 1*a* is superior over the cleaning media of other shapes in terms of the capacity to follow the air current 2 (i.e., the capacity to fly at high speed and the capacity to perform complex motions) and the behavior at the time of contact or collision (e.g., the effect of the edges, sliding contact, bending effect).

In the following, the capacity to follow the air current 2 is described. The flexible bag-shaped cleaning medium 1*a* flies at high speed when receiving the force of an air current from the open end side. When flying in such a condition, high-speed motion can be maintained for a long distance. The higher the speed of the cleaning medium 1*a*, the greater the energy of the cleaning medium 1*a*, resulting in a larger force being applied to the object 3 upon contact and higher cleaning quality. Further, the higher the speed of the cleaning medium 1*a*, the greater the frequency of contact with the object 3, resulting in improved cleaning efficiency. Moreover, because the air resistance of the flexible bag-shaped cleaning medium 1*a* varies significantly depending on its orientation, the flexible bag-shaped cleaning medium 1*a* can not only move along with the air current 2 but also perform complex motions such as a sudden change in the flight direction. Due to the effect of the high-speed air current 2, air turbulence is generated around the object 3. Further, the flexible bag-shaped cleaning media 1*a* rotate around themselves and revolve due to the eddies of the air turbulence to come into contact with the object 3 repeatedly. Therefore the cleaning media 1*a* can provide high cleaning performance and high cleaning efficiency even when the object 3 has a relatively complex shape.

In the following, behavior upon contact or collision is described. When the flexible bag-shaped cleaning medium 1*a* collides at its end first as shown in FIG. 14A, the force of the impact is concentrated on this end, so that a sufficient force is exerted to remove extraneous substances 4 despite the small weight of the cleaning medium 1*a*. Further, since the flexible bag-shaped cleaning medium 1*a* bends to absorb a shock if the force of the impact is large, viscosity resistance due to the air largely affects the collision, which results in an inelastic collision. Thus, the time that the cleaning medium 1*a* is in contact with the object 3 is increased, so that the cleaning performance can be improved. The flexible bag-shaped cleaning medium 1*a* is not likely to bounce back upon collision. When the cleaning medium 1*a* collides at an angle, the cleaning medium 1*a* slides on the object 3 as shown in FIG. 14A. Thus the cleaning medium 1*a* has a greater contact area with the object 3 and removes a greater amount of the extraneous substances 4 from the object 3, thereby achieving higher cleaning efficiency.

Further, in the case of the flexible bag-shaped cleaning medium 1*a*, its wiping motion and scraping motion associated with the sliding contact at the time of contact or collision tend to exert a force on the extraneous substances 4 in the direction parallel to the contact surface.

What is described above are believed to be the reasons why the flexible bag-shaped cleaning media 1*a* exhibit higher cleaning performance and higher cleaning efficiency with respect to components of relatively complex shapes compared with the cleaning media of other shapes. These are outstanding features that are not provided by the conventional blast shot materials, barreling media materials, granular sponge, or granular foam.

The shape suitable for the flexible bag-shaped cleaning medium 1*a* may be of a lateral area of 1 through 1000 $mm^2$ and a tube wall thickness of 1 to 500 μm. Examples of the material suitable for the cleaning medium 1*a* include a resin tube, a thermoplastic elastomer tube, a rubber tube, a cloth tube, a paper tube, and a metal tube. However, without being limited thereto, as mentioned above, the material, weight, size, shape, etc., of the cleaning medium 1*a* may be determined according to the properties of the object 3 (e.g., shape and material) and the properties of the extraneous substances 4 on the object 3 (e.g., the particle size and adhesion force).

Although various flexible materials may be used as the cleaning medium 1*a*, the Young's modulus according to ASTM D882 of the materials may preferably be 4 GPa or less in terms of enhancing the cleaning efficiency due to inelastic collision resulting from bending motion. In terms of overcoming the resistance during wiping motion resulting from sliding contact, the Young's modulus may preferably be 0.2 GPa or greater. For example, the use of general resin proves flexibility and durability, ensuring that the cleaning medium 1 can be used repeatedly for a long time without damaging the object 3. The use of polyethylene is cost-effective, allowing cost reduction. In the case where plural types of extraneous substances 4 are present on the object 3, plural materials may be used for cleaning the plural types of extraneous substances 4. For example, a resin tube is not suitable for adsorbing and removing greasy dirt, but is easily regenerated by dry cleaning because of its low adsorption performance. On the other hand, cloth is suitable for adsorbing and removing greasy dirt, but is not easily regenerated by dry cleaning and cannot withstand repeated use. Especially in the case of repeatedly using the cleaning medium 1*a*, because mechanical strength is required, resin and metal materials are advantageous over paper and cloth materials. Metal materials are plastically deformed by repetitive application of strains, and therefore compounds of micro polymers linked or connected together such as resin tubes, thermoplastic elastomer tubes, and rubber tubes are advantageous over the metal materials. Especially, resin tubes are more likely to cause inelastic collision with the object 3 compared with thermoplastic elastomer tubes and rubber tubes and are therefore advantageous in terms of the cleaning efficiency. As can be understood from the above, because the performance of cleaning the object 3 varies depending on the material, the total cleaning performance can be enhanced by using cleaning media 1*a* made of various different materials.

In the cleaning process, even if the bag-shaped cleaning media 1*a* are attached to the cleaning tank (or the object 3 as shown in FIG. 15), the air current 2 can flow onto the inner surface of the bag-shaped cleaning media 1*a*. When the air current 2 flows onto the inner surface of the bag-shaped cleaning medium 1*a* and the force of the air current separating the cleaning medium 1*a* from the wall of the cleaning tank is greater than the electrostatic attraction force, the cleaning medium 1*a* is separated from the wall of the cleaning tank and thus can fly again. Thus, it is possible to prevent a reduction in the amount of cleaning media 1*a* that contributes to cleaning, thereby maintaining a constant cleaning efficiency. A corona discharging unit may be used in conjunction to provide ions on the surface of the cleaning medium 1*a* in contact with the wall of the cleaning tank so as to discharge the cleaning medium 1*a*, thereby enhancing the effect of making the cleaning medium 1*a* fly repeatedly.

Figure 16:
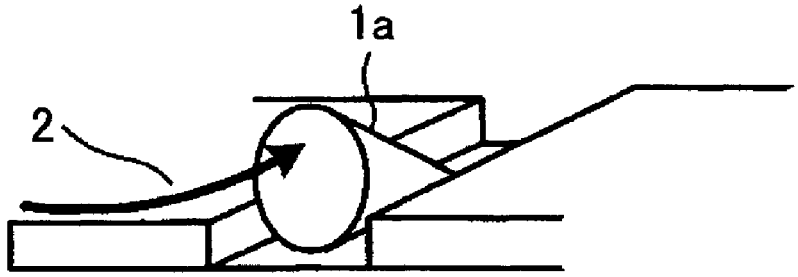
FIG. 16 is a diagram illustrating a bag-shaped cleaning medium stuck in a gap in an object to be cleaned.

Even if the bag-shaped cleaning medium 1*a* is stuck in a gap 5 as shown in FIG. 16 at a joint or a seam in the object 3 or at a joint or a seam in the cleaning tank, the air current 2 hits the inner surface of the cleaning medium 1*a* exposed outside the gap 5 to make the cleaning medium fly again, thereby preventing accumulation of the cleaning media 1*a*.

Further, in the process of removing the cleaning medium 1*a* from the cleaned object 3, when an air current is generated to flow into the bag-shaped cleaning medium 1*a* and the force of the air current separating the cleaning medium 1*a* from the surface of the object 3 is greater than the electrostatic attraction force, the cleaning medium 1*a* is separated from object 3 and thus can be easily removed. A corona discharging unit may be used in conjunction to provide ions on the surface of the cleaning medium 1*a* in contact with the object 3 so as to discharge the cleaning medium 1*a*, thereby enhancing the effect of removing the cleaning medium 1*a*.

Thus, in the cleaning process it is possible to prevent a reduction in the amount of the cleaning media 1*a* that contribute to cleaning and to allow new contact of the cleaning media 1*a* with the object 3 due to prevention of accumulation of the cleaning media 1*a* in the gaps in the object 3, thereby maintaining a constant cleaning efficiency. Further, in the process of removing the cleaning media 1*a* from the cleaned object 3, when an air current is generated to flow into the cleaning medium 1*a* and hit the cleaning medium 1*a*, the cleaning medium 1*a* flies again and thus can easily be removed.

Figure 17:
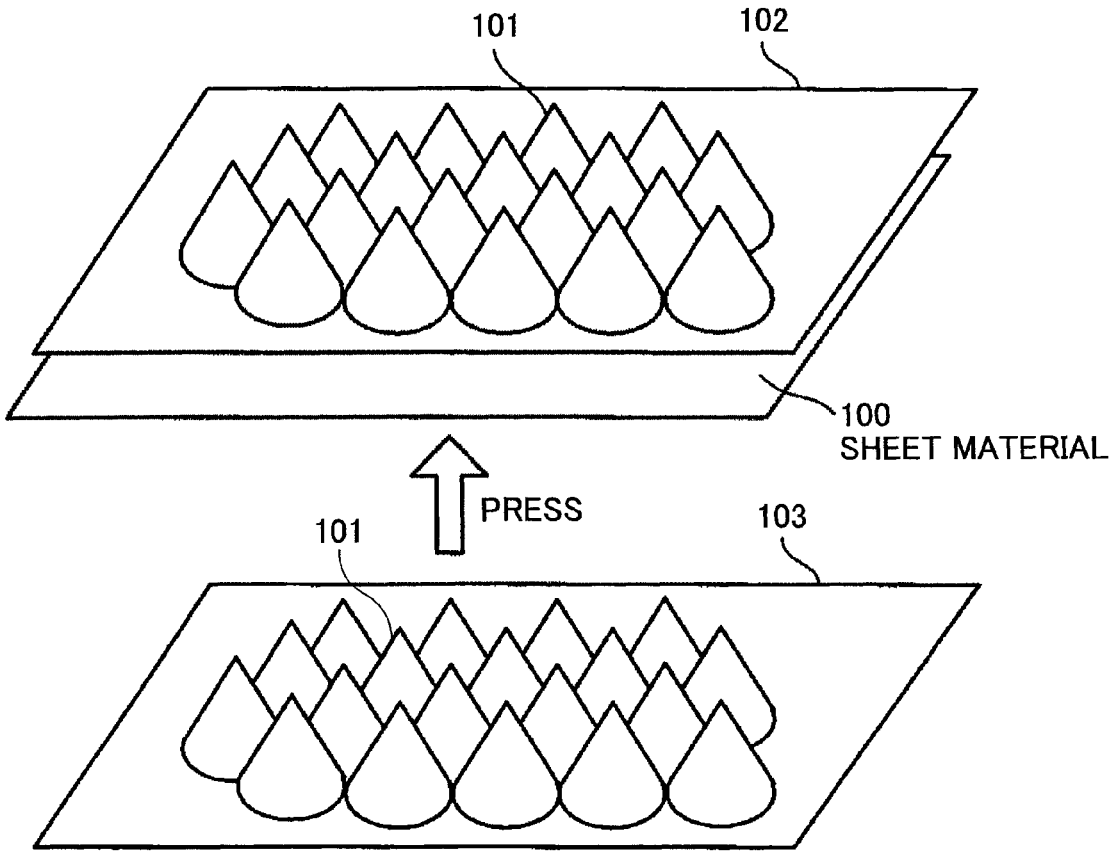
FIG. 17 is a view for explaining a method of producing a bag-shaped cleaning medium.

To facilitate the repeated flight of the cleaning medium 1*a*, the width of the cleaning medium 1*a* is not especially limited as long as it is greater than the widths and depths of the gaps at the joints and seams in the object 3 and the joints and seams of the cleaning tank. This cleaning medium 1*a* may be produced by, for example as shown in FIG. 17, press molding sheet material 100 with press molds 102 and 103 having plural projections. Not only press molding but also other methods may be used such as vacuum molding and compression molding.

Figure 18A:
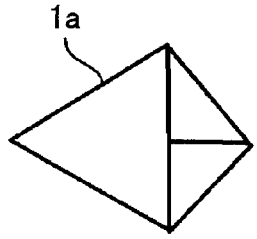
FIGS. 18A through 18C are perspective views each showing a pyramidal bag-shaped cleaning medium.
Figure 18B:
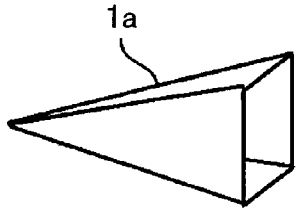
Figure 18C:
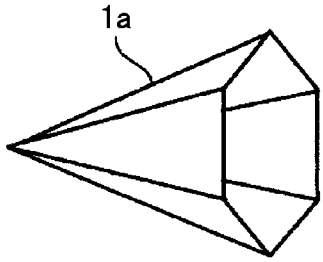

The bag-shaped cleaning medium 1*a* may have any shape as long as it provides flexibility. Examples of the shape of the bag-shaped cleaning medium 1*a* include, in addition to the conical shape as shown in FIG. 13, pyramid shapes such as a three-sided pyramid shape, a four-sided pyramid shape, and a six-sided pyramid shape as shown in FIGS. 18A through 18C. In the case of the cleaning medium 1*a* having a conical shape, because the posture of the cleaning medium 1*a* at the time of collision with the object 3 is constant, variation of the cleaning result is reduced. In the case of the cleaning medium 1*a* having a pyramid shape, because the cleaning medium 1*a* includes long straight edges and therefore has a greater contact area with the object 3, the cleaning performance is enhanced.

Figure 19:
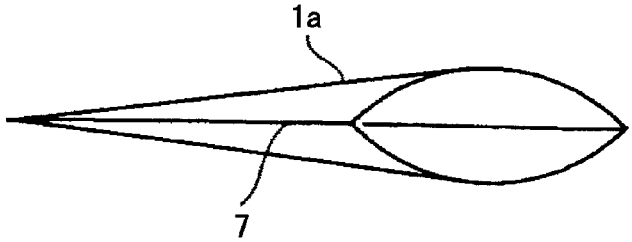
FIG. 19 is a perspective view showing a bag-shaped cleaning medium with folds.

In an embodiment, as shown in FIG. 19, the cleaning medium 1*a* may have folds 7 on the side surface. The cleaning medium 1*a* having folds 7 can clean raised and recessed portions and the grooves with the folds 7. Further, the cleaning medium 1*a* is easily collapsed due to the folds 7 upon collision with the object 3, thereby preventing damage to the object 3 and enhancing the cleaning efficiency due to inelastic collision. This cleaning medium 1*a* may be produced by, for example, press molding sheet material 100 as described above and then making folds.

Each of the cleaning media 1 and 1*a* may preferably be made of or include an antistatic material. To achieve effective antistatic performance, the surface resistance of the cleaning medium 1 (1*a*) may preferably be $10^{10}$ Ω/sq. or less. In the case where the cleaning medium 1 (1*a*) is made of metal, the cleaning medium 1 (1*a*) itself is antistatic. In the case where the cleaning medium 1 (1*a*) is made of resin, any of the following types of antistatic techniques may be used, which are generally classified into three categories, namely, a kneading type, a coating type, a combination of the these two types.

The kneading type is for kneading an antistatic agent into resin in advance. The kneading type is subdivided into a non-stretching type, a biaxial stretching type, and an inflation type. In the case of utilizing ion conduction, examples of an antistatic agent include surfactants (anion surfactant, cationic surfactant, nonionic surfactant, ampholytic surfactant) and hydrophilic macromolecules, which are well known in the art. In the case of utilizing electron conduction, metal particles, conductive particles (conductive carbon, oxide semiconductor, etc.) conductive polymer that are well known in the art can be used as a conductive filler. The coating type is for coating the surface of the cleaning medium 1 (1*a*) with an antistatic agent, thereby forming a layer that provides an antistatic effect. The antistatic agent that can be used is one suitable for coating, which may be selected from aqueous, oily, organic, inorganic, and polymeric antistatic agents that are well known in the art. The layer is generally of submicron thickness, but may be 0.1 μm or less to exert the effect.

The use of this cleaning medium 1 (1*a*) can prevent increase of charges due to friction and can reduce the electrostatic effect of the cleaning medium 1 (1*a*) being attracted to the wall of the cleaning tank or the object 3 to be cleaned. Thus, the cleaning medium 1 (1*a*) can be separated from the wall of the cleaning tank or the object 3 with reduced air current 2, which allows downsizing of the air current generation equipment and leads to reduction of energy consumption. A corona discharging unit may be used in conjunction to improve the effect of making the cleaning media 1 and 1*a* fly repeatedly.

At least a part of the inner surface of the cleaning medium 1 (1*a*) may be covered with a ferromagnetic material. For example, a mixture of magnetic powder (e.g., γ iron oxide and cobalt doped ion oxide) and synthetic resin serving as a binder may be applied to the inner surface of the cleaning medium 1 (1*a*). Alternatively, cobalt is deposited on the outer surface of the cleaning medium 1 (1*a*), and then the cleaning medium 1 (1*a*) is turned inside out. Other magnetically-attractable materials that can be formed into a film may be used as the ferromagnetic material for covering the inner surface. In the case of the cleaning medium 1 (1*a*) of this configuration, a magnetic force generated by a magnetic force generating unit can exert a force that separates the cleaning medium 1 (1*a*) from the wall of the cleaning tank or the object 3. Further, in the process of removing the cleaning media 1 from the cleaned object 3, even if the cleaning medium 1 (1*a*) is attached to the object 3 or stuck in a gap in the object 3, when the magnetic force generated by the magnetic force generating unit such as a permanent magnet and an electromagnet together with the force of the air current that has flowed into the cleaning medium 1 (1*a*) for separating the cleaning medium 1 (1*a*) from the object 3 are greater than the electrostatic attraction force, the cleaning medium 1 (1*a*) is separated from the wall of the cleaning tank and thus can fly again. Thus, the cleaning medium 1 (1*a*) can be separated from the wall of the cleaning tank or the object 3 with reduced air current 2, which allows downsizing of the air current generation equipment and leads to reduction of energy consumption. A corona discharging unit may be used in conjunction to improve the effect of making the cleaning media 1 (1*a*) fly repeatedly. It is to be noted that the magnetic material on the inner surface of the cleaning medium 1 (1*a*) does not come into direct contact with the object 3, which prevents the object 3 from being contaminated with the magnetic material.

At least a part of the inner surface of the cleaning medium 1 (1*a*) may be covered with a luminescent material or a light reflection material. In this case, the cleaning medium 1 (1*a*) may be made of a material that can transmit the light from the luminescent material or the light reflection material. For example, if a light storing material is used to cover at least a part of the inner surface of the cleaning medium 1 (1*a*), the pigment may be subjected to ultraviolet radiation before the cleaning process such that the cleaning medium 1 (1*a*) can emit light. Thus, the cleaning medium 1 (1*a*) remaining on the object 3 can be quickly determined through detection of the light from the cleaning medium 1 (1*a*). Further, the lights of the cleaning media 1 (1*a*) are blocked by the extraneous substances 4 such as toner, so that the amount of light detected by a light detecting unit varies. Therefore, it is possible to determine the dirtiness of the cleaning media 1 (1*a*) and the progress of the cleaning process based on the degree of the change in the amount of the light of the cleaning media 1 (1*a*) between before and after the cleaning. If a fluorescent material is used to cover at least a part of the inner surface of the cleaning medium 1 (1*a*), ultraviolet radiation is performed upon light detection so as to detect a visible light, thereby determining the dirtiness of the cleaning media 1 (1*a*) and the progress of the cleaning process. If a light reflection material is used to cover at least a part of the inner surface of the cleaning medium 1 (1*a*), radiation of light is performed upon light detection so as to detect a reflection light, thereby determining the dirtiness of the cleaning media 1 (1*a*) and the progress of the cleaning process. It is to be noted that the luminescent material or the light reflection material on the inner surface of the cleaning medium 1 (1*a*) does not come into direct contact with the object 3, which prevents the object 3 from being contaminated with the luminescent material or the light reflection material.

Figure 20:
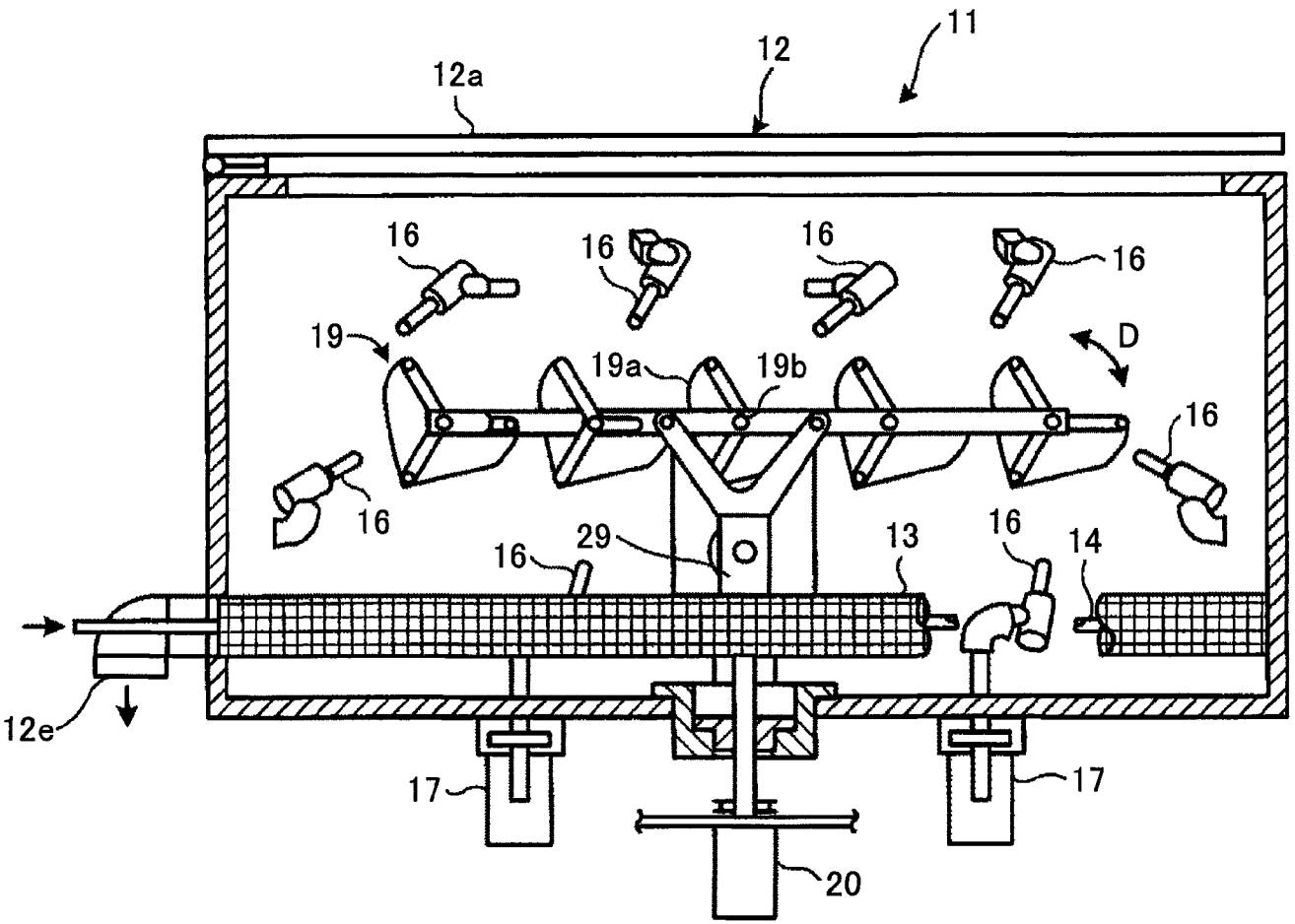
FIG. 20 is a schematic cross-sectional front view illustrating the configuration of a dry cleaning apparatus.
Figure 21:
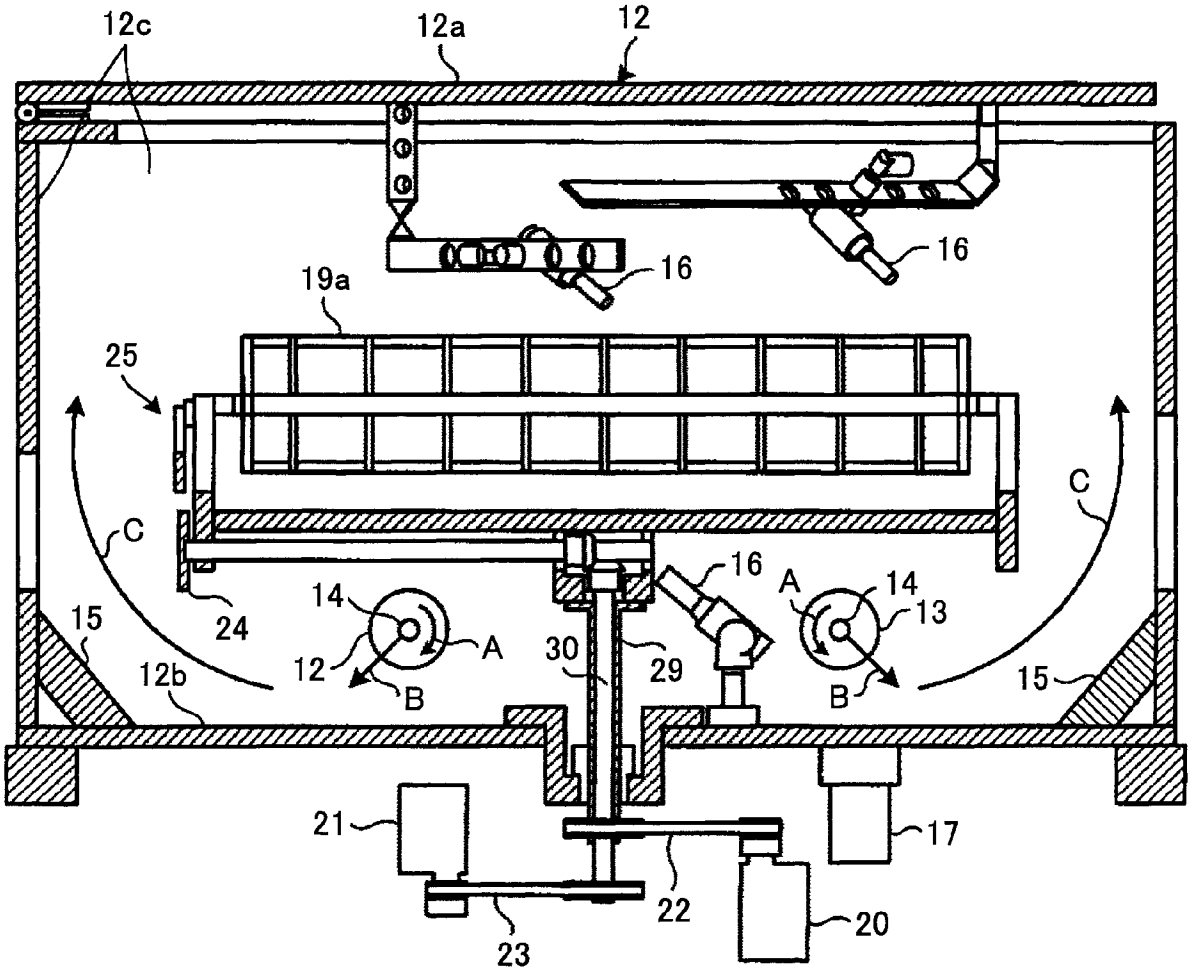
FIG. 21 is a schematic cross-sectional side view illustrating the configuration of a dry cleaning apparatus.

In the following, a dry cleaning apparatus 11 that uses the cleaning medium 1 or the cleaning media 1*a* (hereinafter referred to as the cleaning medium 1) is described. FIGS. 20 and 21 illustrate the configuration of the dry cleaning apparatus 11. More specifically, FIG. 20 is a schematic cross-sectional front view of the dry cleaning apparatus 11, and FIG. 21 is a schematic cross-sectional side view of the dry cleaning apparatus 11. With reference to FIGS. 20 and 21, the dry cleaning apparatus includes a cleaning tank 12, a cylindrical mesh 13, nozzles 14 of Type 1, corner blocks 15, nozzles 16 of Type 2, Type 2 nozzle rotating motors 17, a Type 2 nozzle transport motor (not shown), a work holding unit 19, a work horizontally-rotating motor 20, a work swinging motor 21, timing belts 22 and 23, a rotating joint 24, and a swing link mechanism 25.

Figure 22:
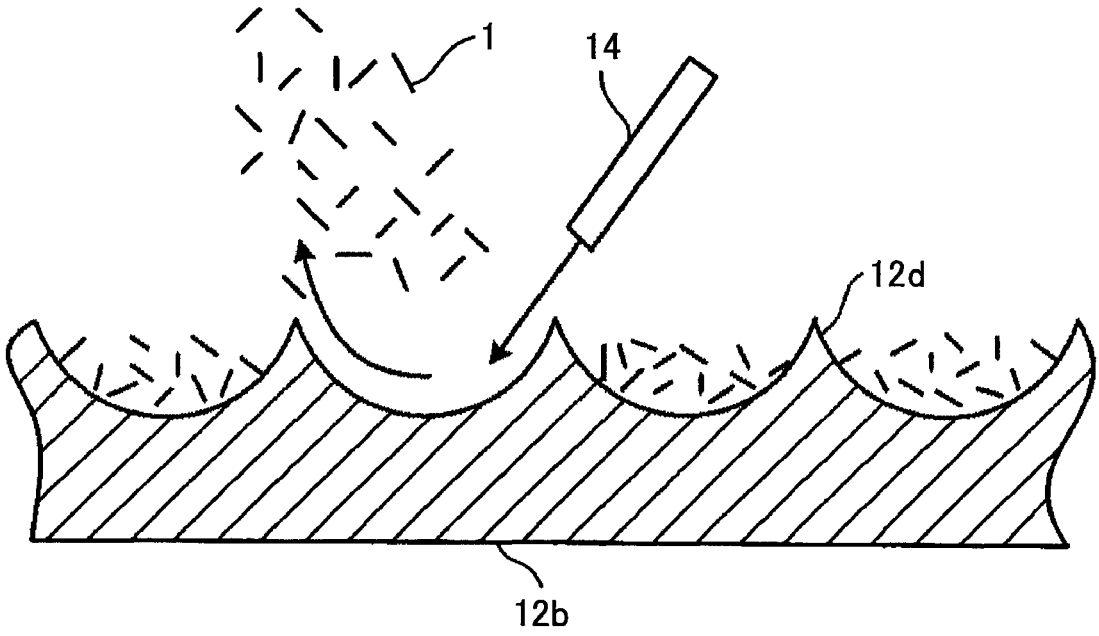
FIG. 22 is a schematic cross-sectional view illustrating recesses in the bottom surface of a cleaning tank.

The cleaning tank 12 has a box shape for accommodating the object 3 to be cleaned and the cleaning media 1 (neither shown), and includes a lid 12*a*, which is opened and closed for placement and removal of the object 3. To make the cleaning media 1 fly easily with air currents from the Type 1 nozzles 14 having a function of propelling and dispersing the cleaning media 1, it is preferable to eliminate right angle corners and acute angle corners at the joints between a bottom surface 12*b* and walls 12*c* as shown in FIG. 21. Therefore, the corner blocks 15 are disposed at the joints to form obtuse or smooth joint such that the air currents directed at the bottom surface 12*b* become upward air currents that make the cleaning media 1 fly upward along the walls 12*c*. Thus, it is possible to easily make the cleaning media 1 on the bottom surface 12*b* of the cleaning tank 12 fly and scatter. It is preferable to form plural cylindrically-curved R grooves or concave-curved recesses 12*d* may be formed as shown in the schematic partial cross-sectional view of FIG. 22 such that the currents from the Type 1 nozzles 14 are directed at the bottom surface 12*b*. With this configuration, upward air currents are generated along the R grooves or recesses 12*d* in the bottom surface 12*b* so that the effect of propelling and dispersing the cleaning media 1 resting on the bottom surface 12*b* of the cleaning tank 12 is increased. Thus, it is possible to make a number of the cleaning media 1 collide with the object 3 to be cleaned, resulting in efficient cleaning. The concave curve is selected as appropriate, and may be a part of sphere, a part of spheroid, or the like.

An outlet port 12*e* for ejecting the extraneous substances 4, which has been removed from the object 3, from the cleaning tank 12 is provided in one of walls 12*c*. The outlet port 12*e* is connected to a filter and a dust collector (neither shown). The outlet port 12*e* is provided with a cylindrical mesh 13 that prevents the cleaning media 1 from being ejected from the cleaning tank 12. The cylindrical mesh 13 may be made of a metal net or the like that have a number of openings sized to allow the extraneous substances 4 such as dust removed from the object 3 to pass through but not the cleaning media 1. The mesh 13 may be preferably one that has little air resistance and to which the extraneous substances 4 are not easily attached. When the cleaning media 1 are attracted to and come into contact with the cylindrical mesh 13, the extraneous substances 4 such as dust attached to the cleaning media 1 are scraped off or beaten off to be separated from the cleaning media 1. Then the extraneous substances 4 pass through the cylindrical mesh 13 to be ejected from the outlet port 12*e* to the outside of the cleaning tank 12.

The Type 1 nozzles 14 provide a function of preventing clogging of the mesh 13 as well as the function of making the cleaning media 1 fly and scatter. More specifically, each nozzle 14 is formed of an air blowing nozzle that has a large number of small holes aligned in the axial direction of the hollow cylinder so as to make the cleaning media 1 fly and scatter in the cleaning tank 12. The nozzle 14 includes a nozzle position and orientation changing unit and is configured to be driven by a motor (not shown) so as to rotate or swing reciprocally during the cleaning operation. When the nozzles 14 are provided with compressed air through the rotating joints and rotated in the direction indicated by the arrows A of FIG. 21, the nozzles 14 discharge air currents indicated by the arrows B, which can circulate in the entire cleaning tank 12, so that the cleaning media 1 on the bottom surface 12*b* of the cleaning tank 12 are blown up along the bottom surface 12*b* and the walls 12*c* as indicated by the arrows C and fly around in the cleaning tank 12 again. Thus it is possible to prevent the cleaning media 1 from staying in some places in the cleaning tank 12 without flying and scattering. The nozzles 14 are disposed inside the cylindrical mesh 13, and serve also to make the cleaning media 1 attracted to and accumulated on the cylindrical mesh 13 to fly apart again in the cleaning tank 12. That is, the nozzles 14 prevent the mesh 13 from being completely clogged with the cleaning media 1 attracted and attached to the mesh 13.

Figure 23:
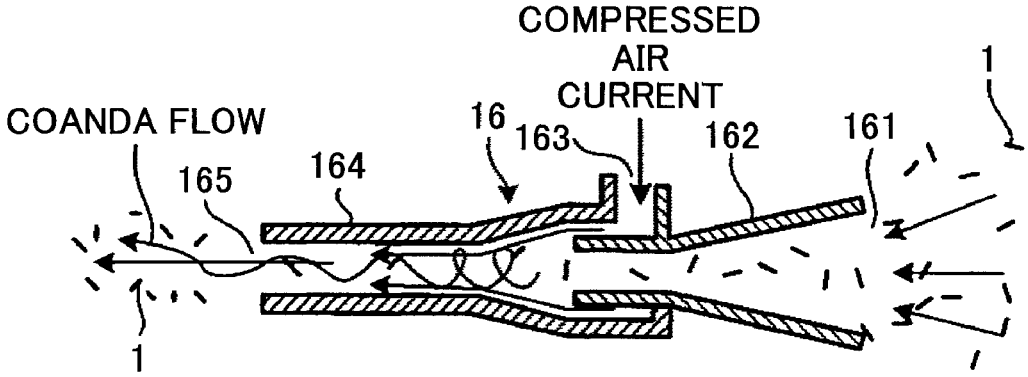
FIG. 23 is a cut-away side view showing the configuration of a nozzle.

The Type 2 nozzles 16 provide a function of accelerating the cleaning media 1 as well as the function of making the cleaning media 1 fly and scatter. A large number of Type 2 nozzles 16 are provided inside the cleaning tank 12 so as to accelerate the cleaning media 1 flying inside the cleaning tank 12 toward the object 3 to be cleaned. Although general purpose air blowing nozzles can be used as the nozzles 16, injection nozzles utilizing the Coanda effect are preferably used in order to reduce air consumption by a large number of the nozzles 16. The air nozzles utilizing the Coanda effect can generate the air current of a volume of a few times through twenty times the volume of the consumed air, and therefore can accelerate a large number of the cleaning media 1 with little air consumption. Various types of injection nozzles utilizing the Coanda effect have been known. FIG. 23 shows an example of the nozzle 16 using one of such injection nozzles. As shown in FIG. 23, the nozzle 16 includes a suction portion 162 having a suction port 161; and a delivery portion 164 having a compressed air supply port 163 on the outlet-side outer surface of the suction portion 162. The nozzle 16 is configured to take suction on from the suction portion 162 due to a high-speed air current flowing from the compressed air supply port 163 toward a delivery port 165 of the delivery portion 164 and deliver, from the delivery port 165, air of a volume a few times through twenty times of the volume of the compressed air supplied from the compressed air supply port 163. The cleaning media 1 pass through the nozzle 16 and thus can be efficiently accelerated. Since the cleaning media 1 can be efficiently accelerated, the required cleaning performance can be achieved even with little air supply. If the volume of air supply is the same, the air blowing nozzle utilizing the Coanda effect can achieve higher cleaning performance than the general purpose air blowing nozzle. Unlike the case of the Type 1 nozzles 14, because there is no obstruct between the Type 2 nozzles 16 and the object 3, the object 3 can be directly subjected to the accelerated air current and the energy of the cleaning media 1, resulting in high performance of removing the extraneous substances 4, namely, high cleaning performance. The positions and the orientations of the nozzles 16 may be changed to change at least the blasting positions or the blasting directions of the nozzles 16, thereby uniformly cleaning the object 3 and reducing the time required for cleaning.

Figure 24:
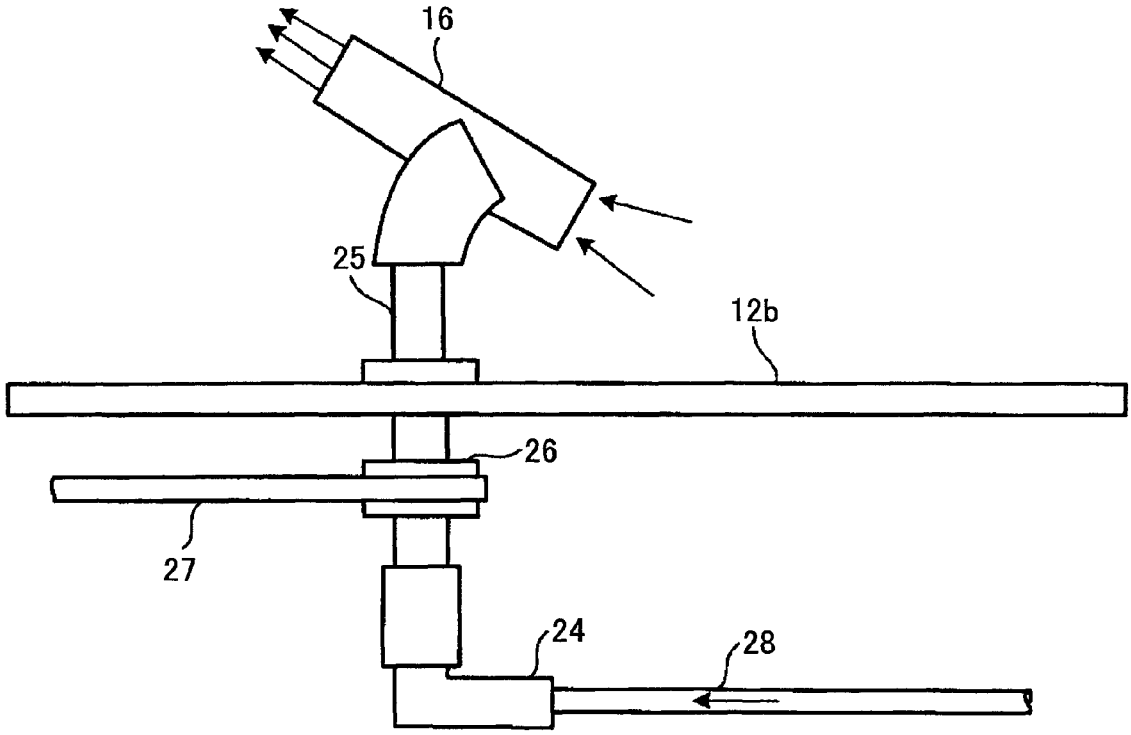
FIG. 24 is a schematic diagram showing the configuration of a nozzle rotating mechanism.

To change the positions and orientations of the Type 2 nozzles 16, the nozzles 16 disposed on the bottom surface 12*b* and the walls 12*c* of the cleaning tank 12 as shown in FIGS. 20 and 21 are rotated or oscillated by nozzle rotating motors 17, and the nozzles 16 disposed on the lid 12*a* of the cleaning tank 12 is linearly reciprocally moved by the nozzle transport motor (not shown). An example of a rotating mechanism that rotates the nozzle 16 is shown in FIG. 24. Each of the nozzles 16 disposed on the bottom surface 12*b* and the walls 12*c* is held by the hollow nozzle rotating shaft 25 coupled to the rotating joint 24. The nozzle rotating shaft (swing link mechanism) 25 includes a timing pulley 26. A timing belt 27 runs over the timing pulley 26, which is rotated by the nozzle rotating motor 17. By driving the nozzle rotating motor 17 while supplying compressed air from a compressed air supply pipe 28 to the nozzle 16 through the rotating joint 24 and the hollow nozzle rotating shaft 25, the nozzle 16 is oscillated or rotated. Thus, the nozzle 16 can be freely moved, rotated, and shifted.

The work holding unit 19 includes, e.g., five work holders 19*a* on a rotating shaft 19*b* for holding the object 3 to be cleaned. The work holding unit 19 is held by a rotatable hollow shaft 29 and is rotated in a horizontal plane by a rotary torque of the work horizontally-rotating motor 20, which is attached to the bottom surface 12*b* of the cleaning tank 12, transmitted through the timing belt 22 to the hollow shaft 29. A torque of the work swing motor 21 is transmitted through the timing belt 23 to a coaxial shaft 30 inside the hollow shaft 29, and then swings the work holders 19*a* as indicated by the arrow D of FIG. 20 through the rotating gear 24 and the swing link mechanism 25. Since the work holders 19*a* are rotatable and swingable, it is possible to subject the object 3 to the cleaning media 1 from various angles, thereby making it possible to uniformly clean the object 3 in a shorter time even if the object 3 has a complex shape.

The following describes the cleaning operation performed by the dry cleaning apparatus 11 for removing the extraneous substances 4 from the object 3 using the cleaning media 1 in the order of steps.

Step of flying, scattering, accelerating and bringing into collision the cleaning media (1) The cleaning media 1 are placed into the cleaning tank 12. The object 3 is held by the work holding unit 19, and the lid 12*a* of the cleaning tank 12 is closed. Then, compressed air is supplied to the nozzles 14 and the nozzles 16 facing the bottom surface 12*b* of the cleaning tank 12 such that the cleaning media 1 on the bottom surface 12*b* are blown up along the bottom surface 12*b* and the walls 12*c* of the cleaning tank 12 to fly and scatter.

Figure 25:
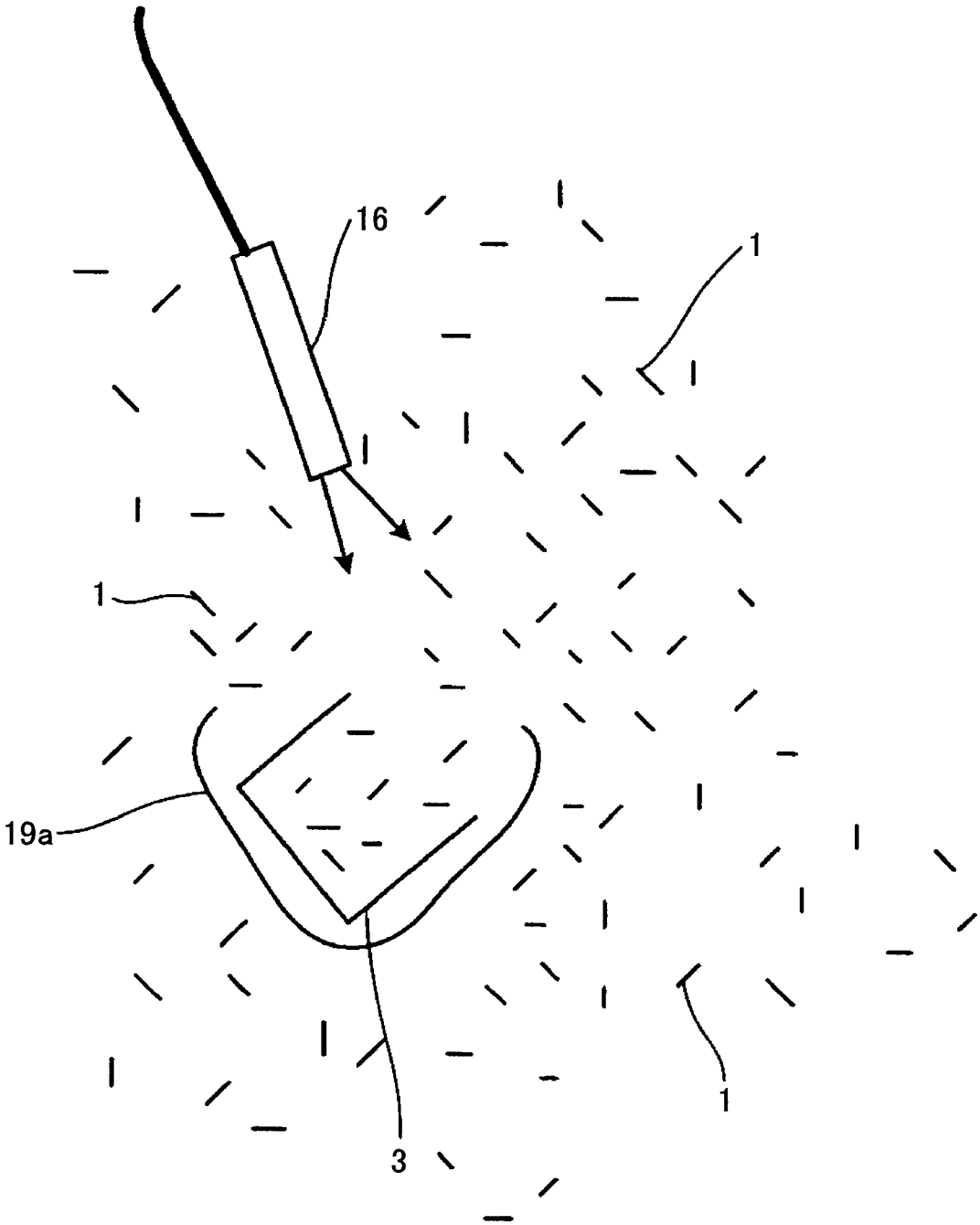
FIG. 25 is a diagram for explaining how the air current from a nozzle causes cleaning media to collide with an object to be cleaned.

(2) As illustrated in FIG. 25, compressed air is supplied to the nozzle 16 facing the object 3 to accelerate the cleaning media 1 flying inside the cleaning tank 12 such that the cleaning media 1 collide with the object 3 at the speed as high as, e.g., 10 m/s.

(3) The nozzle 16 facing the object 3 is oscillated or reciprocally moved for varying its position and orientation (blowing direction), thereby uniformly cleaning the entire surface of the object 3. Since the position or the orientation (the blowing position or the blowing direction) of the nozzle 16 is changed, the nozzle 16 can provides both the function of propelling and scattering the cleaning media 1 and the function of accelerating and bringing into collision the cleaning media 1.

(4) The work holding unit 19 is horizontally rotated and swung for varying the positional relationship between the nozzle 16 and the object 3, thereby causing the cleaning media 1 to uniformly come into contact or collide with the entire surface of the object 3.

Step of cleaning with contact by the cleaning media (5) The cleaning media 1 come into contact or collide with the object 3 to be cleaned at high speed, thereby beating off the extraneous substances 4 attached to the object 3. The extraneous substances 4 that have been beaten off enter the cylindrical mesh 13, are carried inside the cylindrical mesh 13 by the air current flowing toward the outlet port 12*e*, and are ejected from the cleaning tank 12.

(6) Due to the contact or collision of the cleaning media 1 with the object 3 to be cleaned, some of the extraneous substances 4 on the object 3 are attached to the cleaning media 1. These cleaning media 1 are carried toward the cylindrical mesh 13 by the air current flowing toward the outlet port 12*e*.

Step of removing the dust attached to the cleaning media (7) The cleaning media 1 that have been carried toward the cylindrical mesh 13 come into contact or collide with the mesh 13, so that the extraneous substances 4 attached to the cleaning media 1 are separated from the cleaning media 1 and are ejected from the cleaning tank 12. A discharging unit (e.g. an ionizer for generating ionized air) may be provided in the vicinity of the mesh 13. If the cleaning media 1 are discharged by the discharging unit, an electrostatic attraction force between the cleaning media 1 and the extraneous substances 4 is weakened, resulting in an easier separation of the extraneous substances 4.

(8) The cleaning media 1 that have been attached to the mesh 13 due to the suction force of the outlet port 12*e* are made to fly again inside the cleaning tank 12 due to the rotation of the nozzles 14.

The steps described above are repeated, so that the cleaning media 1 circulate inside the cleaning tank 12, thereby efficiently removing the extraneous substances 4 from the object 3. Even if the dust is relatively highly adhesive and is thus hard to be removed by relying only on an air blower, the contact or collision of the cleaning media 1 flying at high speed makes it possible to remove the dust from the object 3. Further, the cylindrical mesh 13 effectively removes the extraneous substances 4 attached to the cleaning media 1 so as to maintain a high degree of cleanliness of the cleaning media 1. This prevents the extraneous substances 4 attached to the cleaning media 1 from adhering to the object 3 again, thereby achieving high quality cleaning.

The step (1) and the step (2) may be performed either alternately or simultaneously. In the case where the step (1) and the step (2) are performed simultaneously, because the compressed air is not used at the same time for propelling and scattering the cleaning media 1 and for accelerating the cleaning media 1, a sufficient effect of propelling and scattering the cleaning media 1 and a sufficient effect of accelerating the cleaning media 1 can be obtained even if the capacity of supplying compressed air is limited. If the capacity of supplying compressed air is high enough, the step of propelling and scattering the cleaning media 1 and the step of accelerating the cleaning media 1 may be performed simultaneously. Thus a large amount of the cleaning media 1 can be easily supplied, thereby making it possible to uniformly clean the object 3 in a shorter time.

One problem which might occur during cleaning using the flying cleaning media 1 is that the cleaning medium 1 may be charged due to friction with the walls 12*c* of the cleaning tank 12, the object 3 to be cleaned, or other cleaning media 1. Especially, when the cleaning medium 1 is flying at higher speed for reducing cleaning time, more friction is produced, so that the amount of charge is increased in a short time. As a result, the cleaning media 1 are attached to the walls 12*c* of the cleaning tank 12 or the object 3 to be cleaned due to the electrostatic effect. Especially in the case of the cleaning media 1 that provide flexibility, the shapes of the cleaning media 1 can follow the shape of an object in contact therewith, and the cleaning media 1 can come into tight contact with the walls 12*c* of the cleaning tank 12 or the surface of the object 3 to be cleaned. Once the cleaning media 1 are in tight contact with the walls 12*c* of the cleaning tank 12 or the surface of the object 3, the space where the air current can enter is reduced between the cleaning media 1 and the walls 12*c* of the cleaning tank 12 or the surface of the object 3. This makes it difficult to discharge the cleaning media 1 using a corona discharging unit, because ions cannot enter the space between the cleaning media 1 and the walls 12*c* of the cleaning tank 12 or the surface of the object 3. As a result, the cleaning media 1 remain attached to the walls 12*c* of the cleaning tank 12 or the surface of the object 3. The amount of the cleaning media 1 available for cleaning in the cleaning process is therefore reduced, which results in lower cleaning efficiency and longer cleaning time. Moreover, in the process of removing the cleaning media 1 from the object 3 after the cleaning process, more time is required to remove the cleaning media 1. With use of one of the cleaning media 1 shown in FIGS. 1, 7A-11B, 13, 18A-18C, and 19, even if the cleaning medium 1 is attached to the wall 12*c* of the cleaning tank 12 or the like, the air current can flow into the cleaning medium 1. When the air current flows into the cleaning medium 1 and the force of the air current separating the cleaning medium 1 from the wall 12*c* of the cleaning tank 12 is greater than the electrostatic attraction force, the cleaning medium 1 is separated from the wall 12*c* of the cleaning tank 12 and thus can fly again. Thus, it is possible to prevent a reduction in the amount of the cleaning media 1 that contributes to cleaning, thereby maintaining a constant cleaning efficiency. A corona discharging unit may be provided on the wall 12*c* of the cleaning tank 12 that provides ions on the surface of the cleaning media 1 in contact with the wall 12*c* of the cleaning tank 12 so as to discharge the cleaning media 1, thereby enhancing the effect of removing the cleaning media 1. The use of the flexible cleaning medium 1 can not only achieve high cleaning quality and high cleaning efficiency, but also can provide an advantageous effect of preventing damage to the object 3.

The work holding unit 19 is horizontally rotated, and the work holders 19*a* holding the object 3 is swung. Further, the nozzles 16 facing the object 3 are oscillated or reciprocally moved for varying their positions and orientations (blowing directions). This makes it possible to cause the cleaning media 1 to come into contact with or collide with the entire surface of the object 3 from various directions, thereby uniformly cleaning the object 3 in a shorter time even if the object 3 has a complex shape. Optionally, the work holding unit 19 holding the object 3 may be slowly moved up and down.

Although the nozzles 16 described above are configured to be rotated or moved, a large number of nozzles 16 with different blowing directions and positions may alternatively be provided. A selective use of such nozzles 16' can provide the same effect as in the case of rotating and moving the nozzles 16.

Figure 26:
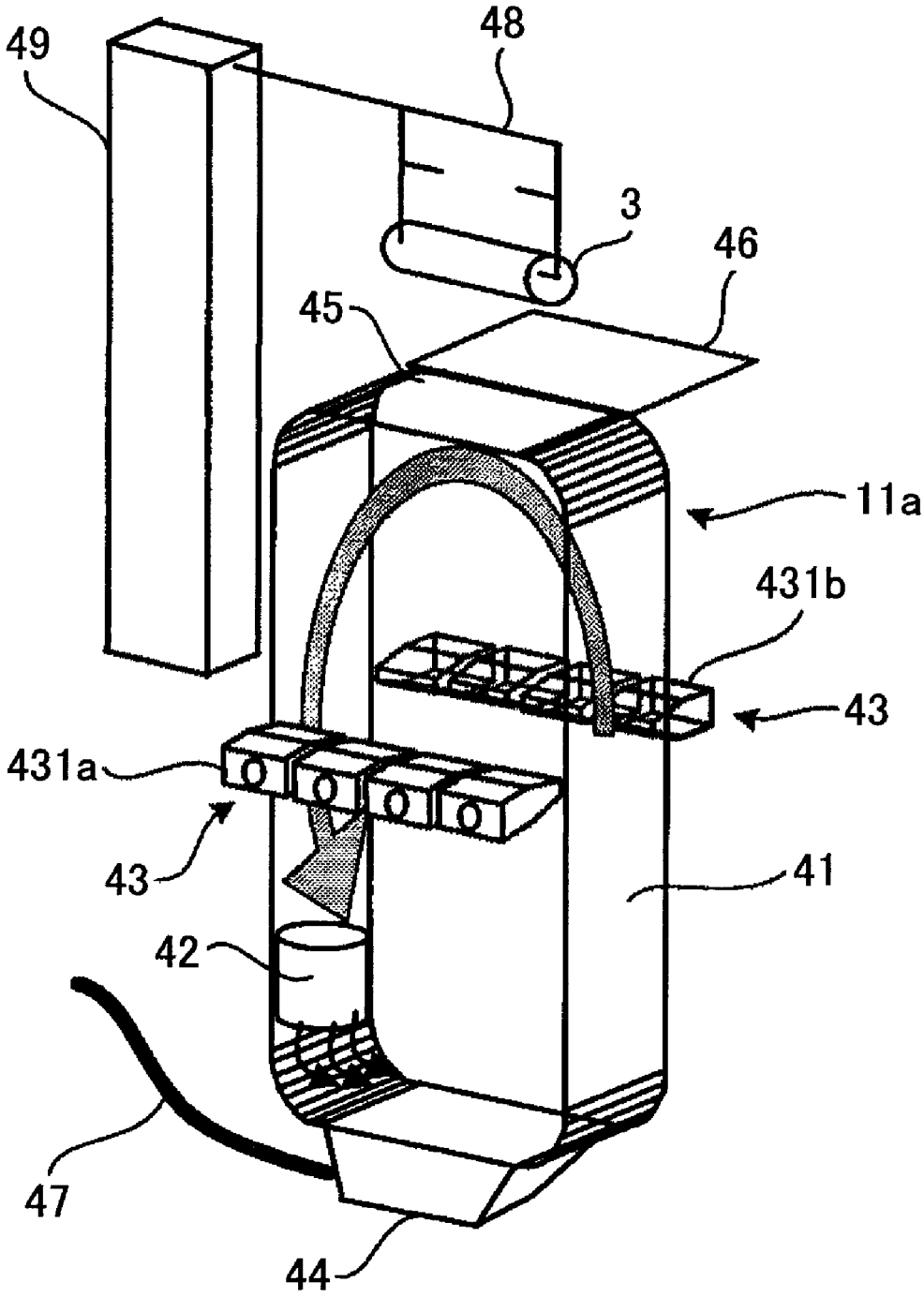
FIG. 26 is a configuration diagram of a second dry cleaning apparatus.

The following describes a second dry cleaning apparatus 11*a* using the flexible cleaning medium 1. Referring to FIG. 26, the second dry cleaning apparatus 11*a* includes a cleaning tank 41, a circulating air current generating unit 42, a cleaning medium accelerating unit 43, and a cleaning medium regenerating unit 44.

Figure 27A:
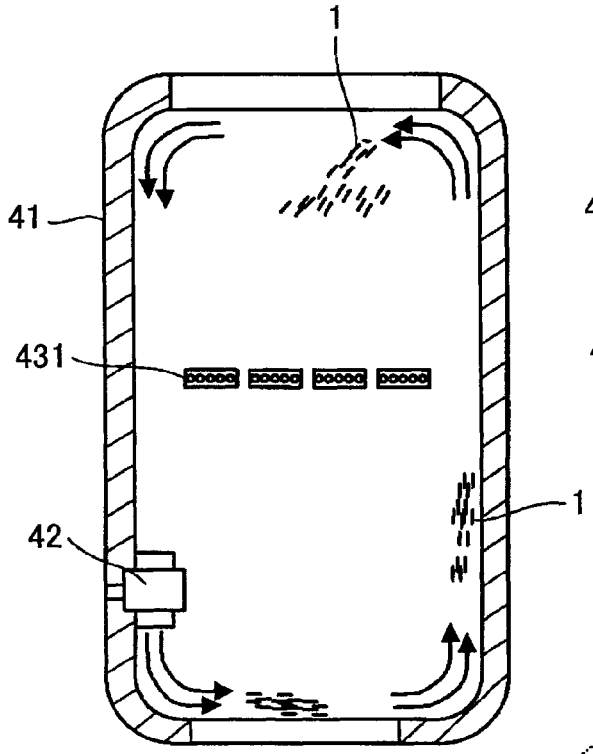
FIGS. 27A and 27B are cross-sectional views each showing the shape of a cleaning tank of the second dry cleaning apparatus.
Figure 27B:
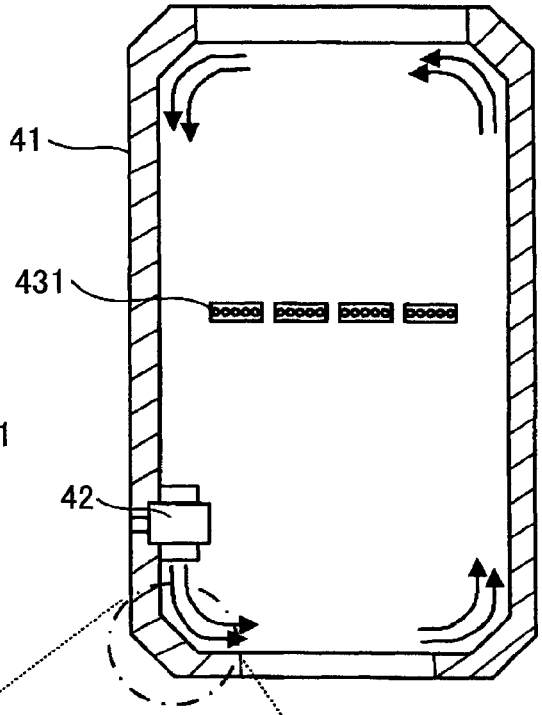
Figure 27B:
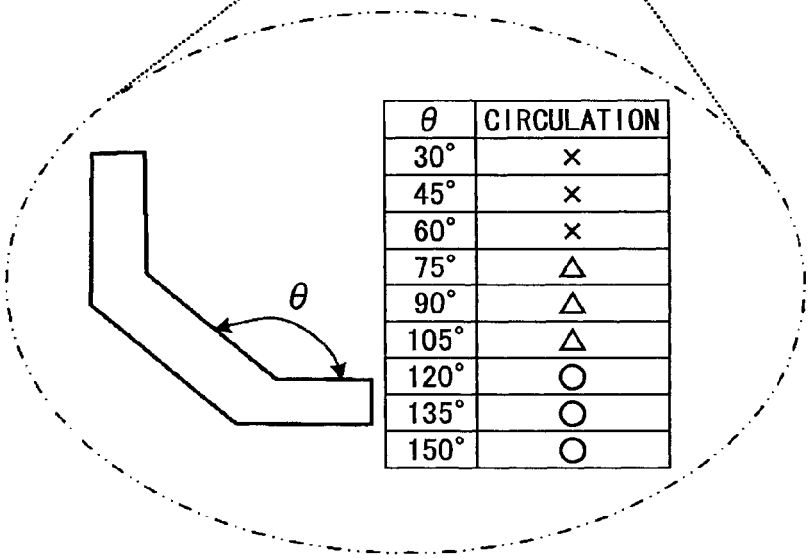

The cleaning tank 41 is a hollow structure of substantially rectangular shape. The cleaning tank 41 includes an object inlet 45 in the top surface through which the object 3 to be cleaned is placed and has an opening in the bottom. The cleaning tank 41 is provided with a lid 46 that opens and closes the object inlet 45. The cleaning medium regenerating unit 44 is disposed at the bottom opening of the cleaning tank 41. A circulating air current generating unit 42 is provided on the inner surface of one of the side walls of the cleaning tank 41 as shown in FIG. 27A. The inner surfaces of the side walls, the bottom surface, and the top surface form a circulation path of the circulating air current. The corners at the joints between these inner surfaces forming the circulation path may form curves as shown in FIG. 27A or may form predetermined angles θ as shown FIG. 27B, thereby causing the circulating air current to circulate efficiently. When the predetermined angle θ is in a range of 120 degrees through 150 degrees, the circulating air current can circulate with reduced resistance.

Although general purpose air blowing nozzles can be used as the nozzles 16, injection nozzles utilizing the Coanda effect such as one shown in FIG. 23 are preferably used. Thus it is possible to reduce the consumption of the compressed air compared with the case of using general purpose air blowing nozzles and to circulate the cleaning media with reduced energy. Further, it is possible to maintain a negative pressure inside the cleaning tank 41 to prevent dust from leaking outside of the cleaning tank 41. In place of compressed air, nitrogen gas, carbon-dioxide gas, inactive gas such as argon gas, or any other proper gas may be used. The circulating air current generating unit 42 is disposed with its suction port facing upward and its ejection port facing downward on one of the side walls of the cleaning tank 41, which side walls form the circulation path of the circulating air current, in the vicinity of the bottom surface.

Referring to FIG. 26, the cleaning medium accelerating unit 43 includes an array of plural accelerating nozzles 431*a* on the surface orthogonal to the inner surfaces forming the circulation path of the circulating air current; and an array of accelerating nozzles 431*b* on the back surface opposing the surface on which the accelerating nozzles 431*a* are disposed. Compressed air supplied from a compressed air source such as a compressor or a pressure tank is delivered via each of the accelerating nozzles 431*a* and 431*b*, thereby causing the cleaning media 1 to collide with the object 3. The accelerating nozzles 431*a* and 431*b* may preferably be injection nozzles as in the case of the circulating air current generating unit 42.

Figure 28A:
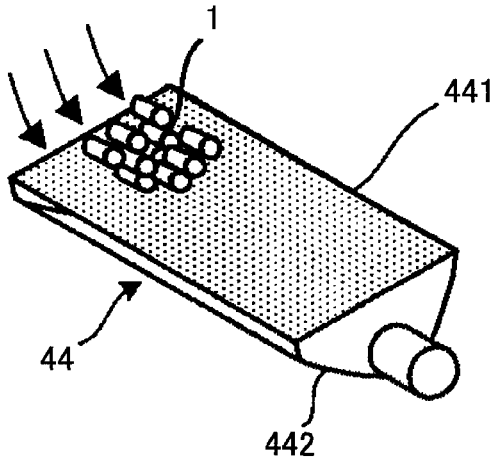
FIGS. 28A and 28B are schematic diagrams each showing the configuration of a cleaning medium regenerating unit.
Figure 28B:
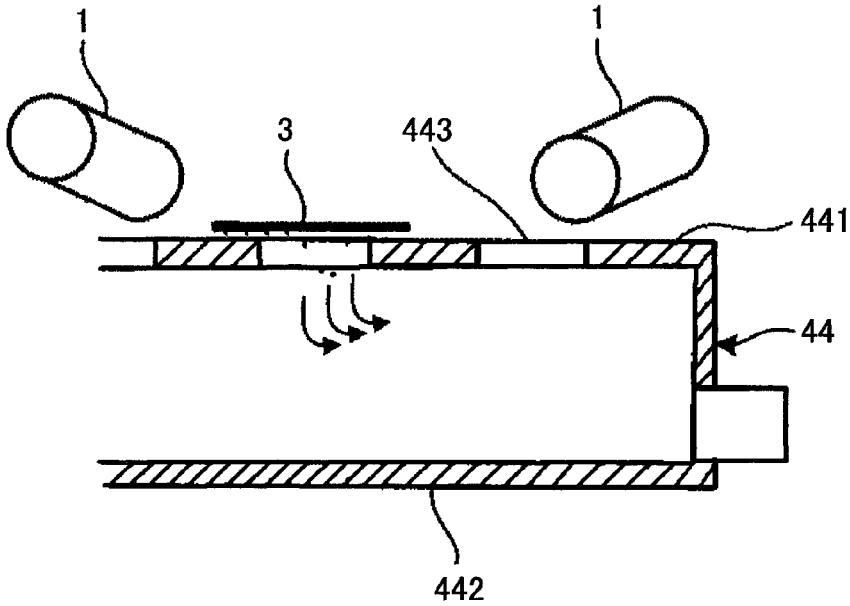

Referring to the perspective view of FIG. 28A and the schematic partial cross-sectional view of FIG. 28B, the cleaning medium regenerating unit 44 is configured such that a separating member 441 disposed at the bottom of the cleaning tank 41 and a hood 442 form a closed space. The closed space is connected via a suction duct 47 to a dust collecting unit (not shown) including a negative pressure generating unit so as to maintain a negative pressure inside the hood 442. The separating member 441 is made of a porous member, such as a metal net, a plastic net, a mesh, a punching metal plate, and a slit plate, which has a large number of small holes that allow the air and particles to pass through but not the cleaning media 1. Thus, the extraneous substances separated from the object 3, chipped or worn cleaning media 1 due to collision, and cleaning media 1 with lowered elasticity due to long use are ejected.

Figure 29:
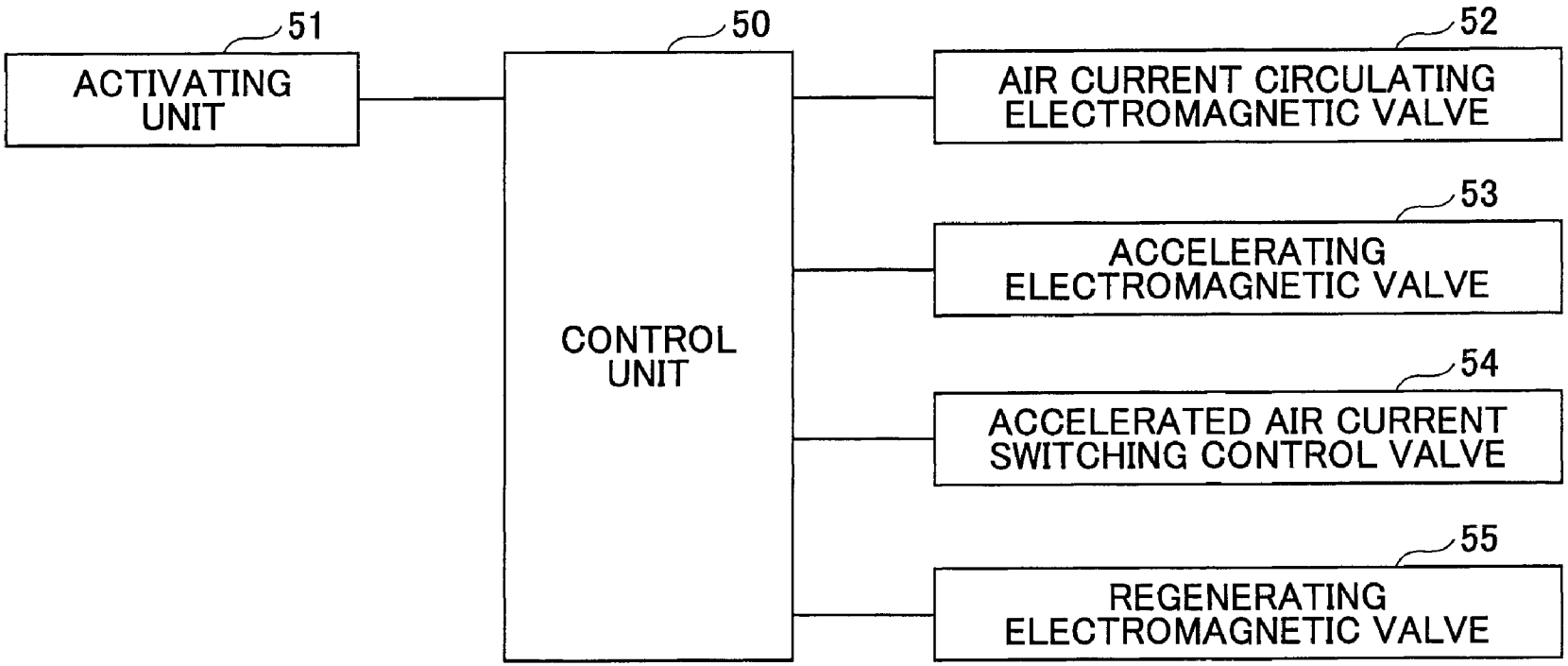
FIG. 29 is a block diagram showing the configuration of a drive control unit of the second dry cleaning apparatus.
Figure 30A:
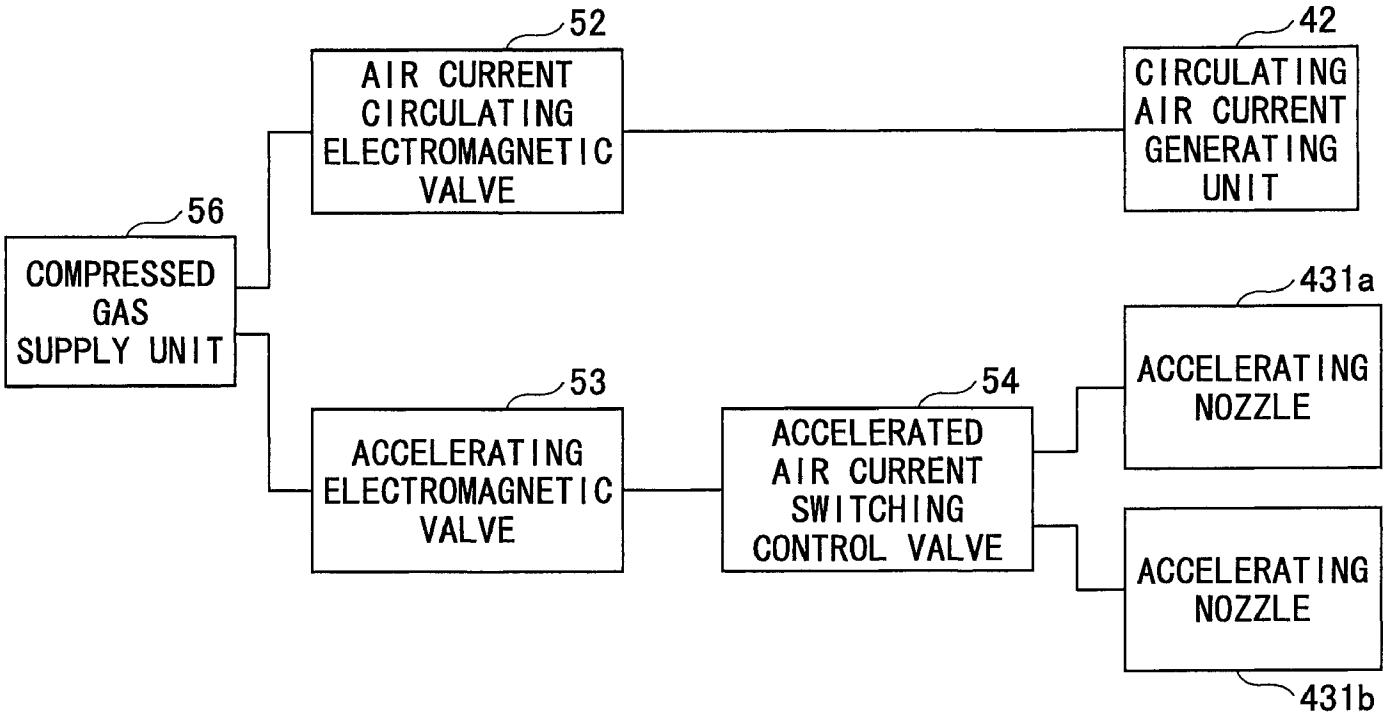
FIGS. 30A and 30B are block diagrams showing the configuration of a drive unit of the second dry cleaning apparatus.
Figure 30B:
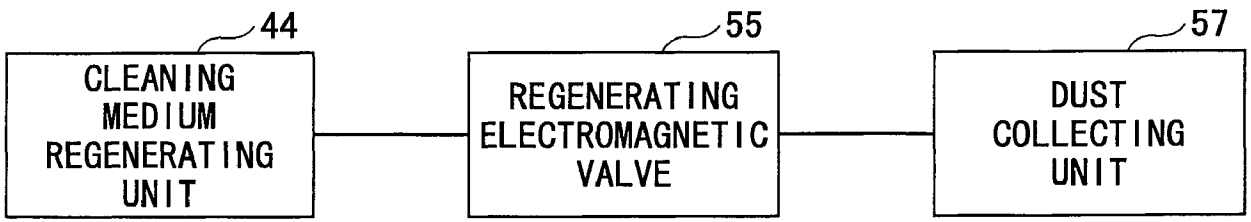

Referring to the block diagrams of FIG. 29, 30A and 30B, a control unit 50 of the dry cleaning apparatus 11 is connected to each of an air current circulating electromagnet valve 52 that opens and closes an air pipe of the compressed air to be supplied from a compressed gas supply unit 56 to the circulating air current generating unit 42; an accelerating electromagnet valve 53 that opens and closes an air pipe of the compressed air to be supplied to the cleaning medium accelerating unit 43; an accelerated air current switching control valve 54 that switches the destination of the compressed air between the accelerating nozzles 431*a* and 431*b* provided on the opposing surfaces of the cleaning medium accelerating unit 43; and a regenerating electromagnet valve 55 that opens and closes the suction duct 47 connecting the cleaning medium regenerating unit 44 and a dust collecting unit 57. The control unit 50 controls the operations of each electromagnet valve according to drive signals provided from an activating unit 51.

Figure 31:
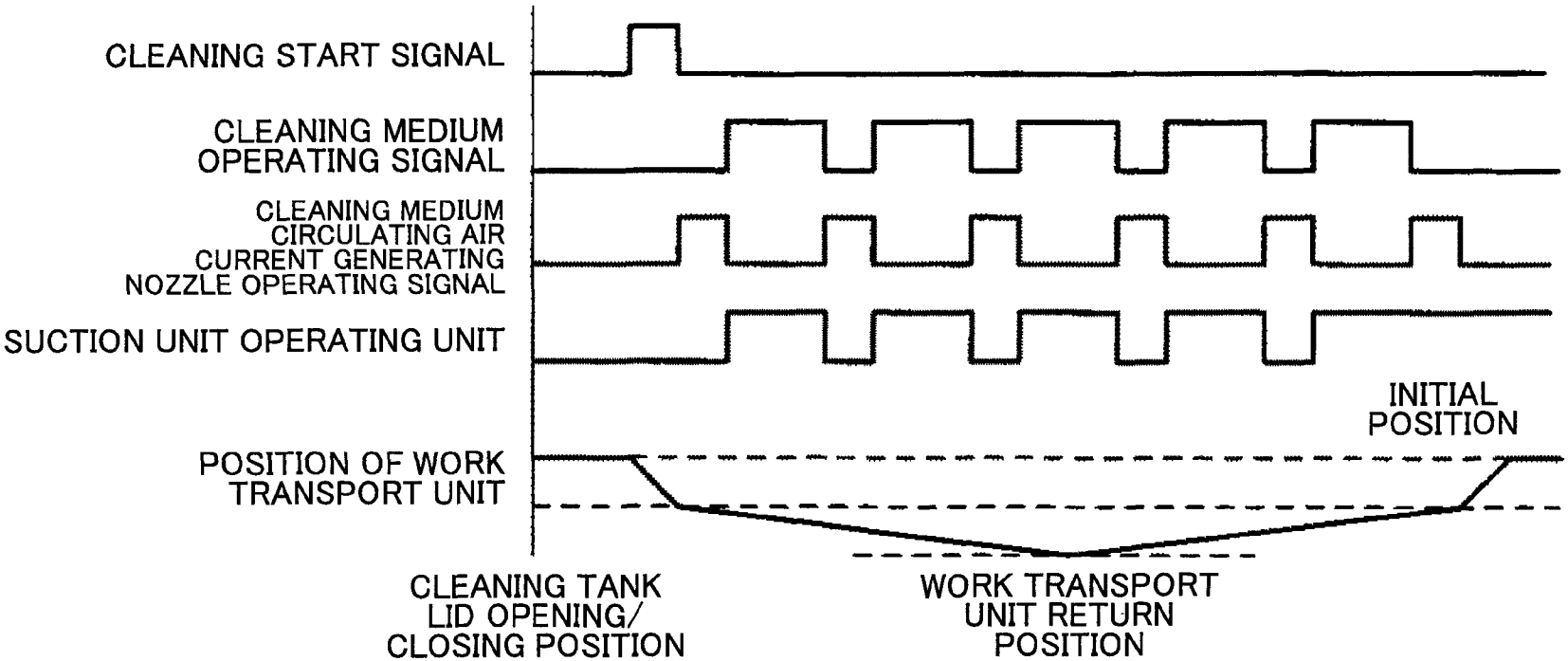
FIG. 31 is a timing chart illustrating a cleaning operation of the second dry cleaning apparatus.

In the dry cleaning apparatus 11*a*, the object 3 held by a work holding unit 48 is placed into the cleaning tank 41 by a work transport unit 49. Then the extraneous substances 4 such as toner attached to the object 3 are removed by circulating the flexible cleaning media 1 in the cleaning tank 41. These operations are described below with reference to the time chart of FIG. 31.

Figure 32A:
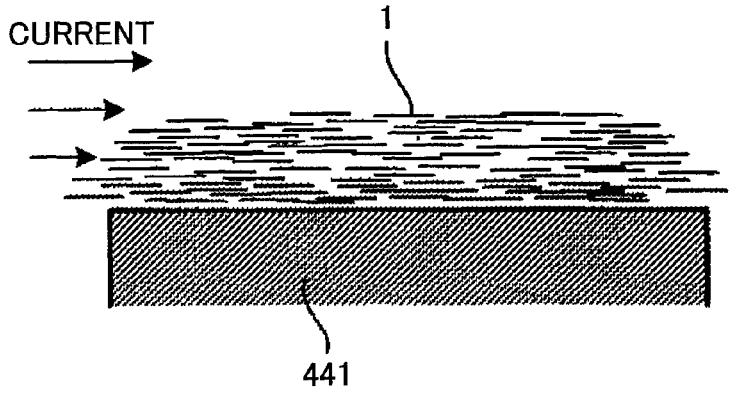
FIGS. 32A through 32C are diagrams showing examples of carrying cleaning media accumulated on a cleaning medium regenerating unit by a circulating air current.
Figure 32B:
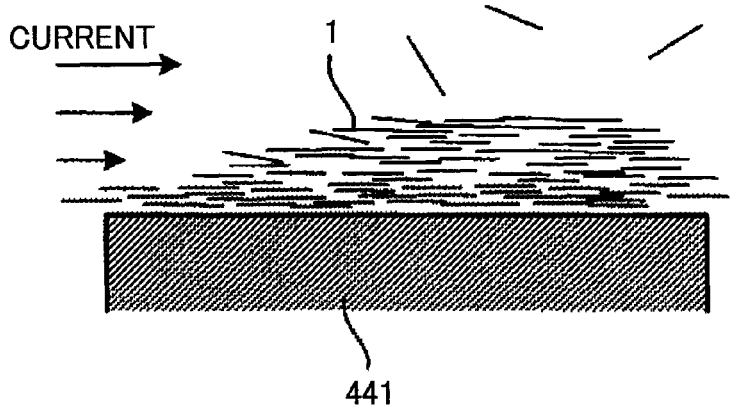
Figure 32C:
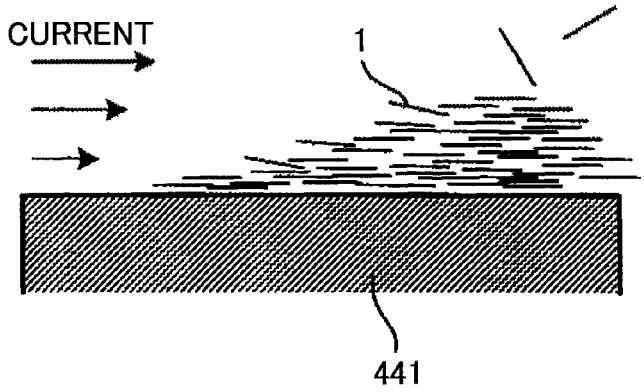

The flexible cleaning media 1 are placed into the cleaning tank 41 and accumulated on the separating member 441 of the cleaning medium regenerating unit 44. Then the object 3 being held by the work holding unit 48 is placed into the cleaning tank 41 through the object inlet 45 and positioned in the initial position by the work transport unit 49. The lid 46 of the object inlet 45 is closed, so that the cleaning tank 41 is sealed. Then the activating unit 51 is operated to input a cleaning start signal to the control unit 50. The control unit 50 first opens the air current circulating electromagnet valve 52 to supply, e.g., compressed air from the compressed gas supply unit 56 such as a compressor to the circulating air current generating unit 42, so that the circulating air current generating unit 42 generates a circulating air current that flows along the circulation path formed by the inner surfaces of the cleaning tank 41. The circulating air current flows along the separating member 441 of the cleaning medium regenerating unit 44; hits the flexible tubular cleaning media 1 accumulated on the separating member 441 from the lateral direction as shown in FIG. 32A; and gradually breaks down the pile of the cleaning media 1 from the top to blow up and carry the cleaning media 1 in the longitudinal direction of the cleaning tank 41 as shown in FIGS. 32B and 32C, thereby making the cleaning media 1 fly. Since the circulating air current that causes the cleaning media 1 to fly is delivered directly into the cleaning tank 41 from the circulating air current generating unit 42, it is possible to exert a large impact force on the accumulated cleaning media 1 and thus to fly the accumulated cleaning media 1 with the circulating air current.

One problem which might occur during cleaning is that the cleaning medium 1 may be charged due to friction with the wall of the cleaning tank 41, the object 3 to be cleaned, or other cleaning media 1. Especially, when the cleaning medium 1 is flying at higher speed for reducing cleaning time, more friction is produced, so that the amount of charge is increased in a short time. As a result, the cleaning media 1 are attached to the wall of the cleaning tank 41 or the object 3 to be cleaned due to the electrostatic effect. Especially in the case of the cleaning media 1 that provide flexibility, the shapes of the cleaning media 1 can follow the shape of an object in contact therewith, and the cleaning media 1 can come into tight contact with the wall of the cleaning tank 41 or the surface of the object 3 to be cleaned. Once the cleaning media 1 are in tight contact with the wall of the cleaning tank 41 or the object 3, the space where the air current can enter is reduced between the cleaning media 1 and the walls 12*c* of the cleaning tank 41 or the surface of the object 3. This makes it difficult to discharge the cleaning media 1 using a corona discharging unit, because ions cannot enter the space between the cleaning media 1 and the wall of the cleaning tank 41 or the surface of the object 3. As a result, the cleaning media 1 remain attached to the wall of the cleaning tank 41 or the object 3. The amount of the cleaning media 1 available for cleaning in the cleaning process is therefore reduced, which results in lower cleaning efficiency and longer cleaning time. Moreover, in the process of removing the cleaning media 1 from the object 3 after the cleaning process, more time is required to remove the cleaning media 1. With use of one of the cleaning media 1 shown in FIGS. 1, 7A-11B, 13, 18A-18C, and 19, even if the cleaning medium 1 is attached to the wall of the cleaning tank 41 or the object 3, the air current can flow into the cleaning medium 1. When the air current flows into the cleaning medium 1 and the force of the air current separating the cleaning medium 1 from the wall of the cleaning tank 41 or the object 3 is greater than the electrostatic attraction force, the cleaning medium 1 is separated from the wall 12 of the cleaning tank 41 or the object 3 and thus can fly again. Thus, it is possible to prevent a reduction in the amount of the cleaning media 1 that contributes to cleaning, thereby maintaining a constant cleaning efficiency. A corona discharging unit may be provided on the wall of the cleaning tank 41 that provides ions on the surface of the cleaning media 1 in contact with the wall of the cleaning tank 41 so as to discharge the cleaning media 1, thereby enhancing the effect of removing the cleaning media 1. Even if the cleaning medium 1 is stuck in a gap at a joint or a seam in the object 3 or at a joint or a seam in the cleaning tank, the air current hits the inner surface of the cleaning medium 1 exposed outside the gap to make the cleaning medium fly again, thereby preventing accumulation of the cleaning media 1. Thus, in the cleaning process it is possible to prevent a reduction in the amount of the cleaning media 1 that contribute to cleaning and to allow new contact of the cleaning media 1 with the object 3 due to prevention of accumulation of the cleaning media 1 in the gaps in the object 3, thereby maintaining a constant cleaning efficiency. Further, in the process of removing the cleaning media 1 from the cleaned object 3, by generating an air current directed to the inner surface of the cleaning medium 1 and making the air current hit the cleaning medium 1, the cleaning medium 1 flies again and thus can easily be removed.

Figure 33A:
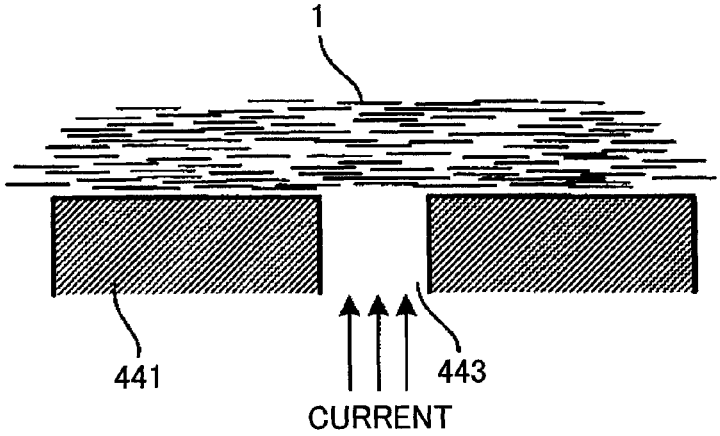
FIGS. 33A through 33C are diagrams showing comparative examples of carrying accumulated cleaning media by a circulating air current.
Figure 33B:
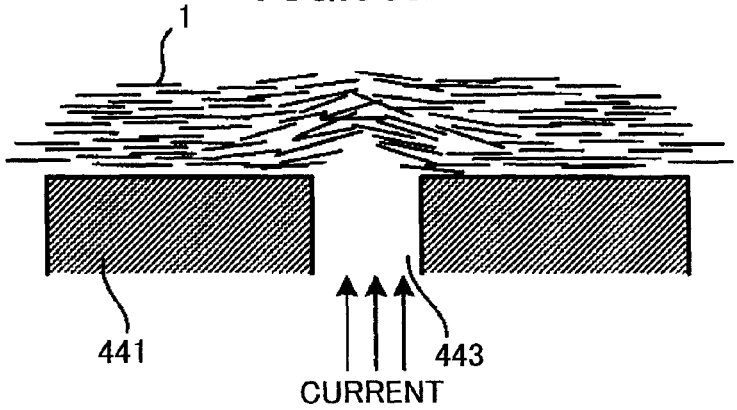
Figure 33C:
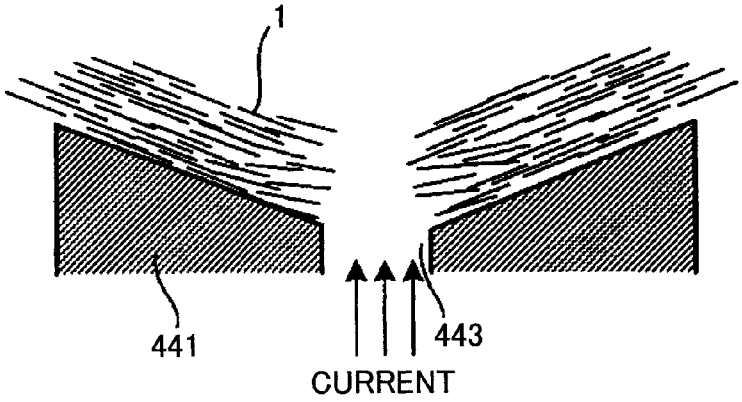

In the case of making the accumulated flexible cleaning media 1 fly by carrying the cleaning media 1 with an air current, if, for example as shown in FIG. 33A, an air current perpendicular to the direction of the accumulation of the cleaning media 1 is provided from a slit 443, energy of a compressed air high enough to blow up all the accumulated cleaning media 1 is required. Therefore, the greater the amount of the accumulated cleaning media 1, the harder to blow up the cleaning media 1 as shown in FIG. 33B. It may be possible to blow up the cleaning media 1 covering the slit 443 from which the air current is delivered. However, because the accumulated flexible cleaning media 1 have low mobility, even if the surface around the slit 443 is sloped toward the slit 443 as shown in FIG. 33C, the cleaning media 1 around the slit 443 remain without being blown off. Thus it is difficult to propel all the accumulated cleaning media 1. On the other hand, in the case where the circulating air current generating unit 42 generates the circulating air current which flows along the circulation path formed by the inner surfaces of the cleaning tank 41 and hits the flexible cleaning media 1 accumulated on the separating member 441 from the lateral direction, the accumulated cleaning media 1 can be made to fly with reduced energy, which allows a reduction of the supply amount of the compressed air to the circulating air current generating unit 42. If the cleaning media 1 are carried by an air current within a duct or hose, the cleaning media 1 can be stuck in the duct or hose. In the above embodiment, because the walls of the cleaning tank 41 form the circulation path of the circulating air current, it is possible to make the cleaning media 1 fly inside the cleaning tank 41 without the risk of the cleaning media 1 being stuck in the circulation path.

The circulating air current generating unit 42 for generating the circulating air current is disposed with its suction port facing upward and its ejection port facing downward on one of the side walls of the cleaning tank 41, which side walls form the circulation path of the circulating air current, in the vicinity of the bottom surface. Therefore, it is possible to apply a great force of the air current along the bottom surface to the cleaning media 1 accumulated on the separating member 441 at the bottom of the cleaning tank 41 even if the cleaning media 1 are spaced apart from the ejection port, and thus to carry a large amount of the cleaning media 1 along the wall of the cleaning tank 41. Further, the cleaning media 1 coming into the suction port are dispersed and have a low space density, and therefore do not clog the suction port. Thus the circulating air current generating unit 42 can stably generate the circulating air current. That is, if the circulating air current generating unit 42 is disposed with its suction port facing downward in the vicinity of the bottom surface of the cleaning tank 41, it is difficult to carry a large amount of the cleaning media 1 accumulated at the bottom of the cleaning tank 41. Further, if a large amount of the accumulated cleaning media 1 is suctioned from the suction port, the space density of the cleaning media 1 at the suction port is increased, resulting in clogging the suction port. Disposing the circulating air current generating unit 42 with its suction port facing upward can prevent these problems.

Figures 34A, 34B, 34C:
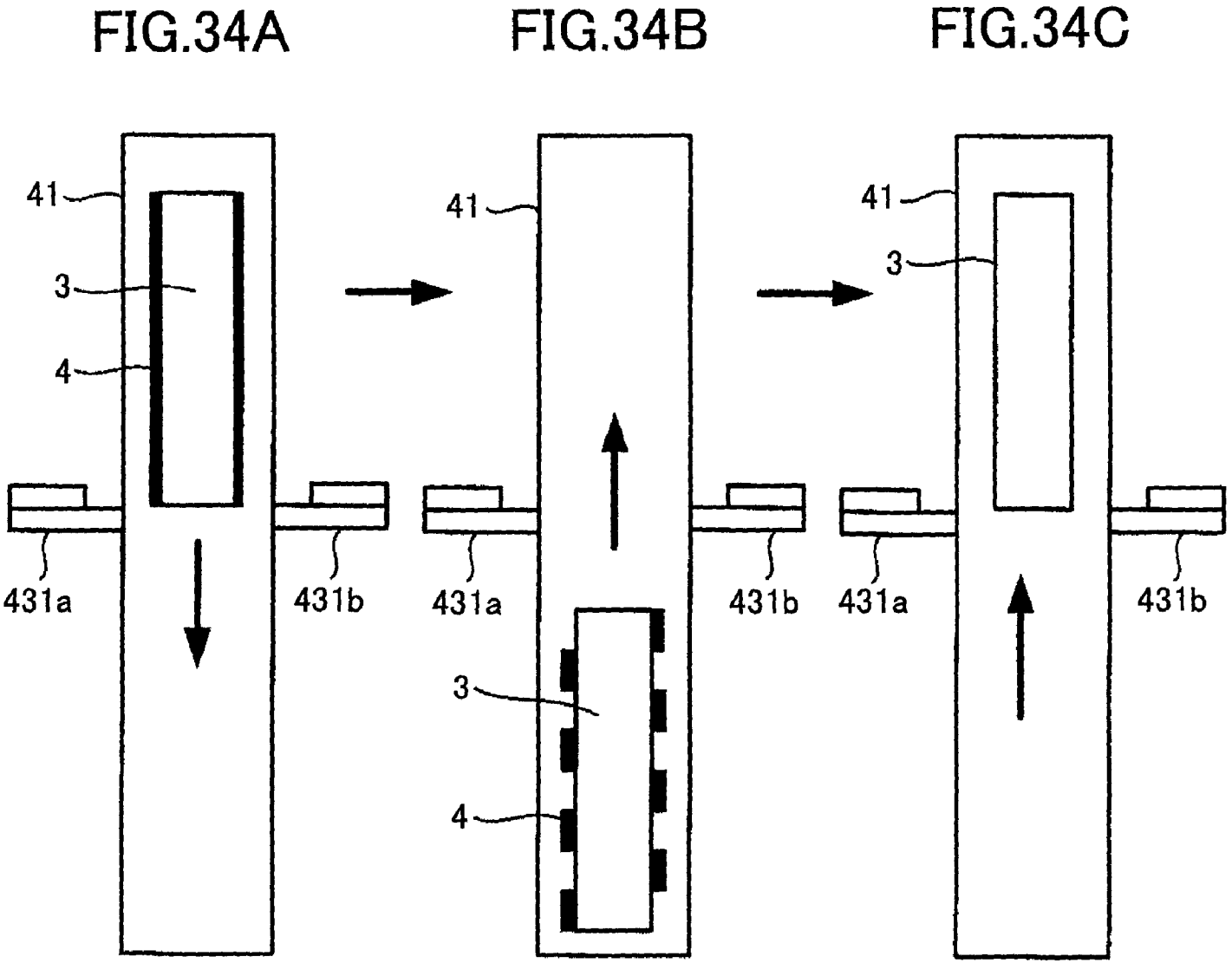
FIGS. 34A through 34C are diagrams illustrating an operation of cleaning an object to be cleaned.

When a predetermined time has elapsed, the control unit 50 closes the air current circulating electromagnet valve 52 to stop generation of the circulating air current by the circulating air current generating unit 42. Then, as shown in FIG. 34A, while the object 3 is gradually moved down from the initial position by the work transport unit 49, the control unit 50 opens the accelerating electromagnet valve 53 to supply compressed air from the compressed gas supply unit 56 via the accelerated current switching control valve 54 to the cleaning medium accelerating unit 43. Thus the accelerating nozzles 431*a* of the cleaning medium accelerating unit 43 deliver compressed air. Further, control unit 50 opens the regenerating electromagnet valve 55 to allow communication between the cleaning medium regenerating unit 44 and the dust collecting unit 57 to create negative pressure inside the hood 442. When the generation of the circulating air current by the circulating air current generating unit 42 is stopped, the cleaning media 1 that have been flying due to the circulating air current start falling. The falling cleaning media 1 collide with the object 3 due to the compressed air from the accelerating nozzles 431*a* and remove the extraneous substances 4 such as toner attached to one side of the object 3.

The dust removed from the object 3 and the cleaning media 1, to which the dust is attached as a result of collision with the object 3, fall due to the gravity onto separating member 441 of the cleaning medium regenerating unit 44 that provides suction due to the negative pressure inside the hood 442. The dust that have fallen together with or without the cleaning media 1 on the separating member 441 is suctioned into the food 442 due to the negative pressure inside the hood 442 and collected by the dust collecting unit 57. Thus the cleaning media 1 to which the dust had been attached are efficiently regenerated.

After performing the injection of compressed air by the accelerating nozzles 431*a* for a predetermined time period, the control unit 50 closes the accelerating electromagnet valve 53 and the regenerating electromagnet valve 55 to stop operations of the cleaning medium accelerating unit 43 and the cleaning medium regenerating unit 44. When the regenerating electromagnet valve 55 is closed, the negative pressure inside the hood 442 is lost. Thus the force of suctioning the cleaning media 1 toward the hood 442 is lost, so that the cleaning media 1 are carried away from the separating member 441 by the circulating air current to come. It is thus possible to continuously separate the dust from the cleaning media 1 while preventing the cleaning media 1 from covering and sealing the mesh or the like of the separating member 441. There is therefore no need to replace the cleaning media 1. If the cleaning media 1 are broken and thus the amount of the cleaning media 1 is reduced, new cleaning media 1 may be added. In this way, it is possible to efficiently use the cleaning media 1 and facilitate maintenance work.

After that, control unit 50 opens the air current circulating electromagnet valve 52 again to cause the circulating air current generating unit 42 to generate a circulating air current, thereby causing the regenerated cleaning media 1 on the separating member 441 of the cleaning medium regenerating unit 44 to fly for a predetermined time period T1. Then the control unit 50 opens the accelerating electromagnet valve 53 and the regenerating electromagnet valve 55, and controls the accelerated air current switching control valve 54 to switch to the accelerating nozzle 431*b*. Thus, the operation of removing dust from the object 3 and the operation of regenerating the cleaning media 1 are performed for a predetermined time period. The predetermine time period for removing dust from the object 3 and regenerating the cleaning media 1 may be made longer than the time period for generating the circulating air current, thereby allowing cleaning a large area of the object 3. Since the compressed air is delivered alternately by the accelerating nozzles 431*a* and the accelerating nozzles 431*b*, it is possible to prevent the interference between the air currents delivered from the accelerating nozzles 431*a* and the accelerating nozzles 431*b* and therefore to surely cause collision of the cleaning media 1 with object 3, thereby enhancing the effect of cleaning by the cleaning media 1.

The operation of generating the circulating air current and the operations of removing dust from the object 3 and regenerating the cleaning media 1 are repeatedly and alternately performed, while the object 3 is gradually moved down from the initial position. When the object 3 reaches a return position shown in FIG. 34B, the object 3 stops moving down and then is gradually moved up. While the object 3 is gradually moved up, the control unit 50 repeatedly and alternately executes the operation of generating the circulating air current and the operations of removing dust from the object 3 and regenerating the cleaning media 1, thereby removing the extraneous substances 4 from the entire surface of the object 3. When the object 3 reaches the top end, i.e., the initial position shown in FIG. 34C, the control unit 50 stops the cleaning operation. When the cleaning operation is stopped, the lid 46 of the cleaning tank 41 is opened to take out the object 3 held by the work holding unit 48 with use of the work transport unit 49. Then another object 3 to be cleaned is placed, and the cleaning operation is started again.

Figure 35:
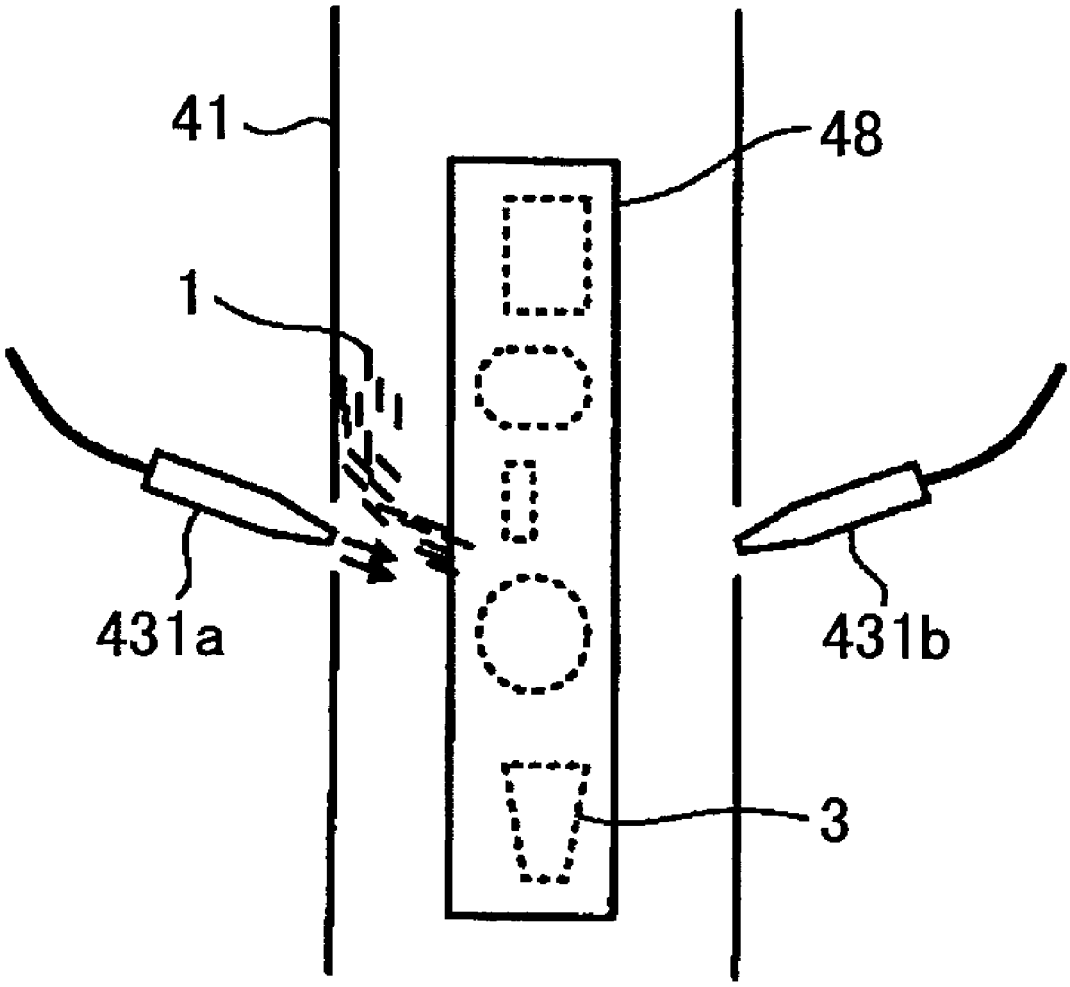
FIG. 35 is a diagram for explaining how the air injected from an accelerating nozzle of a cleaning media accelerating unit causes cleaning media to collide with an object to be cleaned.

In the above embodiment, the accelerating nozzles 431*a* and 431*b* alternately deliver compressed air to clean the entire surface of the object 3. However, if the injection angles of the accelerating nozzles 431*a* and 431*b* are properly adjusted as shown in FIG. 35, the accelerating nozzles 431*a* and 431*b* may deliver compressed air at the same time. Further, if the object 3 has dust on one side, either the accelerating nozzles 431*a* or the accelerating nozzles 431*b* may be used to deliver compressed air.

Figure 36A:
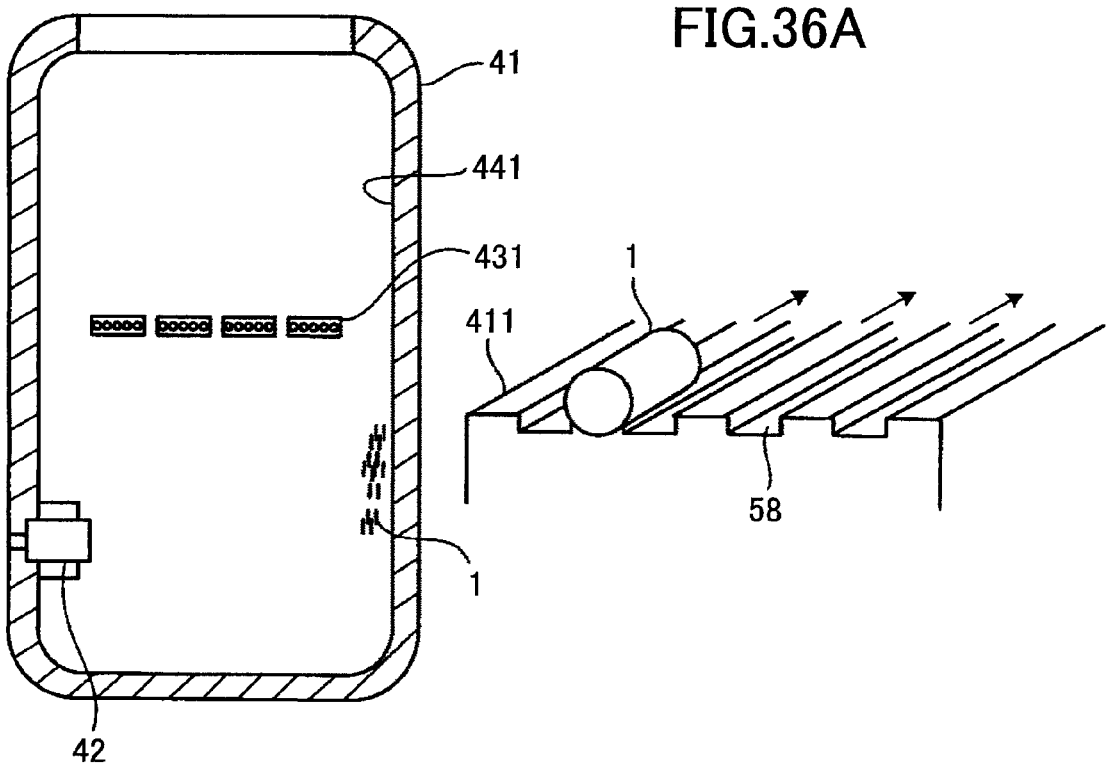
FIGS. 36A and 36B are diagrams each showing the configuration of the inner wall forming an air circulation path of circulating air current.

In the above embodiment, the flat inner surfaces of the cleaning tank 41 form the circulation path of the circulating air current generated by the circulating air are flat. In an alternative embodiment, as shown in FIG. 36A, the wall surface 411 of the cleaning tank 41 forming the circulation path of the circulating air current may be provided with plural angular or curved grooves 58 extending in the direction of the circulating air current. Each groove 58 has a lesser width than the cleaning medium 1 to prevent the cleaning medium 1 from entering the groove 58. The provision of the grooves 58 reduces the contact resistance between the wall surface 411 and the cleaning medium 1 due to the space created between the wall surface 411 and the cleaning medium 1. Moreover, the circulating air current flows inside the grooves 58, and thus can efficiently carry a large amount of the cleaning media 1. The grooves 58 straighten the circulating air current to prevent generation of air turbulence, thereby preventing attenuation of the power of the air current. Thus it is possible to efficiently carry and fly the cleaning media 1, resulting in enhancing the cleaning efficiency. The grooves 58 may have a depth to allow passage of the air current, which may be in a range of about 0.1 mm through 1 mm, for example. The grooves 58 of a depth in this range can be easily formed.

Figure 36B:
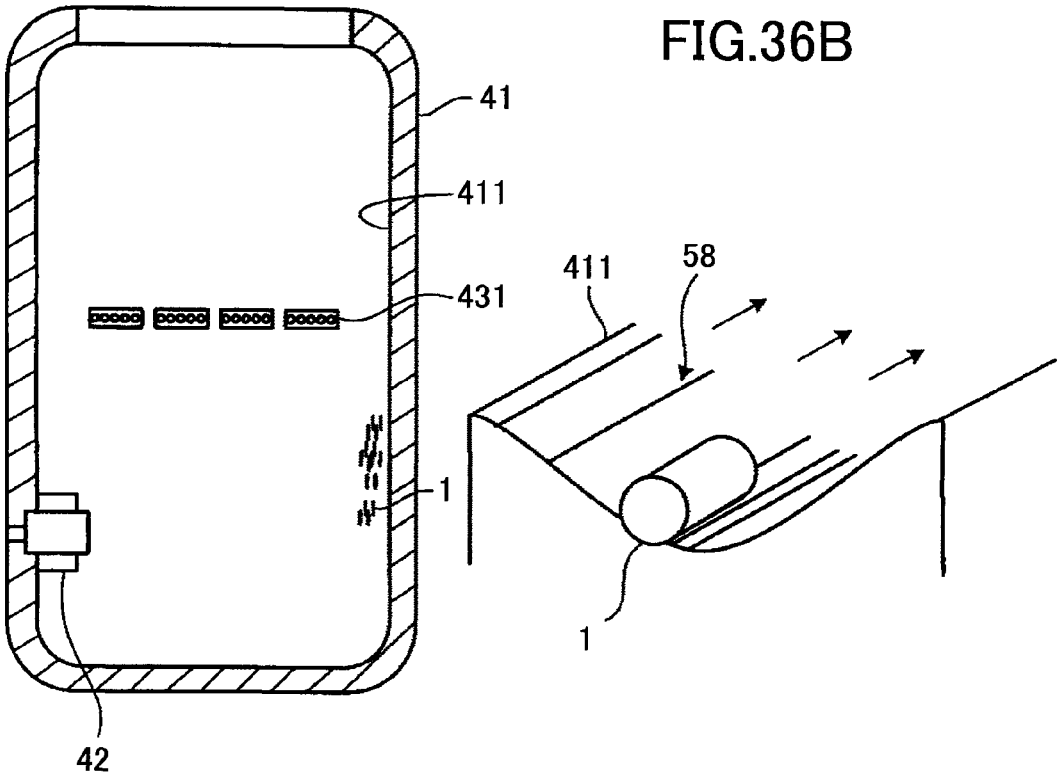

The wall surface 411 of the cleaning tank 41 forming the circulation path of the circulating air current may have a curved surface with a concave shape as shown in FIG. 36B. If the wall surface 411 of the cleaning tank 41 forming the circulation path of the circulating air current has a curved surface with a concave shape, diffusion of the circulating air current can be prevented. Thus it is possible to efficiently carry a large amount of cleaning media 1 and to make a large amount of cleaning media 1 fly in the cleaning tank 41, resulting in enhancing the cleaning efficiency.

Figure 37B:
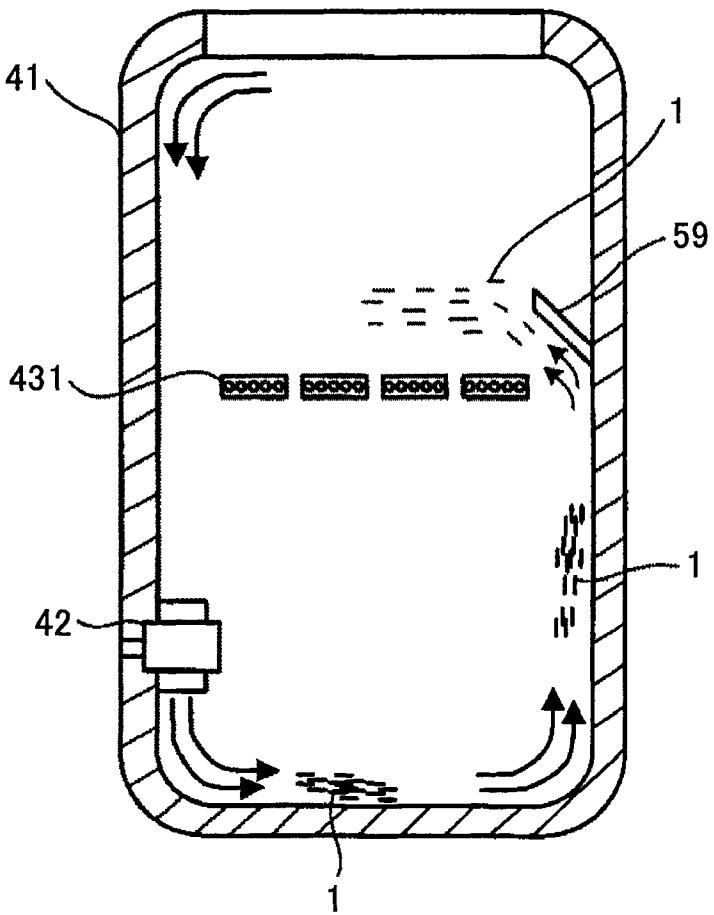
FIGS. 37A and 37B are schematic cross-sectional diagrams each showing a cleaning tank having an air flow guide in a circulation path of circulating air current.
Figure 37A:
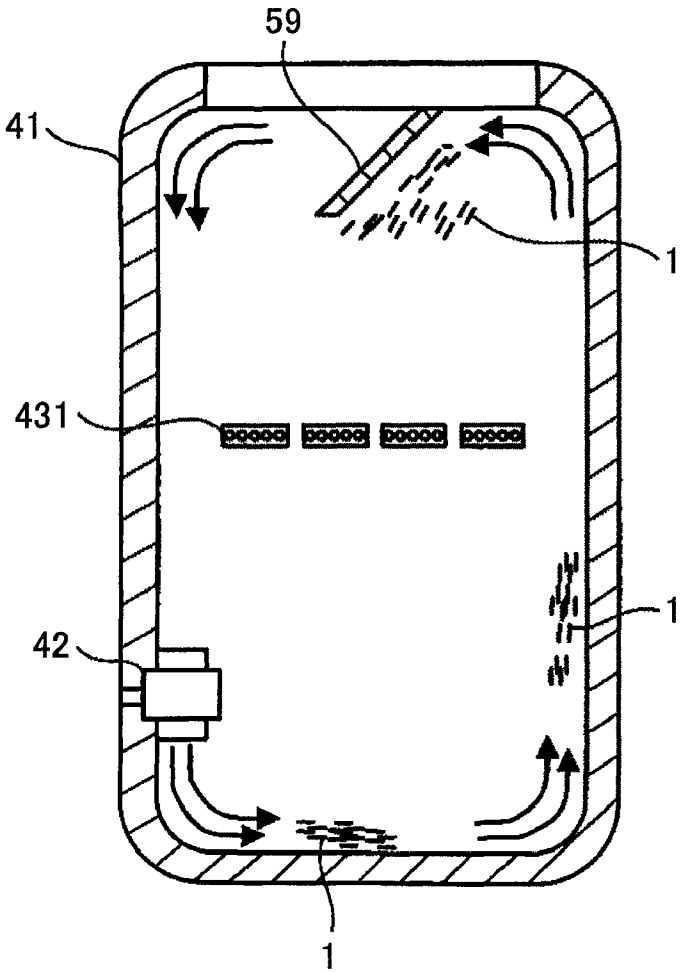

Further, as shown in FIGS. 37A and 37B, an air flow guide 59 for guiding the cleaning media 1 toward the cleaning medium accelerating unit 43 may preferably be provided on the top surface or at the upper side of the side surface of the cleaning tank 41 forming the circulation path of the circulating air current. The provision of the air flow guide 59 in the circulation path of the circulating air current makes it possible to fly a large amount of cleaning media 1 between the cleaning medium accelerating unit 43 and the object 3, resulting in enhancing the cleaning efficiency. Further, the cleaning media 1 whose flying direction is changed by the air flow guide 59 can directly collide with and clean the object 3. The angle at which the air current is made to flow may preferably be adjusted in accordance with the shape and the position of the object 3 to be cleaned.

Figure 38B:
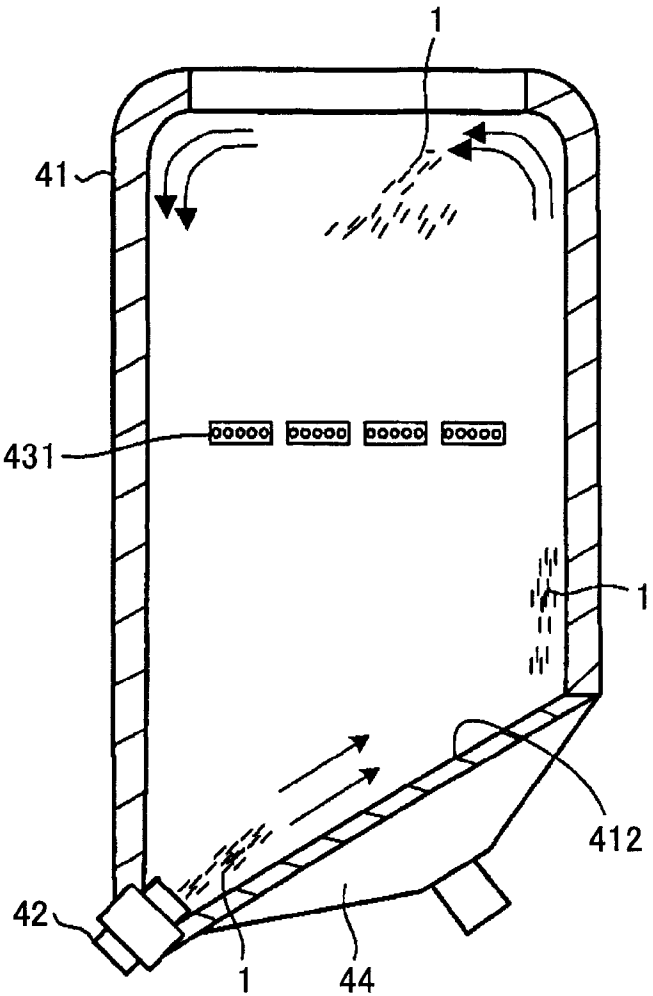
FIGS. 38A and 38B are schematic cross-sectional diagrams each showing a cleaning tank having a sloped bottom surface.
Figure 38A:
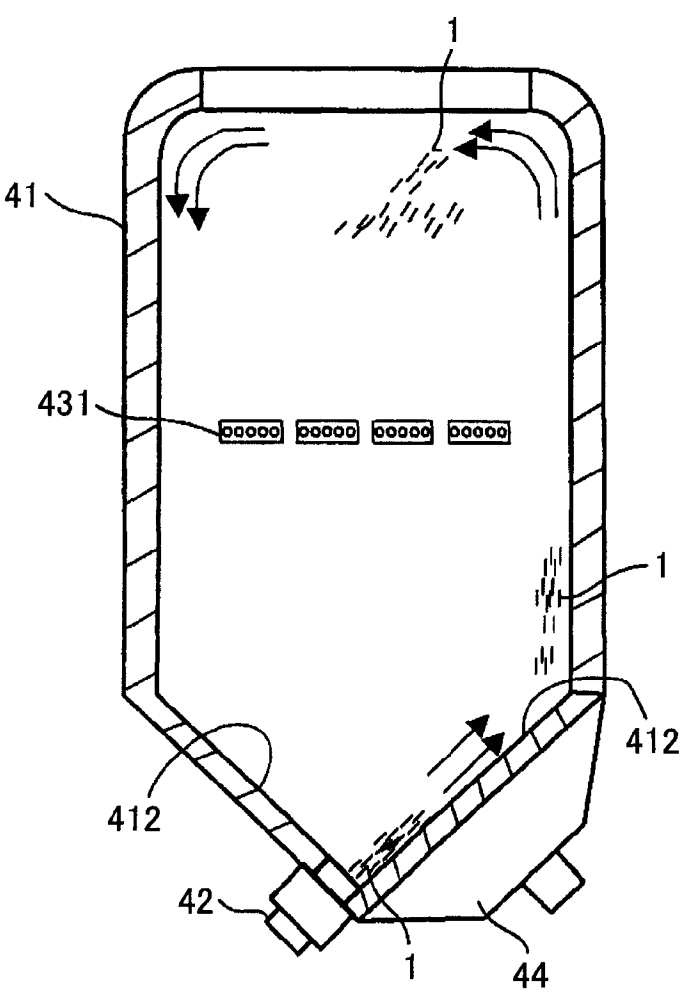

The cleaning tank 41 may not be a substantially rectangular shape and may include a slope 412 forming a bottom surface having an opening as shown in FIG. 38A or 38B. The cleaning medium regenerating unit 44 may be disposed on the slope 412, and the circulating air current generating unit 42 may be disposed at the lower end of the slope 412. Thus the circulating air current generating unit 42 delivers the circulating air current along the slope 412. With this configuration, when the cleaning media 1 that have collided with the object 3 and have removed the extraneous substances 4 fall on the separating member 441 of the cleaning medium regenerating unit 44, the cleaning media 1 can easily be gathered in the vicinity of the ejection port of the circulating air current generating unit 42. The circulating air current generated by the circulating air current generating unit 42 can carry the gathered cleaning media 1. It is therefore possible to carry a large amount of cleaning media 1 with a small supply of compressed air, thereby saving energy. Further, because the cleaning media 1 are gathered on the cleaning medium regenerating unit 44, more time is allowed for regeneration of the cleaning media 1, so that the efficiency of regenerating the cleaning media 1 can be improved.

Figure 39:
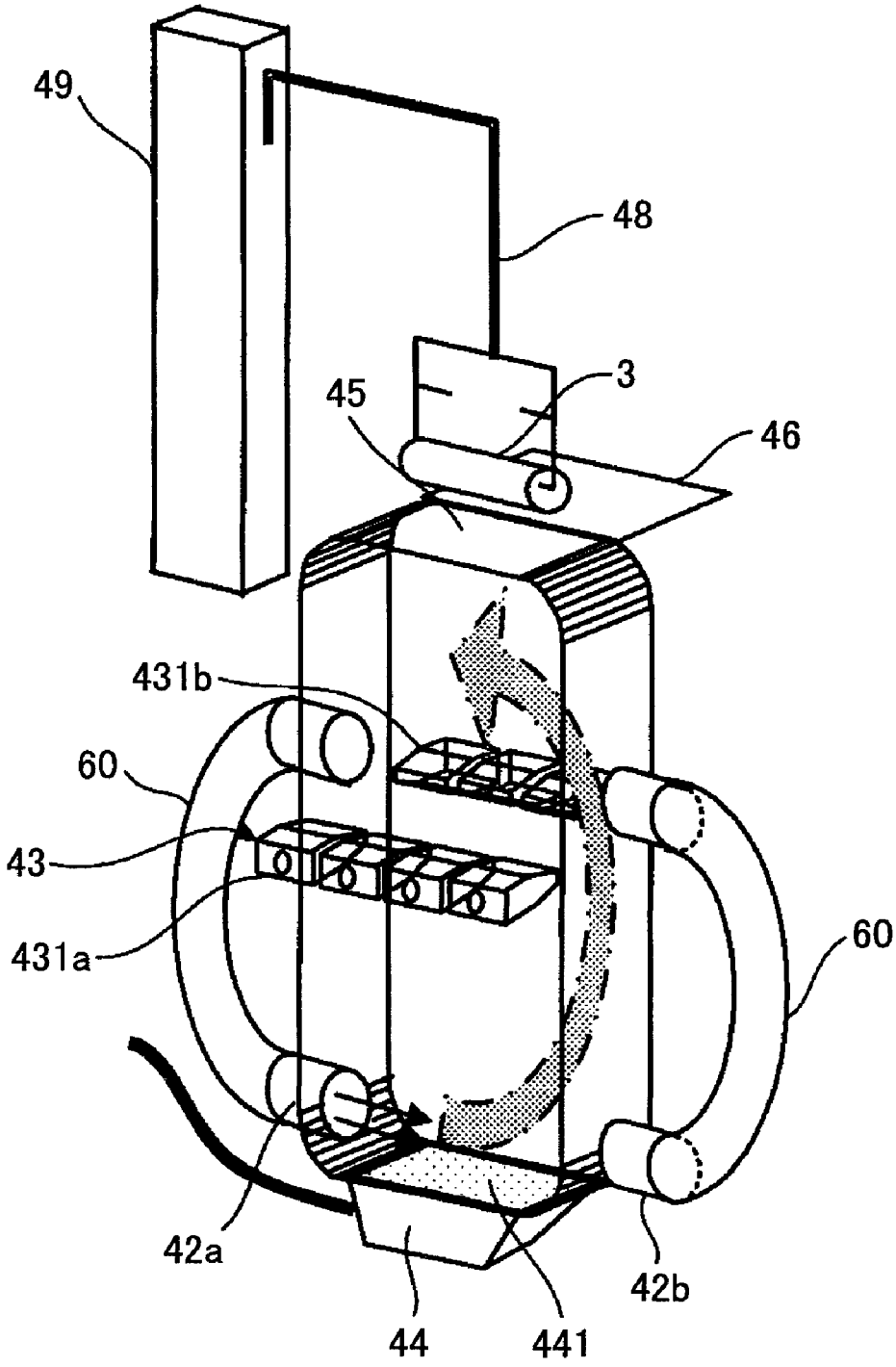
FIG. 39 is a configuration diagram of a third dry cleaning apparatus.
Figure 40:
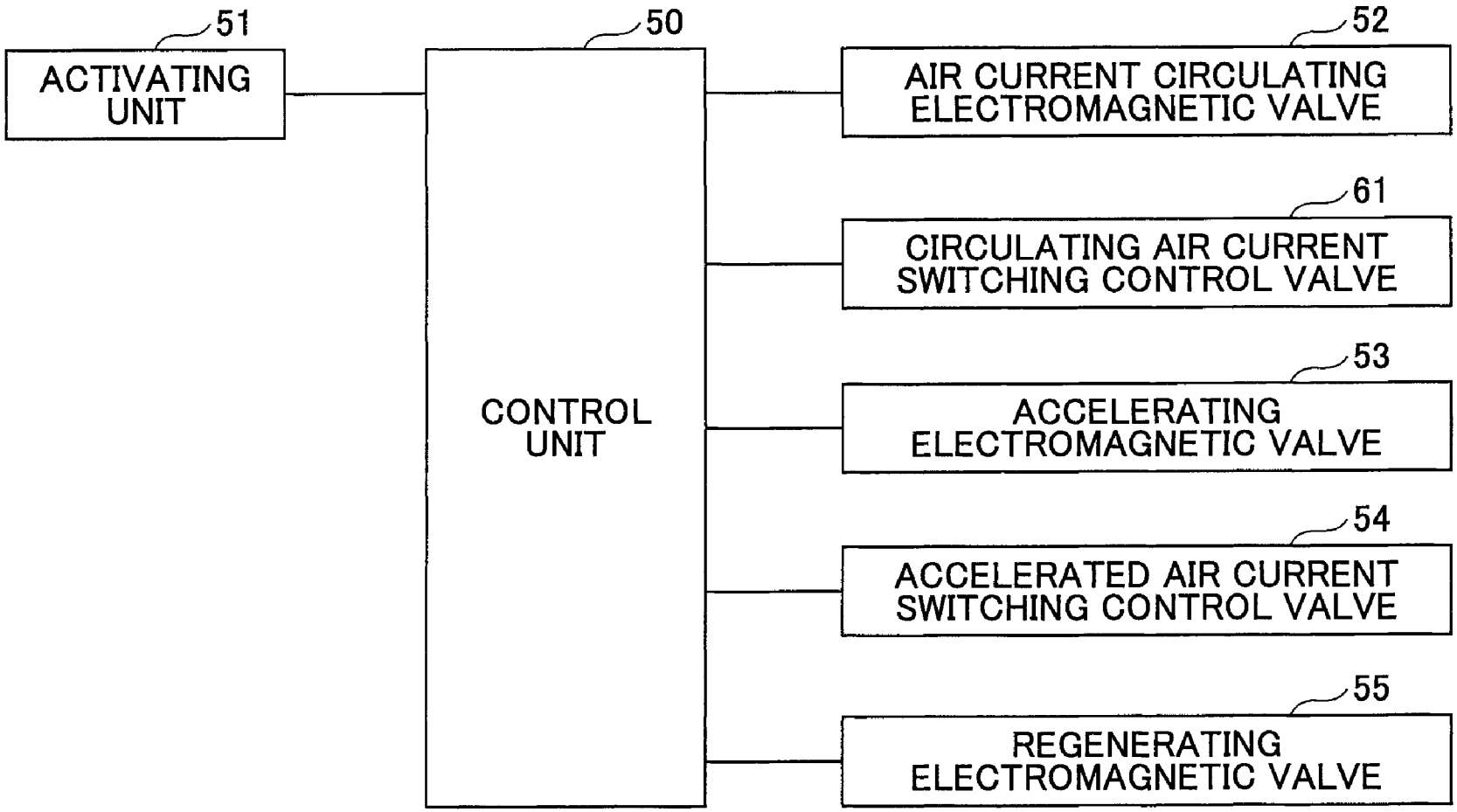
FIG. 40 is a block diagram showing the configuration of a drive control unit of the third dry cleaning apparatus.
Figure 41:
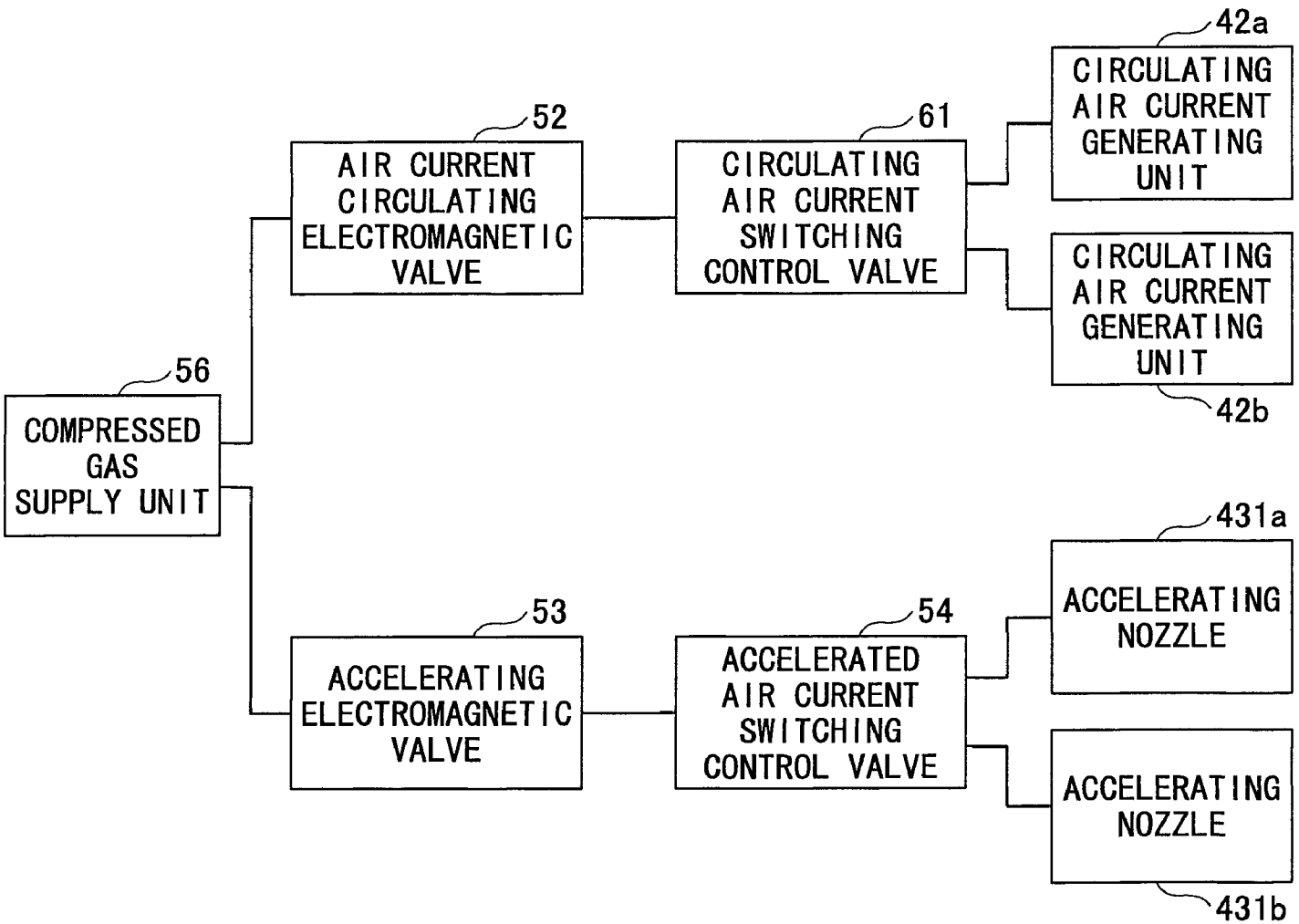
FIG. 41 is a block diagram showing the configuration of a control unit of the third dry cleaning apparatus.

In the above embodiment, one circulating air current generating unit 42 is provided in the cleaning tank 41. In an alternative embodiment shown in FIG. 39, two circulating air current generating units 42*a* and 42*b* may be provided one at each side surface of the cleaning tank 41 near the bottom so as to be symmetrically disposed with the separating member 441 of the cleaning media regenerating unit 44 therebetween. In FIG. 39, the circulating air current generating units 42*a* and 42*b* are disposed outside the cleaning tank 41 with their ejection ports located at the lower part of the cleaning tank 41 and their suction ports connected to the upper part of the cleaning tank 41 via duct hoses 60. In this case, as shown in the block diagram of FIG. 40, the control unit 50 controls not only the air current circulating electromagnet valve 52, the accelerating electromagnet valve 53, the accelerated air current switching control valve 54, and the regenerating electromagnet valve 55, but also a circulating air current switching control valve 61. With reference to FIG. 41, the circulating air current switching control valve 61 switches the destination of the compressed air between the circulating air current generating units 42*a* and 42*b*. When generating the circulating air current for flying the cleaning media 1 in the cleaning tank 41, the control unit 50 controls the circulating air current switching control valve 61 to generate the circulating air current alternately from the circulating air current generating units 42*a* and 42*b*. This eliminates the places in the cleaning tank 41 where the cleaning media 1 are likely to stay, thereby allowing effective use of the cleaning media 1 in the cleaning tank 41. Thus the frequency of collision of the cleaning media 1 with the object 3 is increased, resulting in efficient cleaning. Further, because the suction port is connected to the upper part of the cleaning tank 41 through the duct hose 60, it is possible to generate an upward air current in the cleaning tank 41. Thus the duration of flight of the cleaning media 1 is increased, so that the amount of flying cleaning media 1 is increased. Accordingly, the number of the cleaning media 1 that collide with the object 3 due to the compressed air delivered from the accelerating nozzles 431*a* and 431*b* is increased, resulting in improving the cleaning performance. Although the suction port is connected to the cleaning tank 41 via the duct hose 60, because the duct hose 60 is connected to the upper part of the cleaning tank 41 having smaller space density of the cleaning media 1, it is possible to prevent the duct hose 60 and the circulating air current generating units 42*a* and 42*b* from being clogged with the suctioned cleaning media 1.

Figure 42:
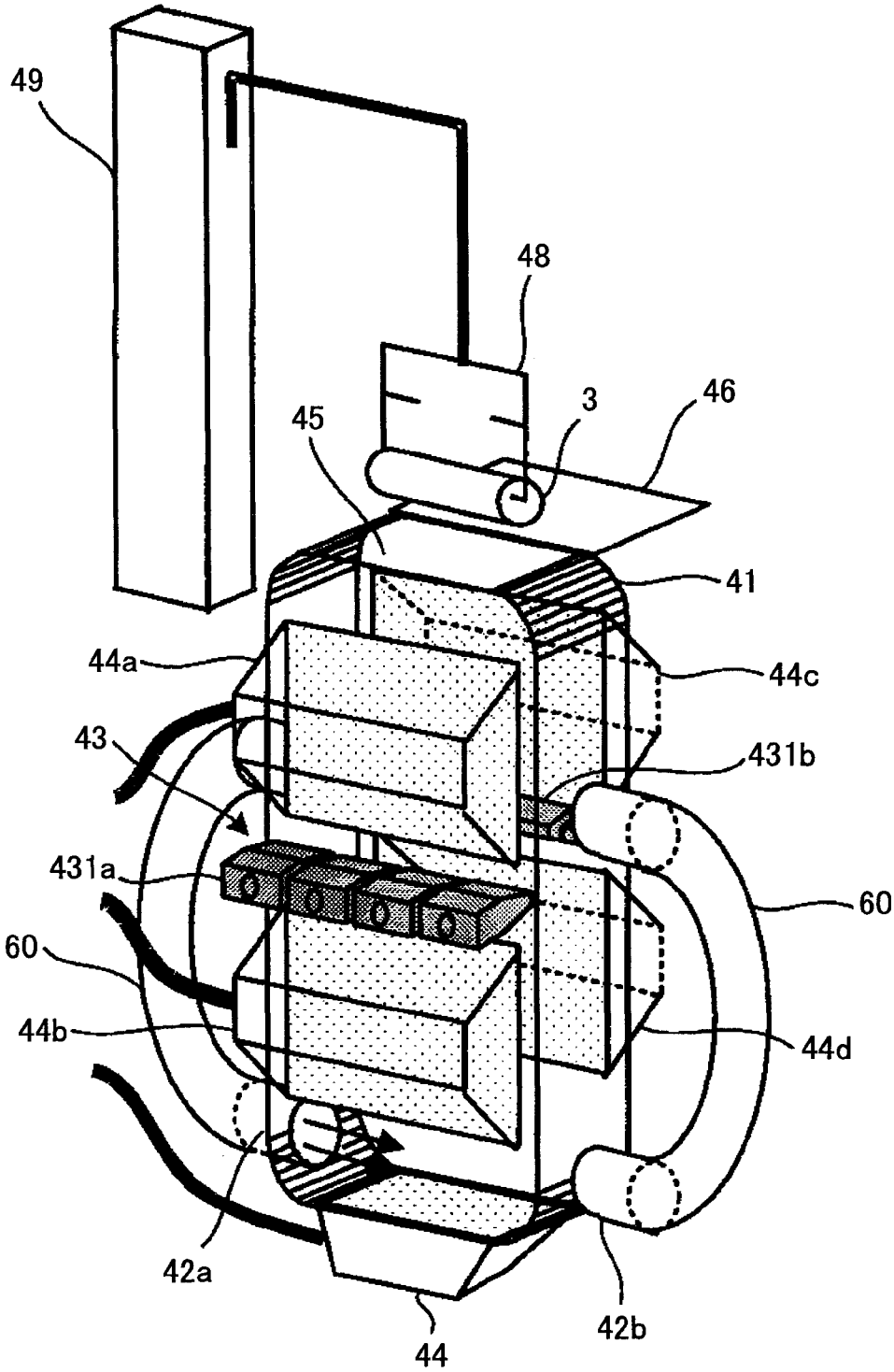
FIG. 42 is a configuration diagram of a fourth dry cleaning apparatus.
Figure 43:
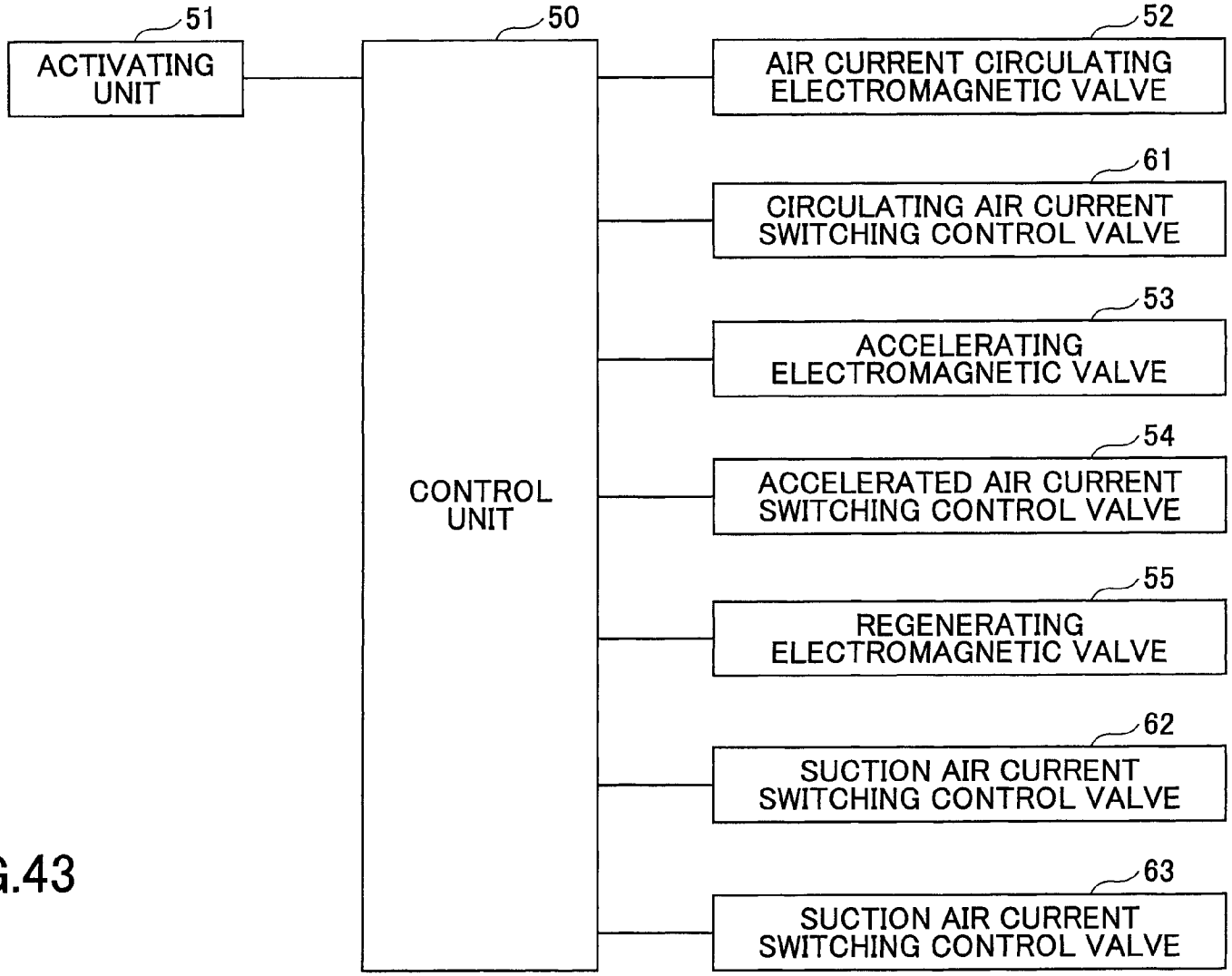
FIG. 43 is a block diagram showing the configuration of a drive control unit of the fourth dry cleaning apparatus.
Figure 44:
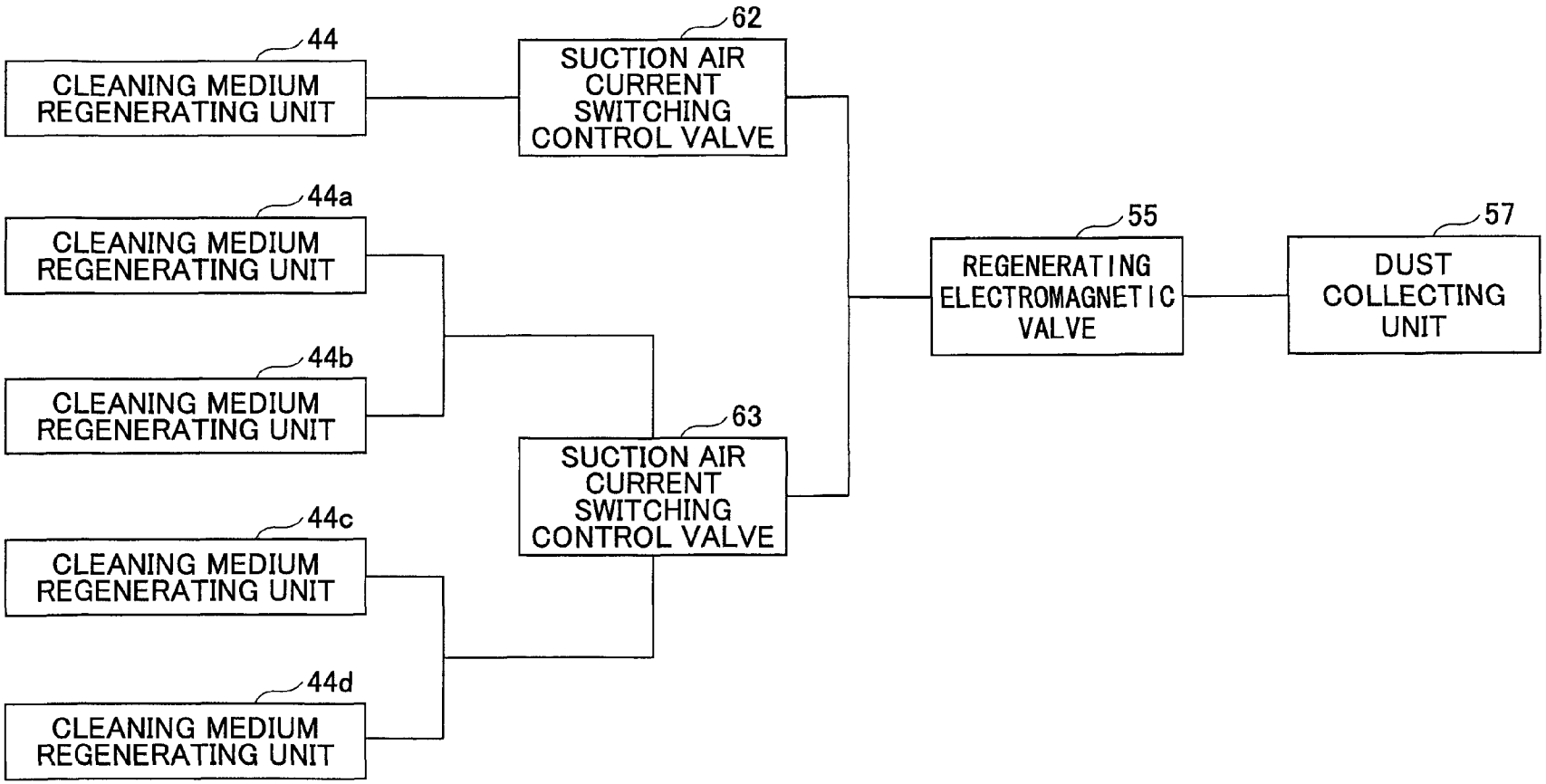
FIG. 44 is a block diagram showing the configuration of a control unit of the fourth dry cleaning apparatus.
Figure 45:
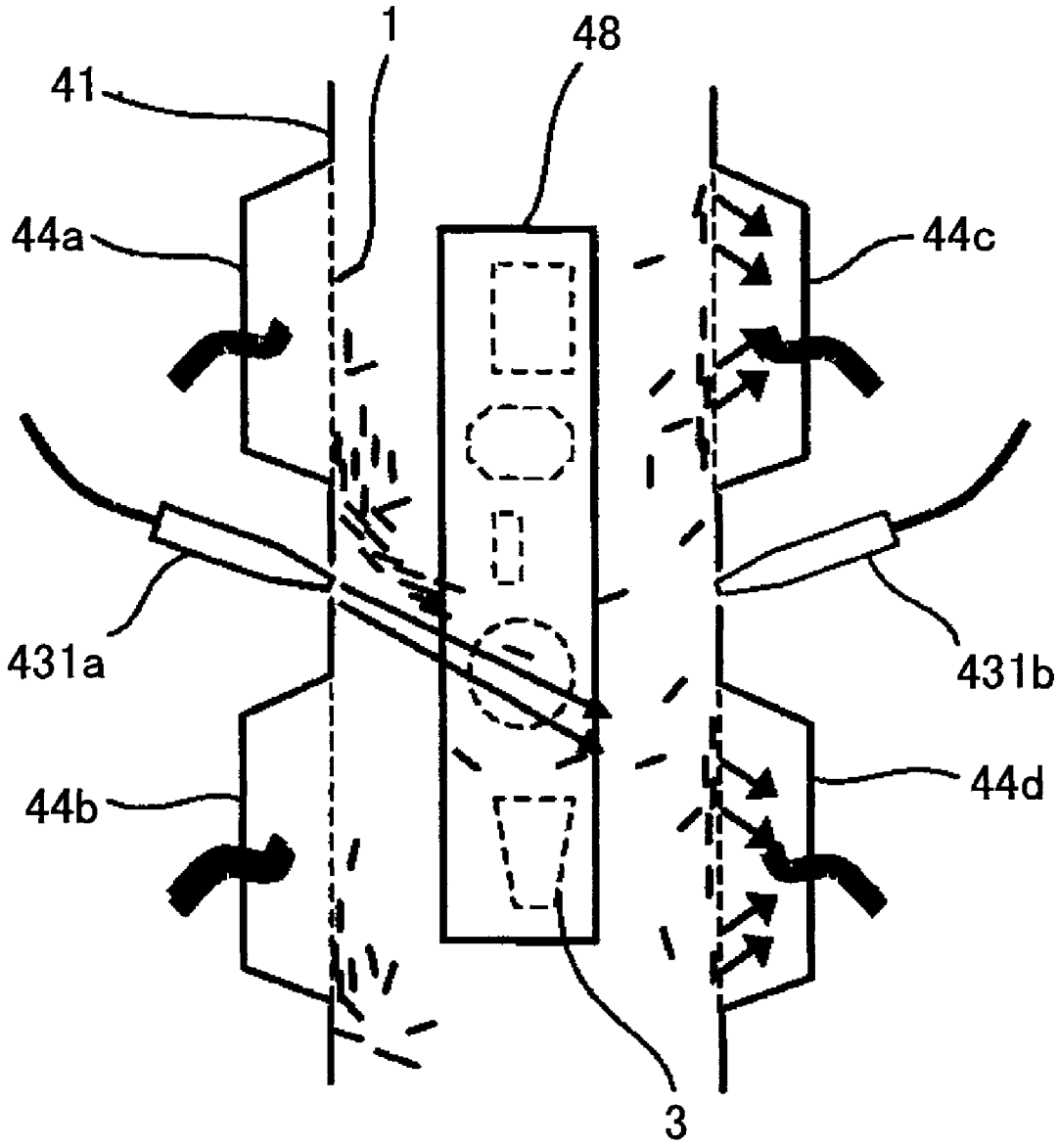
FIG. 45 is a diagram for explaining how the fourth dry cleaning apparatus causes cleaning media to collide with an object to be cleaned.

In the above embodiment, one cleaning medium regenerating unit 44 is provided in the cleaning tank 41. In an alternative embodiment, as shown in FIG. 42 for example, in addition to the cleaning medium regenerating unit 44 at the bottom, cleaning medium regenerating units 44*a*, 44*b*, 44*c* and 44*d* may be provided above and under the array of the accelerating nozzles 431*a* and above and under the array of the accelerating nozzles 431*b*, respectively. In this case, as shown in the block diagram of FIG. 43, the control unit 50 controls not only the air current circulating electromagnet valve 52, the accelerating electromagnet valve 53, the accelerated air current switching control valve 54, the regenerating electromagnet valve 55 and the circulating air current switching control valve 61, but also suction air current switching control valves 62 and 63. With reference to FIG. 44, the suction air current switching control valve 62 switches on and off the suction by the cleaning medium regenerating unit 44, while the suction air current switching control valve 63 switches between suction by the cleaning medium regenerating units 44*a* and 44*b* disposed on the front surface of the cleaning tank 41 and suction by the cleaning medium regenerating unit 44*c* and 44*d* disposed on the back surface of the cleaning tank 41. When, as shown in FIG. 45, cleaning the object 3 with the compressed air from the accelerating nozzles 431*a* disposed on the front surface of the cleaning tank 41, the control unit 50 connects the suction air current switching control valve 62 to the cleaning medium regenerating unit 44 and connects the suction air current switching control valve 63 to the cleaning medium regenerating units 44*c* and 44*d* disposed on the back surface. When cleaning the object 3 with the compressed air from the accelerating nozzles 431*b* is disposed on the back surface of the cleaning tank 41, the control unit 50 connects the suction air current switching control valve 63 to the cleaning medium regenerating units 44*a* and 44*b* disposed on the front surface. Thus, the extraneous substances 4 and the cleaning media 1 flying with the compressed air delivered from the accelerating nozzles 431*a* are suctioned by the cleaning medium regenerating units 44*c* and 44*d*. When the extraneous substances 4 and the cleaning media 1 are suctioned by the cleaning medium regenerating units 44*c* and 44*d*, the current from the accelerating nozzles 431*a* acts on the cleaning media 1 in addition to the suction currents of the cleaning medium regenerating units 44*c* and 44*d*, so that the current speed at the meshes of the separating members 441 of the cleaning medium regenerating units 44*c* and 44*d* can be dramatically increased. As a result, the performance of removing the extraneous substances 4 attached to the cleaning media 1 is significantly improved, ensuring the regeneration of the cleaning media 1. After a predetermine time has elapsed since the delivery of the compressed air from the accelerating nozzles 431*a* has been stopped, the suction by the cleaning medium regenerating units 44*c* and 44*d* is stopped. Thus the cleaning media 1 that have been suctioned onto the cleaning medium regenerating units 44*c* and 44*d* can be separated therefrom.

Further it is possible to prevent the flying cleaning media 1 from falling without being accelerated by the accelerating nozzles 431*a* and 431*b* and to provide a large amount of cleaning media 1 between the accelerating nozzles 431*a* and 431*b* and the object 3 while the compressed air is delivered from the accelerating nozzles 431*a* and 431*b*, resulting in enhancing the cleaning efficiency. That is, in the case of cleaning through collision of the flexible cleaning media 1 with the object 3, the cleaning quality is substantially proportional to the frequency of the collisions of the cleaning media 1 with the object 3 at a speed higher than a predetermined speed. Accordingly, increasing the amount of the cleaning media 1 can improve the cleaning quality and reduce the cleaning time, resulting in a reduction of energy use.

Figure 46:
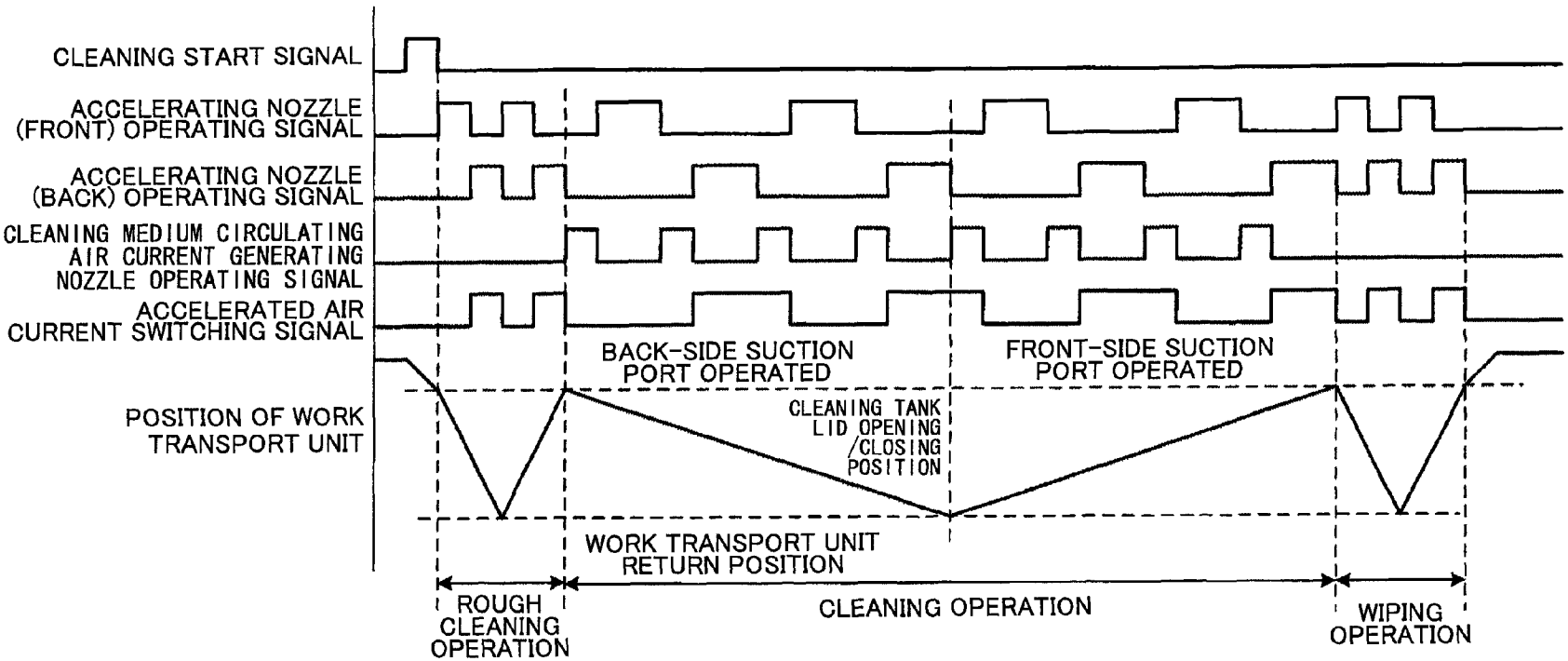
FIG. 46 is a timing chart showing a cleaning operation with a rough-cleaning operation and a wiping operation.

In an embodiment, rough cleaning using the acceleration nozzles 431*a* and 431*b* and the cleaning medium regenerating units 44*a* through 44*d* may be performed before the usual cleaning of the used cleaning media 1. The process including the rough cleaning is described with reference to the timing chart of FIG. 46.

The flexible cleaning media 1 are placed into the cleaning tank 41 and accumulated on the separating member 441 of the cleaning medium regenerating unit 44. Then the object 3 being held by the work holding unit 48 is placed into the cleaning tank 41 through the object inlet 45 and positioned in the initial position by the work transport unit 49. The lid 46 of the object inlet 45 is closed, so that the cleaning tank 41 is sealed. Then the activating unit 51 is operated to input a cleaning start signal to the control unit 50. The control unit 50 opens the accelerating electromagnet valve 53 to switch on and off the accelerated current switching control valve 54 on a predetermined cycle, thereby causing the accelerating nozzles 431*a* and 431*b* to alternately deliver compressed air. In synchronization with the switching between the compressed air delivery by the accelerating nozzles 431*a* and the compressed air delivery by the accelerating nozzles 431*b*, the control unit 50 controls the suction air current switching control valve 63 to switch between suction by the cleaning medium regenerating units 44*a* and 44*b* disposed on the surface facing the accelerating nozzles 431*b* for compressed air delivery and suction by the cleaning media regenerating units 44*c* and 44*d* disposed on the surface facing the accelerating nozzles 431*a* for compressed air delivery. More specifically, when the accelerating nozzles 431*a* on the front surface of the cleaning tank 41 delivers compressed air, the cleaning medium regenerating units 44*c* and 44*d* perform suction. With this operation, when the compressed air delivered from the accelerating nozzles 431*a* hits the object 3, the dirt and the extraneous substances 4 adhering to the object 3 with low adhesion force are removed, so that the object 3 is roughly cleaned. Then the circulating air current generating unit 42 is caused to generate the circulating current, thereby carrying and propelling the cleaning media 1 accumulated on the separating member 441 to of the cleaning media regenerating unit 44, thereby cleaning is performed using the flying cleaning media 1. When the cleaning operation by the flying cleaning media 1 is completed, the accelerating nozzles 431*a* and 431*b* are again caused to alternately deliver compressed air. In synchronization with the switching between the compressed air delivery by the accelerating nozzles 431*a* and the compressed air delivery by the compressed air delivery by the accelerating nozzles 431*b*, the control unit 50 controls the suction air current switching control valve 63 to switch between suction by the cleaning medium regenerating units 44*a* and 44*b* disposed on the surface facing the accelerating nozzles 431*b* for compressed air delivery and suction by the cleaning media regenerating units 44*c* and 44*d* disposed on the surface facing the accelerating nozzles 431*a* for compressed air delivery. Thus the cleaning media attached to the object 3 due to the electrostatic action are blown off, and the cleaning operation is completed. The lid 46 of the cleaning tank 41 is opened to take out the object 3 held by the work holding unit 48 with use of the work transport unit 49 so as to be replaced with another object 3 to be cleaned. Then the cleaning operation is started again. With the rough cleaning operation and the operation of blowing off the cleaning media 1, the cleaning speed and the cleaning quality can be improved.

Figure 47B:
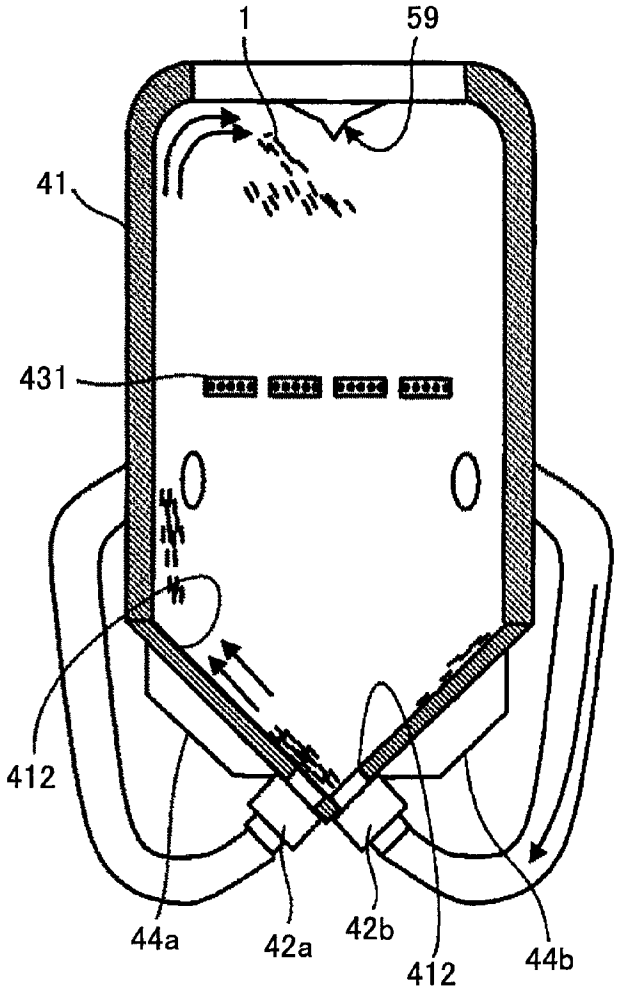
FIGS. 47A and 47B are configuration diagrams of a fifth dry cleaning apparatus.
Figure 47A:
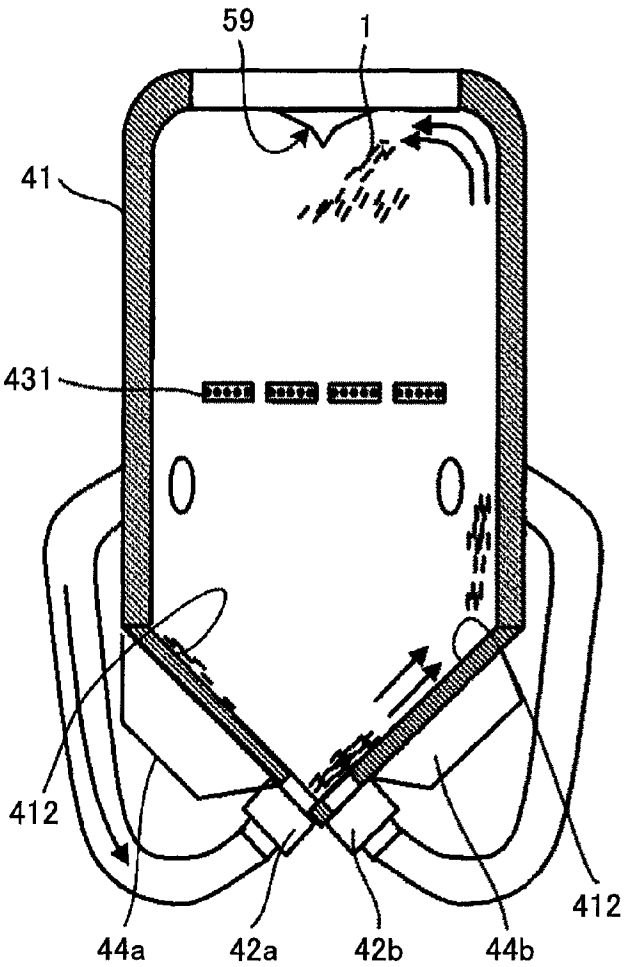

In the above embodiment, the cleaning medium regenerating units 44*a* and 44*b* and the cleaning medium regenerating units 44*c* and 44*d* are disposed on the front surface and the back surface of the cleaning tank 41, respectively. In an alternative embodiment, as shown in FIGS. 47A and 47B, the cleaning tank 41 may include slopes 412 forming a V-shaped bottom surface having two openings. The cleaning medium regenerating units 44*a* and 44*b* may be disposed on the slopes 412, respectively. The circulating air current generating units 42*a* and 42*b* may be disposed at the lower ends of the slopes 412, respectively. Thus the circulating air current generating units 42*a* and 42*b* alternately deliver the circulating air current along the slopes 412. Further, the air flow guide 59 for guiding the cleaning media 1 toward the cleaning medium accelerating unit 43 may preferably be provided on the top surface or at the upper side of the side surface of the cleaning tank 41 forming the circulation path of the circulating air current.

Figure 48:
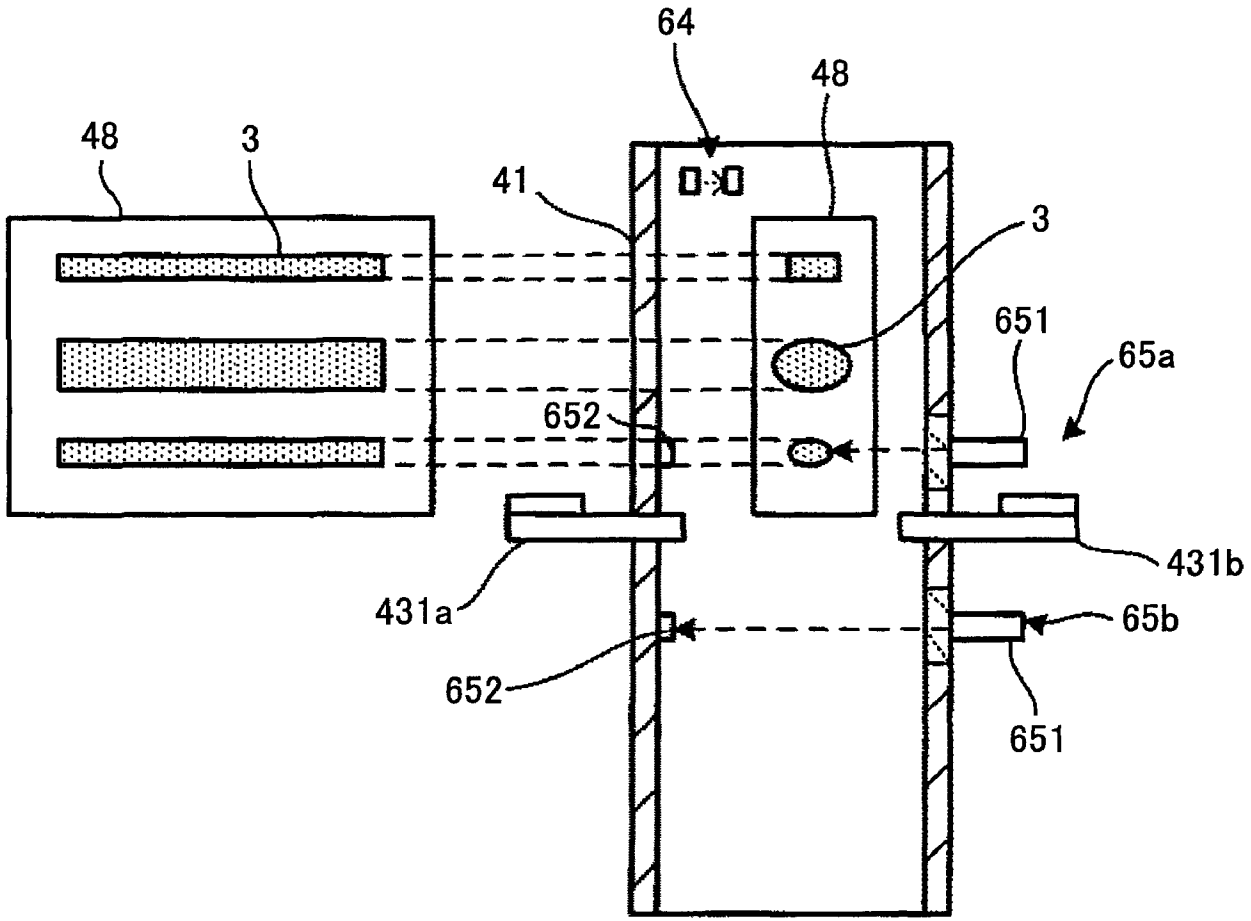
FIG. 48 is a configuration diagram of a sixth dry cleaning apparatus having a flying cleaning media amount measuring unit and an object detecting unit.
Figure 49:
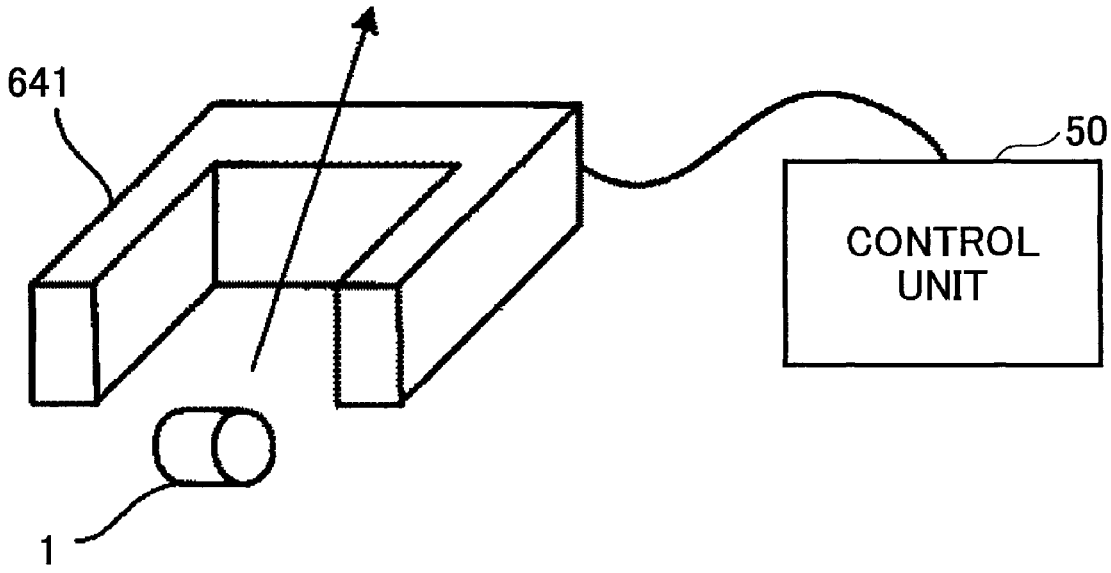
FIG. 49 is a configuration diagram of a photoelectric sensor of a flying cleaning media amount measuring unit.
Figure 50:
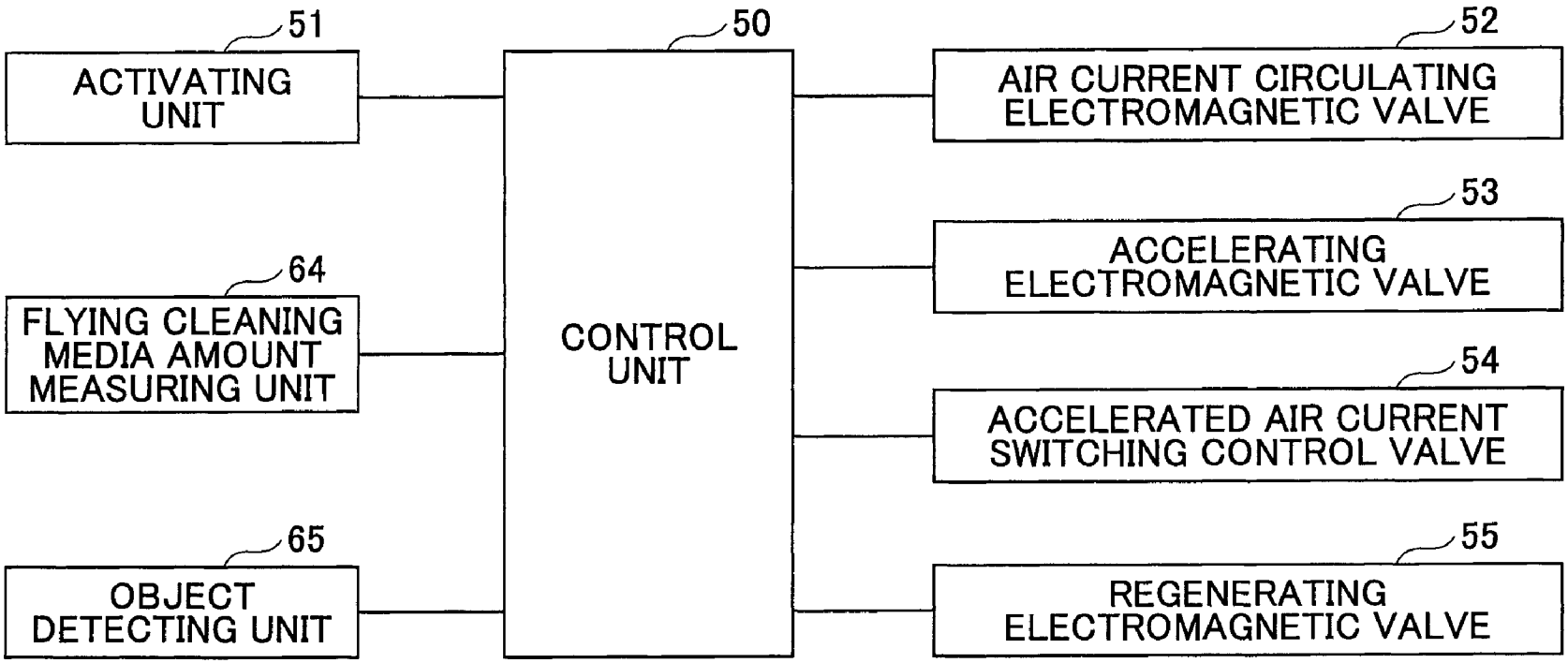
FIG. 50 is a block diagram showing the configuration of a drive control unit of a dry cleaning apparatus having a flying cleaning media amount measuring unit and an object detecting unit.

During cleaning, by causing the cleaning media 1 to fly and collide with the object 3, some cleaning media 1 may be broken down due to the collision with the object 3 and pass through the mesh of the separating member 441 of the cleaning medium regenerating unit 44 to be ejected into the dust collecting unit 57, resulting in a reduced amount of the cleaning media 1 in the cleaning tank 41. If the amount of the cleaning media 1 in the cleaning tank 41 is reduced and thus the amount of the cleaning media 1 flying in the cleaning tank 41 is reduced, the cleaning effect is lowered. In some cases, plural objects 3 may be held by the work holding unit 48 and placed into the cleaning tank 41 so as to be cleaned. In such cases, as shown in FIG. 48, it is preferable to provide a flying cleaning media amount measuring unit 64 in the cleaning tank 41 and to provide object detecting units 65*a* and 65*b* above and below the accelerating nozzles 431*a* and 431*b*, respectively, with a predetermined distance therebetween. As shown in FIG. 49, for example, the flying cleaning media amount measuring unit 64 includes a photoelectric sensor 641 with its optical beam orthogonal to the direction in which the cleaning media 1 circulate. Each of the object detecting units 65*a* and 65*b* includes a photoelectric sensor having, e.g., a light emitting/receiving unit 651 and a light reflector 652. The light emitting/receiving unit 651 is attached to the front surface of the cleaning tank 41 or the back surface thought a transparent window so as not to interfere with the cleaning media 1. The light reflector 652 is attached to the inner surface opposing the light emitting/receiving unit 651. Thus the light beam extends across the cleaning tank 41. The cleaning media amount measuring unit 64 and the object detecting units 65*a* and 65*b* are connected to the control unit 50 as shown in the block diagram of FIG. 50. The control unit 50 counts how many times the optical beam of the photoelectric sensor 641 of the flying cleaning media amount measuring unit 64 is blocked so as to measure the amount of the flying cleaning media 1 for a predetermined time period. The control unit 50 also controls the cleaning operation upon detection of the object 3 by the object detecting units 65*a* or 65*b*.

Figure 51:
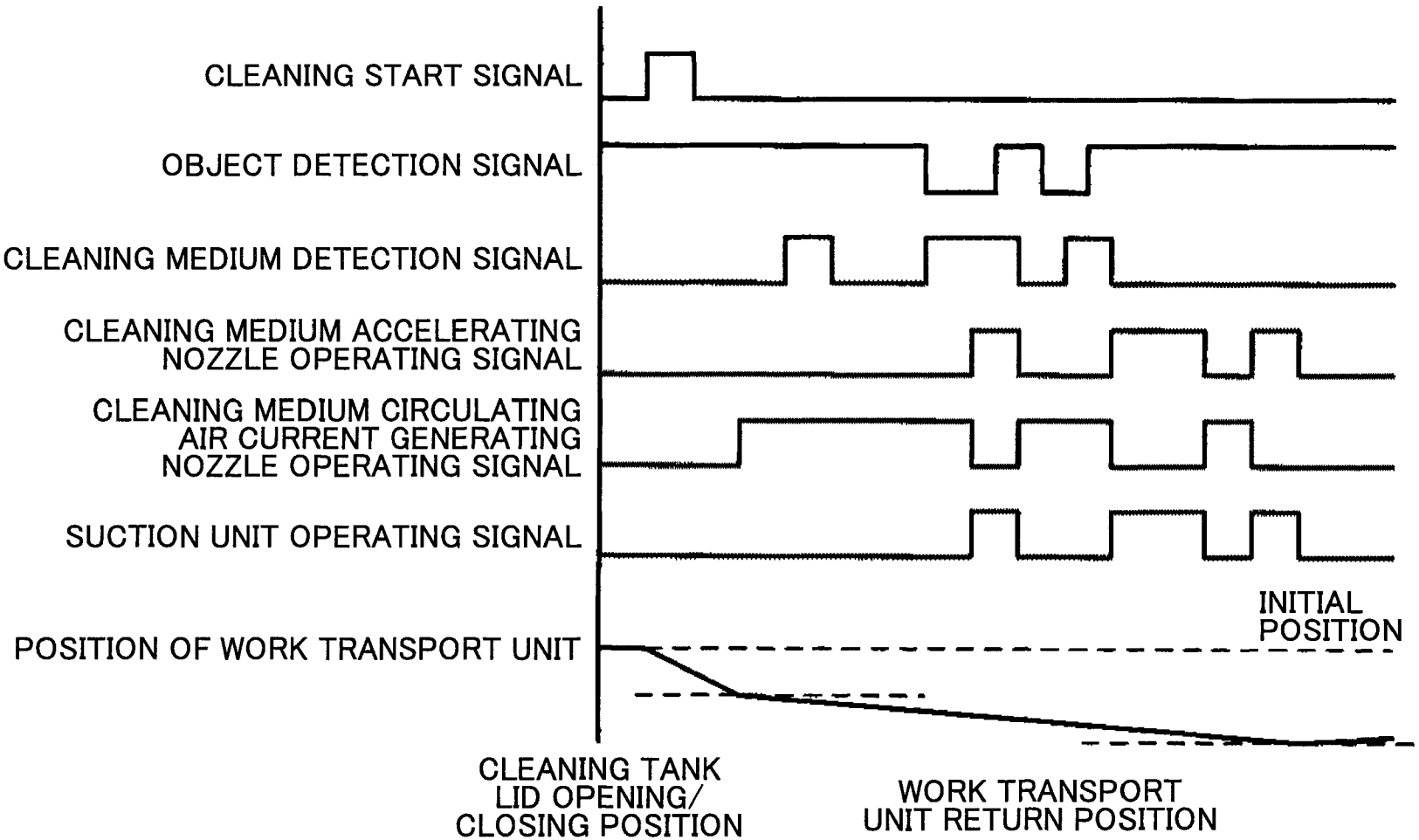
FIG. 51 is a timing chart illustrating a cleaning process of the sixth dry cleaning apparatus.

The cleaning operation to be performed in the case where the flying cleaning media amount measuring unit 64 and the object detecting units 65*a* and 65*b* are provided is described below with reference to the timing chart of FIG. 51.

As shown in FIG. 48, plural objects 3 being held by the work holding unit 48 are placed into the cleaning tank 41. After that, when a cleaning start signal is input, the circulating air current generating unit 42 generates a circulating air current, thereby carrying the cleaning media 1 accumulated on the cleaning media regenerating unit 44 to propel the cleaning media 1 in the cleaning tank 41. The photoelectric sensor 641 of the flying cleaning media amount measuring unit 64 detects the amount of the flying cleaning media 1 and reports the amount to the control unit 50. The control unit 50 compares the reported amount of the flying cleaning media 1 for a predetermined time period with a preset threshold, and starts a cleaning operation if the amount of the flying cleaning media 1 is greater than the threshold. If the amount of the flying cleaning media 1 is less than the threshold, the control unit 50 issues an alert and stops the cleaning operation. Then, a hopper or the like supplies a predetermined amount of the cleaning media 1 or a sufficient amount of the cleaning media 1 to cover the shortfall. When a cleaning start signal is input again, the cleaning media 1 are caused to fly. If the amount of the flying cleaning media 1 is greater than the threshold, the control unit 50 starts a cleaning operation.

Since the amount of the flying cleaning media 1 is detected and the cleaning operation is performed using the predetermined amount of the flying cleaning media 1 or greater, high quality cleaning can be performed. The amount of the cleaning media 1 that collide with the object 3 is proportional to the amount of the flying cleaning media 1. Therefore, the control unit 50 can evaluate the cleaning quality based on the flying amount in each predetermined time period. Further, if the fluctuation of the amount of the flying cleaning media 1 is recorded, it is possible to accurately quantify the cleaning quality and cleaning performance.

When the cleaning operation starts, the work transport unit 49 moves down the plural objects 3. When the first object 3 reaches a position to block the optical beam of the object detecting unit 65*a* disposed above the accelerating nozzles 431*a* and 431*b*, the object detecting unit 65*a* inputs an object detection signal to the control unit 50. With a delay of a time required for the object 3 to reach the position of the accelerating nozzles 431*a* and 431*b*, which is calculated based on the travel speed of the object 3 and the distance between the object detecting unit 65*a* and the accelerating nozzles 431*a* and 431*b*, the control unit 50 stops generation of circulating air current and starts delivery of the compressed air by the accelerating nozzles 431*a* and suction by the cleaning medium regenerating unit 44 so as to clean the first object 3. When the object detection signal is not input from the object detecting unit 65*a* any longer, with a delay of the time required for the object 3 to reach the position of the accelerating nozzles 431*a* and 431*b*, the control unit 50 stops the delivery of the compressed air by the accelerating nozzles 431*a* and suction by the cleaning medium regenerating unit 44 and starts generation of circulating air current by the circulating air current generating unit 42. This control operation is performed every time the object detecting unit 65*a* inputs an object detecting signal, so that the plural objects 3 are sequentially cleaned. When the objects 3 reach the return point, the objects 3 start moving up. While the objects 3 move up, the control unit 50 performs a control operation similar to the above-described control operation every time the object detecting unit 65*a* inputs an object detecting signal, thereby cleaning the entire surfaces of the objects 3 while causing the accelerating nozzles 431*b* to deliver compressed air.

With this configuration, since the delivery of the compressed air from the accelerating nozzles 431*a* and 431*b*, which use a large amount of compressed air, is performed according to the position of the object 3, the use of compressed air by the accelerating nozzles 431*a* and 431*b* can be reduced, thereby reducing energy consumption.

In the above embodiment, the flying cleaning media amount measuring unit 64 including the photoelectric sensor 641 is used. In an alternative embodiment, a method of integrating the power of impact of the cleaning media 1 on the object 3 with use of a force sensor, or a method of measuring weight at the end of process with use of a weight sensor, a method of measuring the amount of the accumulated cleaning media 1 at the bottom of the cleaning tank 41 with use of the distance sensor may be used. In the case of integrating the power of the impact of the cleaning media 1, cleaning quality can be evaluated based on the integrated number of times of the impact.

Figure 52:
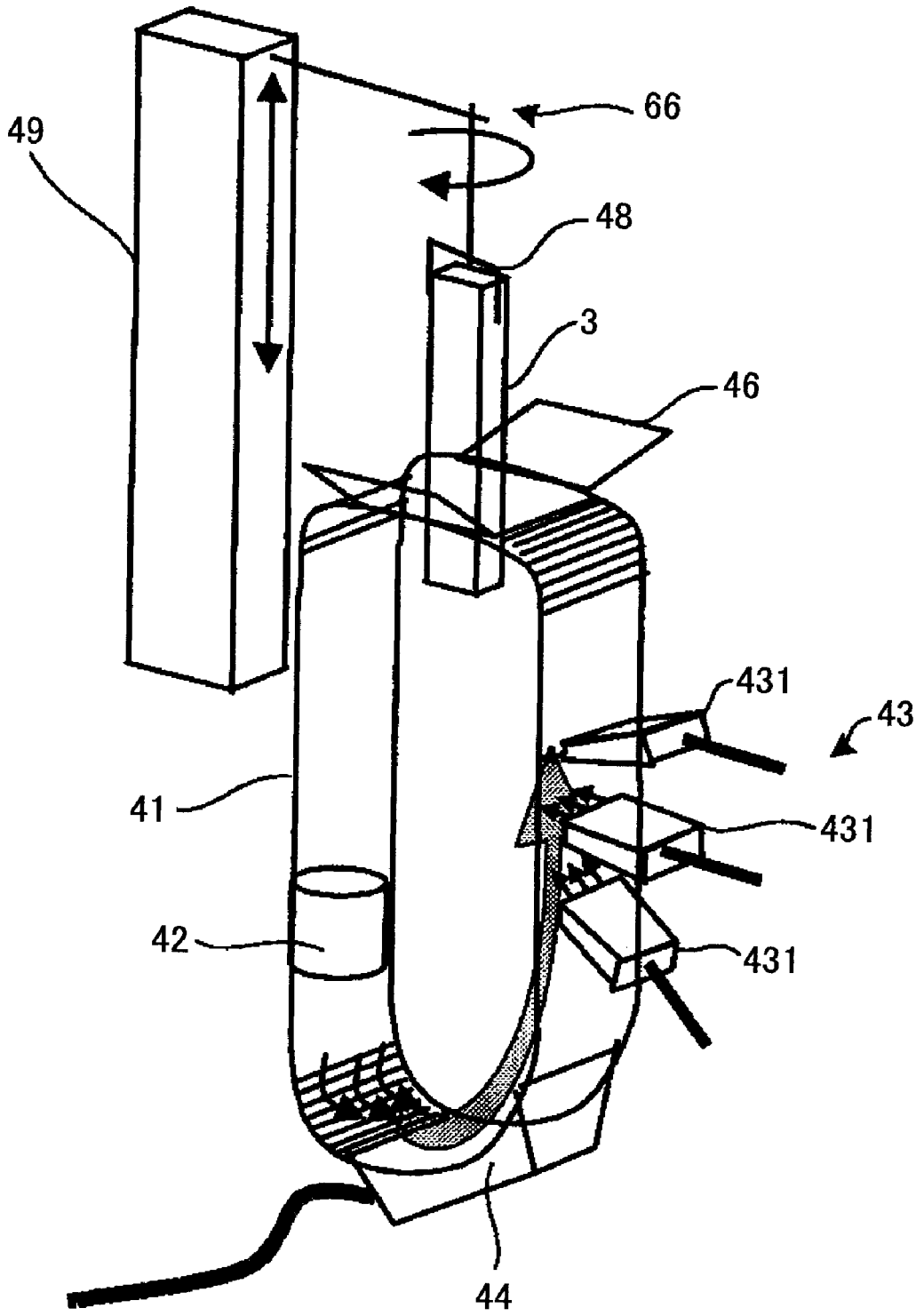
FIG. 52 is a configuration diagram of a seventh dry cleaning apparatus.

Referring to FIG. 52, a work orientation changing unit 66 that rotates the work holding unit 48 about the longitudinal axis using a motor or an air cylinder may be provided between the work transport unit 49 and the work holding unit 48. Further, as the cleaning medium accelerating unit 43, plural arrays, e.g., three arrays, of plural accelerating nozzles may be provided on one of the side walls of the cleaning tank 41 forming the circulation path of the circulating air current. The accelerating nozzles 431 are disposed to have different injection directions, e.g., the horizontal direction and the vertical direction. The object 3 being held by the work holding unit 48 is placed into the cleaning tank 41. The object 3 is rotated and vertically moved while the injection of the compressed air is alternately performed by the plural arrays of accelerating nozzles 431, thereby cleaning the object 3. Injecting the compressed air from different directions to the object 3 being rotated and vertically moved makes it possible to uniformly clean the entire surface of the object 3 even if the object 3 has a complex shape.

The above embodiments are designed for removing dry toner (average diameter in a range about 5 through 10 μm) as the extraneous substances 4, which is used in electrophotographic apparatuses such as copiers and laser printers. This is not a limiting example, and the present invention is applicable to a cleaning apparatus for removing attached particles or dust in general. The type of the cleaning medium 1 and the speed and volume of the air current are selected as appropriate in accordance with the characteristics of the object 3 and the extraneous substances 4. If the object 3 to be cleaned is easily damaged, for example, a tubular cleaning medium 1 made of a flexible material such as resin and having a thin wall thickness may be used. The easily bendable cleaning medium 1 does not damage the object 3 to be cleaned.

Experiment 1

In order to observe the effects of the adhesion force of toner as the extraneous substance 4 to be removed by dry cleaning, a toner cartridge of a copier with toner attached was heated for one hour, and thus three types of samples were prepared having the toner adhering thereto with different adhesion forces (low adhesion force, medium adhesion force, and high adhesion force). The samples were cleaned by the dry cleaning apparatus 11 to remove the toner adhering to the samples. Each sample was cleaned for two minutes by using plural air nozzles SL-920A made by Silvent as an air blowing unit while maintaining a constant compressed air pressure of 0.2 MPa.

The following four types of flexible tubular cleaning media 1 were used.

(1) cylindrical polyethylene tube having a wall thickness of 30 μm, an outer diameter of 5 mm, and a length of 10 mm (2) cylindrical PET (polyethylene terephthalate) tube having a wall thickness of 30 μm, an outer diameter of 5 mm, and a length of 10 mm (3) cylindrical polyethylene tube having a wall thickness of 100 μm, an outer diameter of 5 mm, and a length of 10 mm (4) cylindrical PET tube having a wall thickness of 100 μm, an outer diameter of 5 mm, and a length of 10 mm As comparative examples, performed were:

(5) dry cleaning by air blow without using cleaning media, and dry cleaning by air blow using the following four types of granular cleaning media:

(6) nylon cube of 2 mm on a side (7) nylon ball having a diameter of 2 mm (8) urethane sponge ball having a diameter of 5 mm (9) non-flexible PET cylinder having a diameter of 5 mm and a length of 10 mm Table 1 shows the cleaning results.

TABLE 1

| CLEANING MEDIUM | TONER/ADHESION FORCE HIGH | TONER/ADHESION FORCE MEDIUM | TONER/ADHESION FORCE LOW | DAMAGE TO OBJECT | CLEANING UNIFORMITY (ADHESION FORCE: MEDIUM) |
|---|---|---|---|---|---|
| EXPERIMENT 1 | | | | | |
| (1) cylindrical polyethylene tube, wall thickness 30 μm, outer diameter: 5 mm, length: 10 mm | ◎ | ◎ | ○ | NO | HIGH |
| (2) cylindrical PET tube, wall thickness 30 μm, outer diameter: 5 mm, length: 10 mm | ◎ | ○ | ○ | NO | HIGH |
| (3) cylindrical polyethylene tube, wall thickness: 100 μm, outer diameter: 5 mm, length: 10 mm | ◎ | ○ | ○ | NO | HIGH |
| (4) cylindrical PET tube, wall thickness: 100 μm, outer diameter: 5 mm, length: 10 mm | ◎ | ○ | Δ | NO | HIGH |
| COMPARATIVE EXAMPLES | | | | | |
| (5) dry cleaning by air blow only, no cleaning media | X | X | X | NO | REMAIN UNCLEAN |
| (6) nylon cube, 2 mm on a side | ○ | Δ | Δ | YES | LOW |
| (7) nylon ball, diameter: 2 mm | ○ | Δ | Δ | YES | LOW |
| (8) urethane sponge ball, diameter: 5 mm | Δ | Δ | X | NO | LOW |
| (9) non-flexible PET cylinder, diameter: 5 mm length: 10 mm | ○ | Δ | Δ | YES | LOW |

As is understood from Table 1 the dry cleaning methods using the flexible tubular cleaning media 1 exhibited better cleaning results than the related-art dry cleaning methods using granular cleaning media. Among the flexible tubular cleaning media 1, the higher the flexibility of the cleaning medium 1, the better the cleaning result.

Experiment 2

The following shows experimental results of dry cleaning using the cleaning media 1 repeatedly.

A toner cartridge of a copier with toner attached was heated for one hour, and thus samples were prepared having the toner adhering thereto with medium adhesion force. Each sample was cleaned for two minutes by using plural air nozzles SL-920A made by Silvent as an air blowing unit while maintaining a constant compressed air pressure of 0.2 MPa. The same cleaning media 1 were continuously used without being replaced. Thus transitions of the cleaning results along with the increase of the number of the samples subjected to the cleaning process were compared. The following five types of flexible tubular cleaning media 1 were used.

(1) cylindrical polyethylene tube having a wall thickness of 30 μm, an outer diameter of 5 mm, and a length of 10 mm (2) cylindrical PET tube having a wall thickness of 30 μm, an outer diameter of 5 mm, and a length of 10 mm (3) cylindrical nylon-cloth tube having a wall thickness of 100 μm, an outer diameter of 5 mm, and a length of 10 mm (4) cylindrical paper tube having a wall thickness of 100 μm, an outer diameter of 5 mm, and a length of 10 mm (5) cylindrical aluminum tube having a wall thickness of 100 μm, an outer diameter of 5 mm, and a length of 10 mm Table 2 shows the cleaning results.

TABLE 2

| CLEANING MEDIUM | SAMPLE | | | |
|---|---|---|---|---|
| EXPERIMENT 2 | 1st | 10th | 50th | 100th |
| (1) cylindrical polyethylene tube, wall thickness: 30 μm, outer diameter: 5 mm, length: 10 mm | ○ | ○ | ○ | ○ |
| (2) cylindrical PET tube, wall thickness: 30 μm, outer diameter: 5 mm, length: 10 mm | ○ | ○ | ○ | ○ |
| (3) cylindrical nylon-cloth tube, wall thickness: 100 μm, outer diameter: 5 mm, length: 10 mm | ○ | ○ | Δ frayed at the ends | X frayed entirely |
| (4) cylindrical paper tube, wall thickness: 100 μm, outer diameter: 5 mm, length: 10 mm | ○ | ○ | Δ frayed at the ends | X frayed entirely |
| (5) cylindrical aluminum tube, wall thickness: 100 μm, outer diameter: 5 mm, length: 10 mm | ○ | X curled and incapable of cleaning | — | — |

As is understood from Table 2, the cleaning media 1 made of resin materials exhibited better cleaning results in the case of repeated use.

Experiment 3

In order to observe the difference in the cleaning performance, a toner cartridge of a copier with toner attached was heated for one hour, and thus samples were prepared having the toner adhering thereto with increased adhesion force (medium adhesion force). The samples were cleaned by the dry cleaning apparatus 11*a*. Each sample was cleaned for one minute by using plural air nozzles SL-920A made by Silvent as an air blowing unit while maintaining a constant compressed air pressure of 0.2 MPa. The following three types of flexible tubular cleaning media 1 were used.

(1) cylindrical PET tube formed in the shape shown in FIG. 1 and having a wall thickness of 30 μm, an outer diameter of 5 mm, and a length of 10 mm (2) quadrangular PET tube formed in the shape shown in FIG. 7B and having a wall thickness of 30 μm, an outer diameter of 5 mm, and a length of 10 mm (3) cylindrical PET tube including flexible thin pieces on the side surface formed in the shape shown in FIG. 11A and having a wall thickness of 30 μm, an outer diameter of 5 mm, and a length of 10 mm As comparative examples, cleaning was performed using the following six types of cleaning media:

(4) PET film having a thickness of 30 μm and sides of 5 mm by 5 mm (5) dry cleaning by air blow without using cleaning media (6) nylon cube of 2 mm on a side (7) nylon ball having a diameter of 2 mm (8) urethane sponge ball having a diameter of 5 mm (9) non-flexible PET cylinder having a diameter of 5 mm and a length of 10 mm Table 3 shows the cleaning results. In Table 3, the double circle mark indicates very clean as a result of toner cleaning; the single circle mark indicates fairly clean; the triangle mark indicates partly unclean; and the x mark indicates unclean.

TABLE 3

| CLEANING MEDIUM | TONER CLEANING RESULT | CLEANING UNIFORMITY | TONER REMAINING POINT DUE TO ATTACHED CLEANING MEDIA | AMOUNT OF CLEANING MEDIA ATTACHED TO TANK OR OBJECT |
|---|---|---|---|---|
| EXPERIMENT 3 | | | | |
| (1) cylindrical PET tube, wall thickness: 30 μm, outer diameter: 5 mm, length: 10 mm | ○ | HIGH | NO | SMALL |
| (2) quadrangular PET tube, wall thickness: 30 μm, outer diameter: 5 mm, length: 10 mm | ◎ | HIGH | NO | SMALL |

TABLE 3-continued

| CLEANING MEDIUM | TONER CLEANING RESULT | CLEANING UNIFORMITY | TONER REMAINING POINT DUE TO ATTACHED CLEANING MEDIA | AMOUNT OF CLEANING MEDIA ATTACHED TO TANK OR OBJECT |
|---|---|---|---|---|
| (3) cylindrical PET tube including flexible thin pieces on the side surface, wall thickness: 30 μm, outer diameter: 5 mm, length: 10 mm | ○ | HIGH | NO | NONE |
| COMPARATIVE EXAMPLES | | | | |
| (4) PET film, thickness: 30 μm, sides of 5 mm by 5 | ○ | HIGH | YES | LARGE |
| (5) dry cleaning by air blow only, no cleaning media | X | REMAIN UNCLEAN | NO | NONE |
| (6) nylon cube, 2 mm on a side | Δ | LOW | NO | SMALL |
| (7) nylon ball, diameter: 2 mm | Δ | LOW | NO | SMALL |
| (8) urethane sponge ball, diameter: 5 mm | Δ | LOW | NO | SMALL |
| (9) non-flexible PET cylinder, diameter: 5 mm length: 10 mm | Δ | LOW | NO | SMALL |

As is understood from Table 3, the dry cleaning methods using the flexible tubular cleaning media 1 exhibited better cleaning results than the related-art cleaning methods. The flexible tubular cleaning media 1 having different shapes showed good results in different evaluation items. Therefore, the cleaning medium 1 having the shape that shows a good result in the item on which importance is placed may be selected so as to achieve the desired cleaning result. It is possible to use different shapes of the flexible tubular cleaning media 1 at the same time or to use different shapes of the cleaning media 1 at different steps of the cleaning process.

Experiment 4

In order to observe the effects of the adhesion force of toner as the extraneous substance 4 to be removed by dry cleaning, a toner cartridge of a copier with toner attached was heated for one hour, and thus three types of samples were prepared having the toner adhering thereto with different adhesion forces (low adhesion force, medium adhesion force, and high adhesion force). The samples were cleaned by the dry cleaning apparatus 11*a* to remove the toner adhering to the samples. Each sample was cleaned for two minutes by using plural air nozzles SL-920A made by Silvent as an air blowing unit while maintaining a constant compressed air pressure of 0.2 MPa.

The following four types of flexible bag-shaped cleaning media 1*a* were used.

(1) polyethylene cone having a wall thickness of 30 μm, a bottom diameter of 5 mm, and a length of 10 mm (2) PET (polyethylene terephthalate) cone having a wall thickness of 30 μm, a bottom diameter of 5 mm, and a length of 10 mm (3) polyethylene cone having a wall thickness of 100 μm, a bottom diameter of 5 mm, and a length of 10 mm (4) PET cone having a wall thickness of 100 μm, a bottom diameter of 5 mm, and a length of 10 mm As comparative examples, performed were:

(5) dry cleaning by air blow without using cleaning media, and dry cleaning by air blow using the following four types of granular cleaning media:

(6) nylon cube of 2 mm on a side (7) nylon ball having a diameter of 2 mm (8) urethane sponge ball having a diameter of 5 mm (9) non-flexible PET cone having a bottom diameter of 5 mm and a length of 10 mm Table 4 shows the cleaning results.

TABLE 4

| CLEANING MEDIUM | TONER ADHESION FORCE HIGH | TONER ADHESION FORCE MEDIUM | TONER ADHESION FORCE LOW | DAMAGE TO OBJECT | CLEANING UNIFORMITY (ADHESION FORCE: MEDIUM) |
|---|---|---|---|---|---|
| EXPERIMENT 4 | | | | | |
| (1) polyethylene cone, wall thickness: 30 μm, bottom diameter: 5 mm, length: 10 mm | ◎ | ◎ | ○ | NO | HIGH |
| (2) PET (polyethylene terephthalate) cone, wall thickness: 30 μm, bottom diameter: 5 mm, length: 10 mm | ◎ | ○ | ○ | NO | HIGH |
| (3) polyethylene cone, wall thickness: 100 μm, bottom diameter: 5 mm, length: 10 mm | ◎ | ○ | ○ | NO | HIGH |
| (4) PET cone, wall thickness: 100 μm, bottom diameter: 5 mm, length: 10 mm | ◎ | ○ | Δ | NO | HIGH |
| COMPARATIVE EXAMPLES | | | | | |
| (5) dry cleaning by air blow only, no cleaning media | X | X | X | NO | REMAIN UNCLEAN |
| (6) nylon cube, 2 mm on a side | ○ | Δ | Δ | YES | LOW |

TABLE 4-continued

| CLEANING MEDIUM | TONER ADHESION FORCE HIGH | MEDIUM | LOW | DAMAGE TO OBJECT | CLEANING UNIFORMITY (ADHESION FORCE: MEDIUM) |
|---|---|---|---|---|---|
| (7) nylon ball, diameter: 2 mm | ○ | Δ | Δ | YES | LOW |
| (8) urethane sponge ball, diameter: 5 mm | Δ | Δ | X | NO | LOW |
| (9) non-flexible PET cone, bottom diameter: 5 mm, length: 10 mm | ○ | Δ | Δ | YES | LOW |

As is understood from Table 4, the dry cleaning methods using the flexible bag-shaped cleaning media 1*a* exhibited better cleaning results than the related-art dry cleaning methods using granular cleaning media. Among the flexible bag-shaped cleaning media 1*a*, the higher the flexibility of the cleaning medium 1*a*, the better the cleaning result.

Experiment 5

The following shows experimental results of dry cleaning using the flexible bag-shaped cleaning media 1*a* repeatedly.

A toner cartridge of a copier with toner attached was heated for one hour, and thus samples were prepared having the toner adhering thereto with medium adhesion force. Each sample was cleaned for two minutes by using plural air nozzles SL-920A made by Silvent as an air blowing unit while maintaining a constant compressed air pressure of 0.2 MPa. The same cleaning media 1*a* were continuously used without being replaced. Thus transitions of the cleaning results along with the increase of number of the cleaned samples were compared. The following five types of flexible bag-shaped cleaning media 1*a* were used.

(1) polyethylene cone having a wall thickness of 30 μm, a bottom diameter of 5 mm, and a length of 10 mm (2) PET cone having a wall thickness of 30 μm, a bottom diameter of 5 mm, and a length of 10 mm (3) nylon-cloth cone having a wall thickness of 100 μm, a bottom diameter of 5 mm, and a length of 10 mm (4) paper cone having a wall thickness of 100 μm, a bottom diameter of 5 mm, and a length of 10 mm (5) aluminum cone having a wall thickness of 100 μm, a bottom diameter of 5 mm, and a length of 10 mm Table 5 shows the cleaning results.

As is understood from Table 5, the cleaning media 1*a* made of resin materials exhibited better cleaning results in the case of repeated use.

Experiment 6

In order to observe the difference in the cleaning performance, a toner cartridge of a copier with toner attached was heated for one hour, and thus samples were prepared having the toner adhering thereto with increased adhesion force (medium adhesion force). The samples were cleaned by the dry cleaning apparatus 11*a*. Each sample was cleaned for one minute by using plural air nozzles SL-920A made by Silvent as an air blowing unit while maintaining a constant compressed air pressure of 0.2 MPa. The following three types of flexible bag-shaped cleaning media 1*a* were used.

(1) PET cone formed in the shape shown in FIG. 13 and having a wall thickness of 30 μm, a bottom diameter of 5 mm, and a length of 10 mm (2) PET four-sided pyramid formed in the shape shown in FIG. 18B and having a wall thickness of 30 μm, a bottom diameter of 5 mm, and a length of 10 mm (3) PET cone including folds on the side surface formed in the shape shown in FIG. 19 and having a wall thickness of 30 μm, a bottom diameter of 5 mm, and a length of 10 mm As comparative examples, cleaning was performed using the following six types of cleaning media:

(4) PET film having a thickness of 30 μm and sides of 5 mm by 5 mm (5) dry cleaning by air blow without using cleaning media (6) nylon cube of 2 mm on a side (7) nylon ball having a diameter of 2 mm

TABLE 5

| CLEANING MEDIUM EXPERIMENT 5 | SAMPLE 1st | 10th | 50th | 100th |
|---|---|---|---|---|
| (1) polyethylene cone, wall thickness: 30 μm, bottom diameter: 5 mm, length: 10 mm | ○ | ○ | ○ | ○ |
| (2) PET cone, wall thickness: 30 μm, bottom diameter: 5 mm, length: 10 mm | ○ | ○ | ○ | ○ |
| (3) nylon-cloth cone, wall thickness: 100 μm, bottom diameter: 5 mm, length: 10 mm | ○ | ○ | Δ frayed at the ends | X frayed entirely |
| (4) paper cone, wall thickness: 100 μm, outer diameter: 5 mm, length: 10 mm | ○ | ○ | Δ frayed at the ends | X frayed at the ends |
| (5) aluminum cone, wall thickness: 100 μm, bottom diameter: 5 mm, length: 10 mm | ○ | X curled and incapable of cleaning | — | — |

(8) urethane sponge ball having a diameter of 5 mm (9) non-flexible PET cone having a bottom diameter of 5 mm and a length of 10 mm Table 6 shows the cleaning results. In Table 6, the double circle mark indicates very clean as a result of toner cleaning; the single circle mark indicates fairly clean; the triangle mark indicates partly unclean; and the x mark indicates unclean.

TABLE 6

| CLEANING MEDIUM | TONER CLEANING RESULT | CLEANING UNIFORMITY | TONER REMAINING POINT DUE TO ATTACHED CLEANING MEDIA | AMOUNT OF CLEANING MEDIA ATTACHED TO TANK OR OBJECT |
|---|---|---|---|---|
| EXPERIMENT 6 | | | | |
| (1) PET cone, wall thickness: 30 μm, a bottom diameter: 5 mm, length: 10 mm | ○ | HIGH | NO | SMALL |
| (2) PET four-sided pyramid, wall thickness: 30 μm, bottom diameter: 5 mm, length: 10 mm | ◎ | HIGH | NO | SMALL |
| (3) PET cone including folds on the side surface, wall thickness: 30 μm, bottom diameter: 5 mm, length: 10 mm | ○ | HIGH | NO | NONE |
| COMPARATIVE EXAMPLES | | | | |
| (4) PET film, thickness: 30 μm, sides of 5 mm by 5 | ○ | HIGH | YES | LARGE |
| (5) dry cleaning by air blow only, no cleaning media | X | REMAIN UNCLEAN | NO | NONE |
| (6) nylon cube, 2 mm on a side | Δ | LOW | NO | SMALL |
| | Δ | LOW | NO | SMALL |
| (8) urethane sponge ball, diameter: 5 mm | Δ | LOW | NO | SMALL |
| (9) non-flexible PET cone, bottom diameter: 5 mm length: 10 mm | Δ | LOW | NO | SMALL |

As is understood from Table 6, the dry cleaning methods using the flexible bag-shaped cleaning media 1*a* exhibited better cleaning results than the related-art cleaning methods. The flexible bag-shaped cleaning media 1*a* having different shapes showed good results in different evaluation items. Therefore, the cleaning medium 1*a* having the shape that shows a good result in the item on which importance is placed may be selected so as to achieve the desired cleaning result. It is possible to use different shapes of the flexible bag-shaped cleaning media 1*a* at the same time or to use different shapes of the cleaning media 1*a* at different steps of the cleaning process.

In an embodiment of the present invention, a cleaning medium is configured to fly with an air current to collide with an object to be cleaned and remove extraneous substances attached to the object. The cleaning medium includes a flexible thin piece having an upright portion extending from a flat base portion.

According to an embodiment of the present invention, a cleaning medium M is configured to have a space where an air current can enter between the wall of a cleaning tank and the cleaning medium M attached thereto and between the surface of an object to be cleaned and the cleaning medium M attached thereto. The cleaning medium M is also configured to not enter greater than a predetermined depth in joints and seams in the cleaning tank or joints and seams in the object.

More specifically, the cleaning medium M is modified from a flexible thin cleaning medium to include one or more upright portions extending from a flat base portion so as to have a three dimensional shape.

With this configuration, in the cleaning process, even if the cleaning medium M is attached to the wall of the cleaning tank, there is a space where an air current can enter between the cleaning medium M and the wall of the cleaning tank.

Then, when an air current is generated to flow into the space and the force of the air current separating the cleaning medium M from the wall of the cleaning tank is greater than the electrostatic attraction force, the cleaning medium M is separated from the wall of the cleaning tank and thus can fly again.

Thus, it is possible to prevent a reduction in the amount of cleaning media M that contributes to cleaning, thereby maintaining a constant cleaning efficiency.

A corona discharging unit may be used in conjunction to provide ions on the surface of the cleaning medium M in contact with the wall of the cleaning tank so as to discharge the cleaning medium M, thereby enhancing the effect of making the cleaning medium M fly repeatedly.

In a process of removing the cleaning medium M from the cleaned object, even if the cleaning medium M is attached to the object, there is a space where an air current can enter between the cleaning medium M and the object.

Then, when an air current is generated to flow into the space and the force of the air current separating the cleaning medium M from object is greater than the electrostatic attraction force, the cleaning medium M is separated from the object and thus can easily be removed.

A corona discharging unit may be used in conjunction to provide ions on the surface of the cleaning medium M in contact with the object so as to discharge the cleaning medium M, thereby enhancing the effect of removing the cleaning medium M.

Further, even if there is a gap having the substantially same width as the width of the thin cleaning medium M at a joint or a seam in the object or a joint or a seam in the cleaning tank, the bent portion (upright portion) of the cleaning medium M prevents complete insertion of the cleaning medium M into the gap. The air current hits a part of the cleaning medium M exposed outside the gap to make the cleaning medium M fly again, thereby preventing accumulation of the cleaning media M.

Thus, in the cleaning process it is possible to prevent a reduction in the amount of the cleaning media M that contribute to cleaning and to allow new contact of the cleaning media M with the object due to prevention of accumulation of the cleaning media M in gaps in the object, thereby maintaining constant cleaning efficiency.

Further, in the process of removing the cleaning media M from the cleaned object, when an air current is generated to flow into the space to hit a part of the cleaning medium M exposed outside the gap, the cleaning medium M flies again and thus can easily be removed.

The following describes the shape of the cleaning medium M.

Figure 53A:
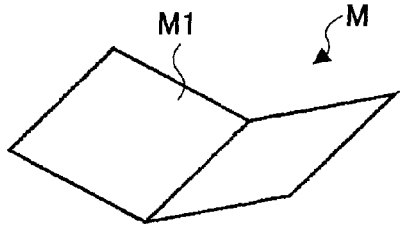
FIGS. 53A through 53C-2 are diagrams showing examples of a cleaning medium according to an embodiment of the present invention.

In an embodiment, a cleaning medium M includes, as one or more bent portions M1, one or more upright portions formed by bending a flat base portion as shown in FIG. 53A, for example.

The position and number of the bent portions M1 are not especially limited as long as it is possible to form a space where an air current can enter between the cleaning medium M and the wall of the cleaning tank or the surface of the object, and as long as the height of the three dimensional shape defined by the bent portion M1 is greater than the widths of the gaps that have been known from use of unprocessed thin cleaning media.

Figures 1, 53B:
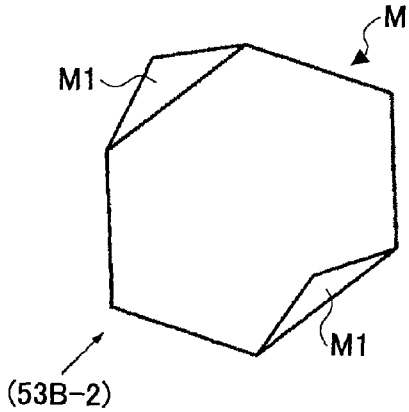
Figures 2, 53B:
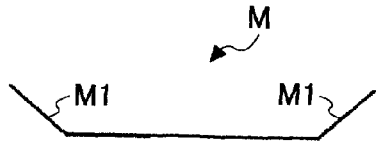
Figures 1, 53C:
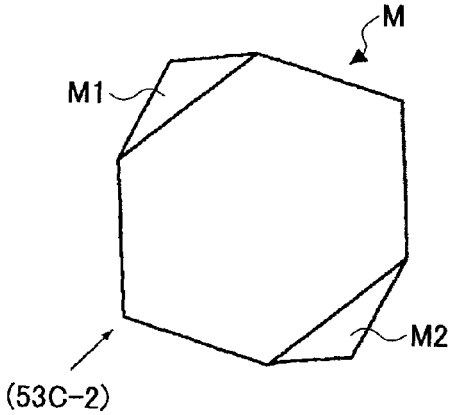
Figures 2, 53C:
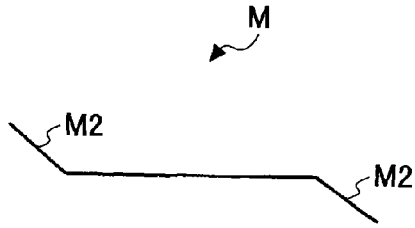
Figures 1, 54A:
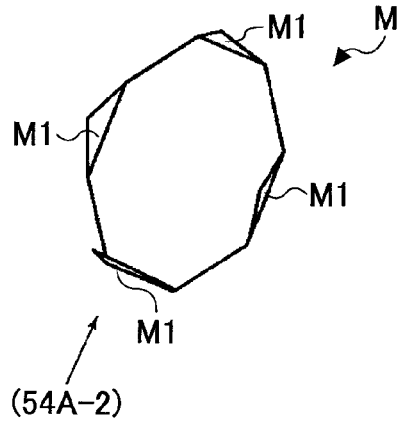
Figures 2, 54A:
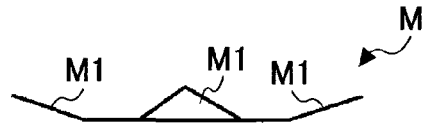
Figures 1, 54B:
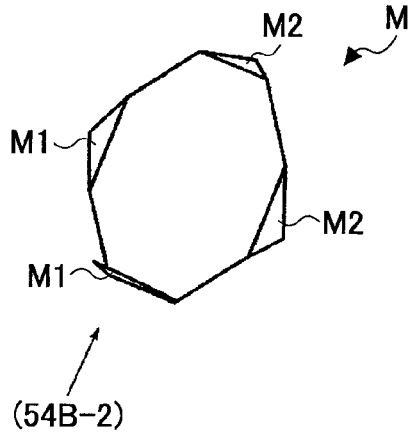
Figures 2, 54B:
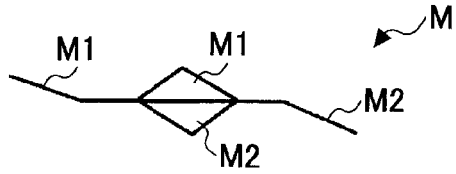
Figure 55:
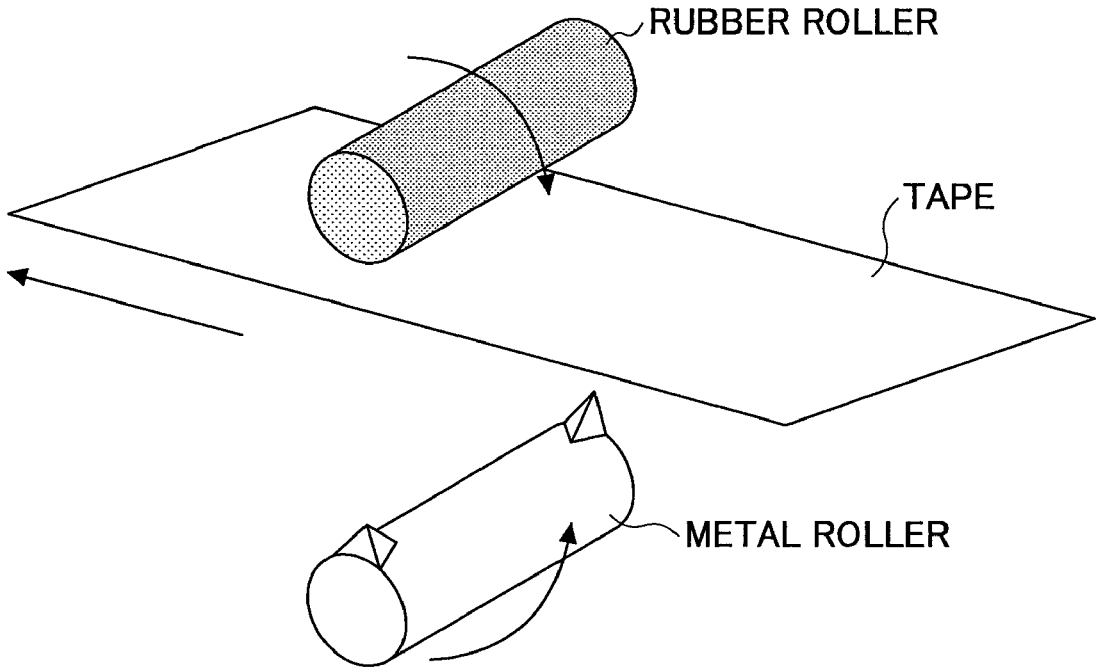
FIG. 55 is a diagram for explaining a method of producing the cleaning medium of FIGS. 54A-1 and 54A-2.
Figure 56A:
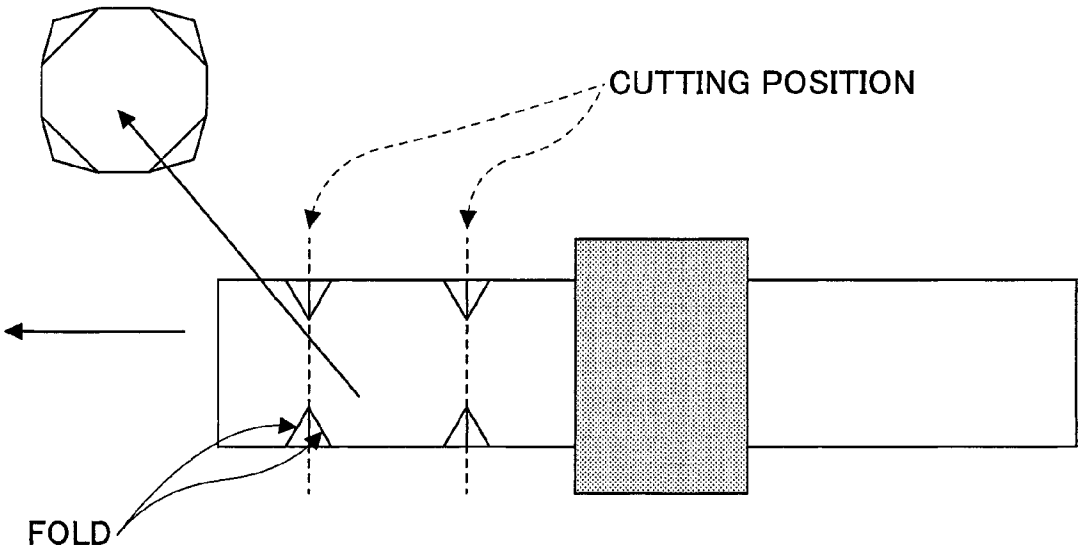
FIGS. 56A and 56B are diagrams for explaining the method of producing the cleaning medium of FIGS. 54A-1 and 54A-2.
Figure 56B:
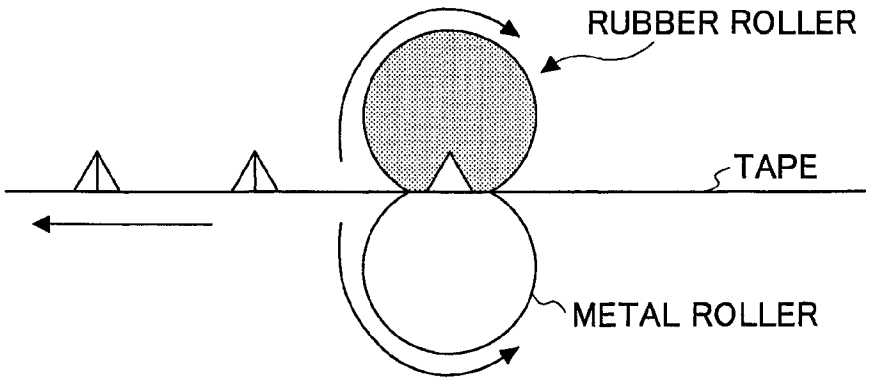
Figure 57:
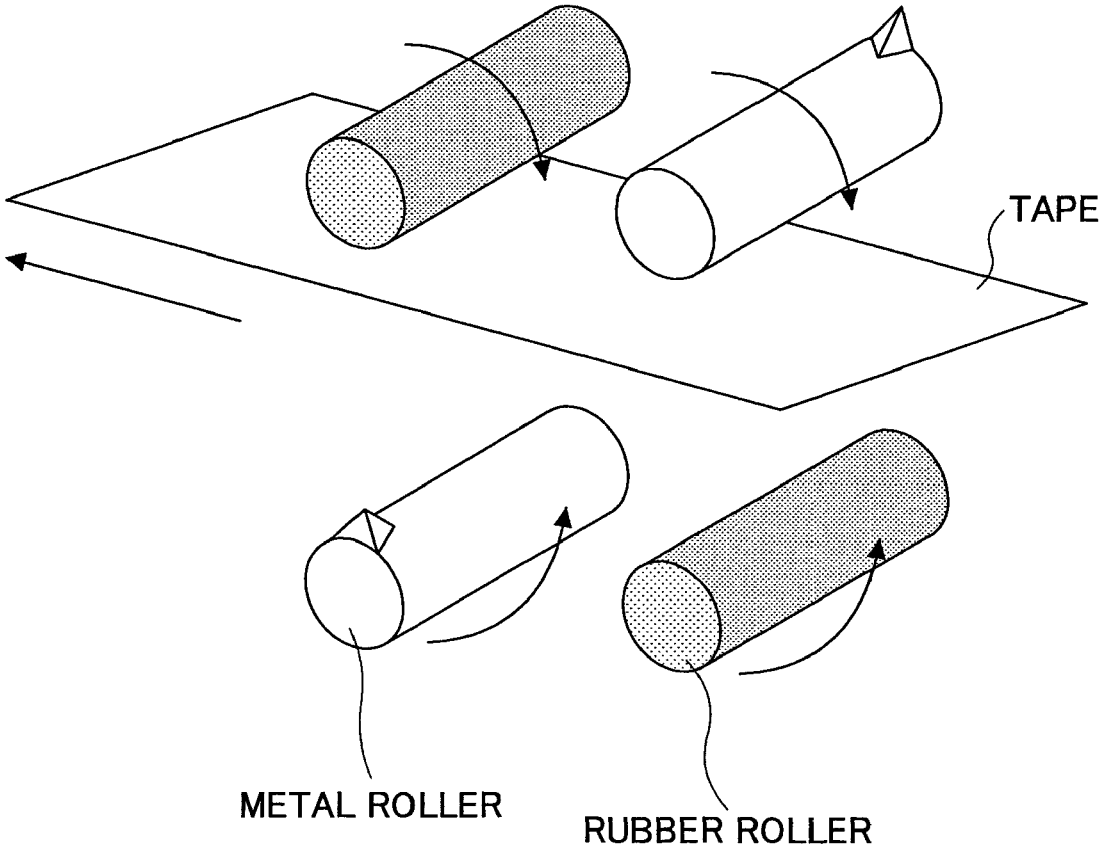
FIG. 57 is a diagram for explaining a method of producing the cleaning medium of FIGS. 54B-1 and 54B-2.
Figure 58A:
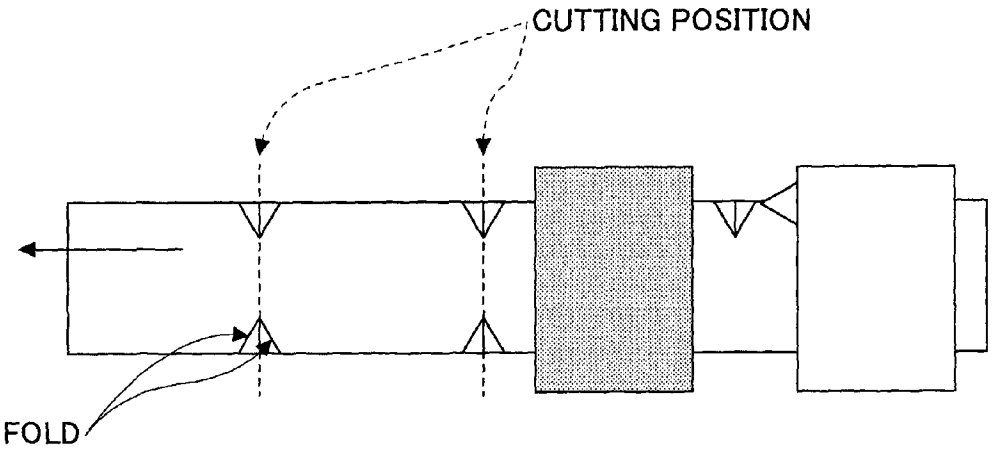
FIGS. 58A and 58B are diagrams for explaining the method of producing the cleaning medium of FIGS. 54B-1 and 54B-2.
Figure 58B:
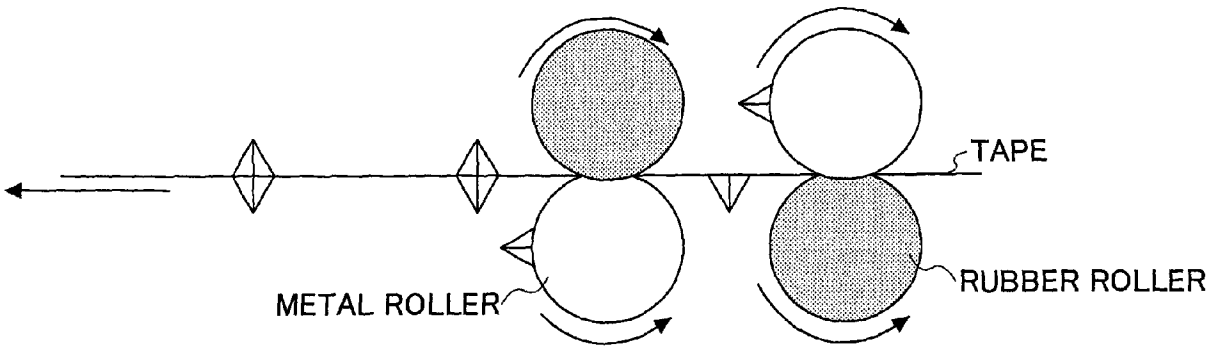

An example of a cleaning medium M shown in FIG. 53A has a so-called half-fold style. An example of a cleaning medium M shown in FIGS. 53B-1 and 53B-2 is formed by bending two opposing corners of a square in the same direction to have a hexagonal base and bent portions M1. An example of a cleaning medium M shown in FIGS. 53C-1 and 53C-2 is formed by bending two opposing corners of a square in opposite directions to have a hexagonal base portion and bent portions M1 and M2 bent in different directions. FIG. 53B-2 and FIG. 53C-2 are cut-away side views as viewed from arrows 53B-2 and 53C-2 of FIGS. 53B-1 and 53C-1, respectively.

In the case of the cleaning medium having the bent portions M1 bent in the same direction, the space is formed between the base portion and the bent portions M1. In the case of the cleaning medium having the bent portions M1 and M2 bent in the opposite directions, spaces are formed between the base portion M1 and the surface of the base portion and between the base portion M2 and the opposite surface of the base portion. Although the cleaning media N shown in FIGS. 53B-1 and 53B-2 and FIGS. 53C-1 and 53C-2 have the bent portions at the opposing corners, bent portions may be formed by bending adjacent corners in the same direction or in opposite directions as long as the bent portions have sizes that do not prevent entry of air current into the space(s).

Cleaning media M shown in FIGS. 54A-1 and 54A-2 and FIGS. 54B-1 and 54B-2 include polygonal base portions with an increased number of bent portions. The cleaning medium M of FIGS. 54A-1 and 54A-2 includes plural pairs of opposing corners bent in the same direction. The cleaning medium M of FIGS. 54B-1 and 54B-2 includes plural pairs of opposing corners wherein each pair of the opposing corners are bent in opposite directions.

As shown in FIGS. 55, 56A and 56B and FIGS. 57, 58A and 58B, the cleaning medium M may be produced by passing a tape between molding rollers to make folds and then cutting the tape by a tape cutter or the like. This production method is only an example, and any production method may be used that can produce the cleaning medium M having bent portion(s).

With this configuration, in the cleaning process, even if the cleaning medium M is attached to the wall of the cleaning tank, there is a space where an air current can enter between the cleaning medium M and the wall of the cleaning tank. Then, when an air current is generated to flow into the space and the force of the air current separating the cleaning medium M from the wall of the cleaning tank is greater than the electrostatic attraction force, the cleaning medium M is separated from the wall of the cleaning tank and thus can fly again.

Thus, it is possible to prevent a reduction in the amount of cleaning media M that contributes to cleaning, thereby maintaining a constant cleaning efficiency.

A corona discharging unit may be used in conjunction to provide ions on the surface of the cleaning medium M in contact with the wall of the cleaning tank so as to discharge the cleaning medium M, thereby enhancing the effect of making the cleaning medium M fly repeatedly.

In a process of removing the cleaning medium M from the cleaned object, even if the cleaning medium M is attached to the object, there is a space where an air current can enter between the cleaning medium M and the object.

Then, when an air current is generated to flow into the space and the force of the air current separating the cleaning medium M from object is greater than the electrostatic attraction force, the cleaning medium M is separated from the object and thus can easily be removed.

A corona discharging unit cleaning unit may be used in conjunction to provide ions on the surface of the cleaning medium M in contact with the object so as to discharge the cleaning medium M, thereby enhancing the cleaning efficiency.

Figure 59A:
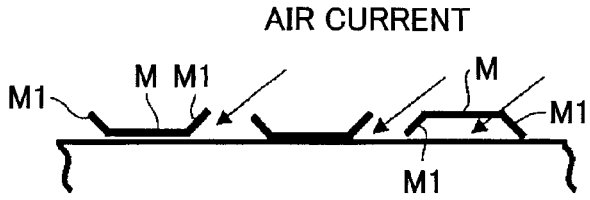
FIGS. 59A through 59C are diagrams for explaining the effect of a cleaning medium according to an embodiment of the present invention.
Figure 59C:
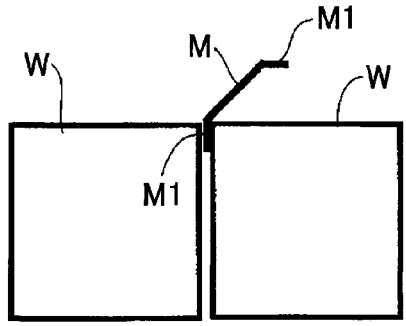
Figure 59B:
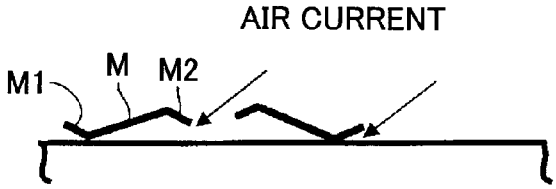

In this embodiment, in the case of the surface shape including one or more bent portions M1 (and M2) as the upright portions, the provision of plural bent portions M1 (and M2) as shown in FIGS. 54A-1 and 54A-2 and FIGS. 54B-1 and 54B-2 allows air current from any direction to hit any of the bent portions M1 (and M2) as shown in FIGS. 59A and 59B, ensuring the flight of the cleaning medium M.

Further, as shown in FIG. 59C, even if there is a gap having the substantially same width as the width of the thin cleaning medium M at a joint or a seam in the object W or a joint or a seam in the cleaning tank, the bent portion (upright portion) M1 or M2 of the cleaning medium M prevents complete insertion of the cleaning medium M into the gap. The air current hits a part of the cleaning medium M exposed outside the gap to make the cleaning medium M fly again, thereby preventing accumulation of the cleaning media M.

Thus, in the cleaning process it is possible to prevent a reduction in the amount of the cleaning media M that contribute to cleaning and to allow new contact of the cleaning media M with the object due to prevention of accumulation of the cleaning media M in gaps in the object, thereby maintaining constant cleaning efficiency.

Further, in the process of removing the cleaning media M from the cleaned object, when an air current is generated to flow into the space to hit a part of the cleaning medium M exposed outside the gap, the cleaning medium M flies again and thus can easily be removed.

Figure 60:
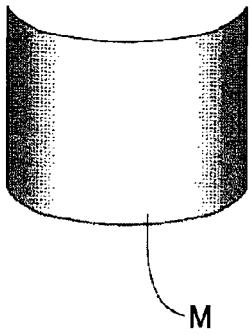
FIG. 60 is a schematic diagram showing a modified example of a cleaning medium according to an embodiment of the present invention.

In an embodiment, a cleaning medium M including an upright portion has a curved shaped as shown in FIG. 60.

The curvature is not especially limited as long as it is possible to form a space where an air current can enter between the cleaning medium M and the wall of the cleaning tank or the surface of the object, and as long as the height of the three dimensional shape defined by the curved portion is greater than the widths of the gaps that have been known from use of unprocessed thin cleaning media.

Figure 61:
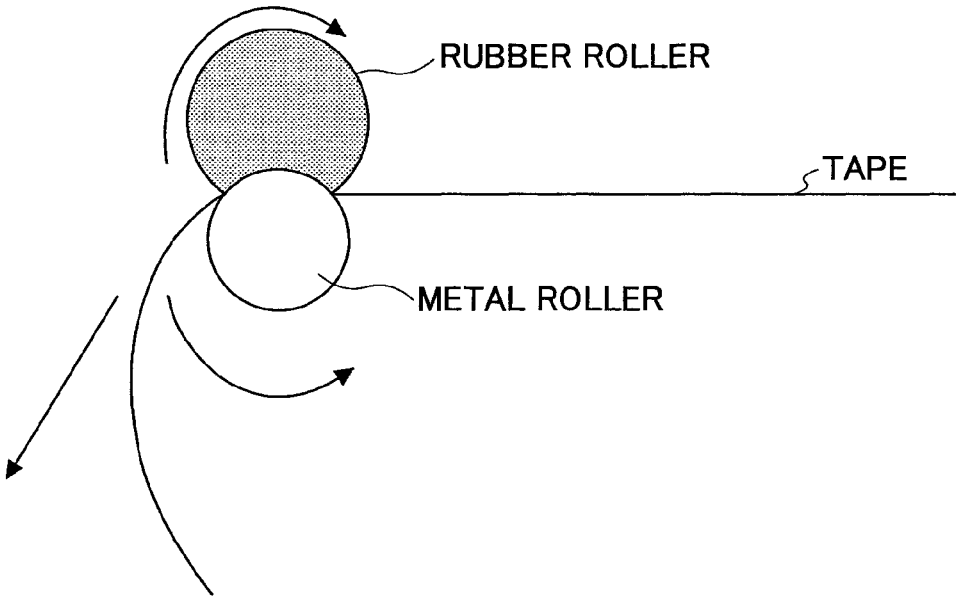
FIG. 61 is a diagram for explaining a method of producing the cleaning medium of FIG.

As shown in FIG. 61, the cleaning medium M may be produced by passing a tape between molding rollers to curve the tape and then cutting the tape by an electronic tape cutter. A desired curvature may be obtained by using a molding roller having a diameter corresponding to the desired curvature.

This production method is only an example, and any production method may be used that can produce the cleaning medium M having a curved shape. For example, the cleaning medium M may be produced by the following methods:

- cutting a tube in the circumferential direction and the axial direction
- winding a tape around a cylindrical core to make the tape curved, and then cutting the tape.
- applying friction to one surface of a tape to make the tape stretched and warped, and then cutting the tape.
- applying heat to one surface of a tape to make the tape stretched and warped due to thermal expansion, and then cutting the tape.
- applying heat to a tape including layers of materials of different thermal expansion to make the tape warped due to the difference in thermal expansion, and then cutting the tape.

With this configuration, in the cleaning process, even if the cleaning medium M is attached to the wall of the cleaning tank, there is a space where an air current can enter between the cleaning medium M and the wall of the cleaning tank.

Then, when an air current is generated to flow into the space and the force of the air current separating the cleaning medium M from the wall of the cleaning tank is greater than the electrostatic attraction force, the cleaning medium M is separated from the wall of the cleaning tank and thus can fly again.

Thus, it is possible to prevent a reduction in the amount of cleaning media M that contributes to cleaning, thereby maintaining a constant cleaning efficiency.

A corona discharging unit may be used in conjunction to provide ions on the surface of the cleaning medium M in contact with the wall of the cleaning tank so as to discharge the cleaning medium M, thereby enhancing the effect of making the cleaning medium M fly repeatedly.

In a process of removing the cleaning medium M from the cleaned object, even if the cleaning medium M is attached to the object, there is a space where an air current can enter between the cleaning medium M and the object due to the above-described configuration of the cleaning medium M.

Then, when an air current is generated to flow into the space and the force of the air current separating the cleaning medium M from object is greater than the electrostatic attraction force, the cleaning medium N is separated from the object and thus can easily be removed.

Figure 62A:
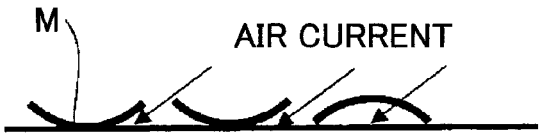
FIGS. 62A and 62B are diagrams for explaining the effect of the cleaning medium of FIG. 60.

In the case of the curved surface shape, when the cleaning medium M is in line contact with the object to be cleaned or the wall of the cleaning tank when attached thereto as shown in FIG. 62A, the air current can flow onto the greater part of the surface in line contact with the object or the wall of the cleaning tank and thus can make the cleaning medium M fly easily. It should be noted that the cleaning medium can be in total contact with the object due to its bending motion upon collision during cleaning.

Figure 62B:
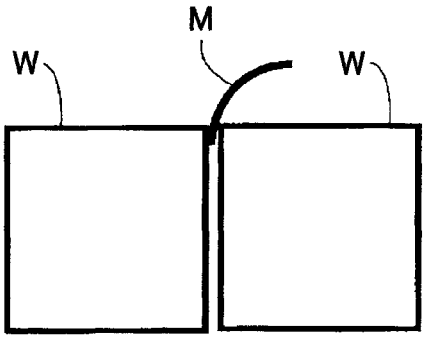

Further, as shown in FIG. 62B, even if there is a gap having the substantially same width as the width of the thin cleaning medium M at a joint or a seam in the object or a joint or a seam in the cleaning tank, the curved portion of the cleaning medium M prevents complete insertion of the cleaning medium M into the gap. The air current hits a part of the cleaning medium M exposed outside the gap to make the cleaning medium N fly again, thereby preventing accumulation of the cleaning media M.

Thus, in the cleaning process it is possible to prevent a reduction in the amount of the cleaning media M that contributes to cleaning and to allow new contact of the cleaning media M with the object due to prevention of accumulation of the cleaning media M in the gap in the object, thereby maintaining constant cleaning efficiency.

Further, in the process of removing the cleaning media M from the cleaned object, when an air current is generated to flow into the space to hit a part of the cleaning medium M exposed outside the gap, the cleaning medium M flies again and thus can easily be removed.

In an embodiment, a cleaning medium M includes raised and recessed portions on both surfaces as shown in FIGS. 63A through 63F (wherein the raised portions in different directions are denoted by different reference numerals, P1 and P2).

The positions and the number of the raised and recessed portions P1 and P2 are not especially limited as long as it is possible to form a space where an air current can enter between the cleaning medium M and the wall of the cleaning tank or the surface of the object, and as long as the height of the three dimensional shape defined by the raised and recessed portions is greater than the widths of the gaps that have been known from use of unprocessed thin cleaning media.

Figure 64:
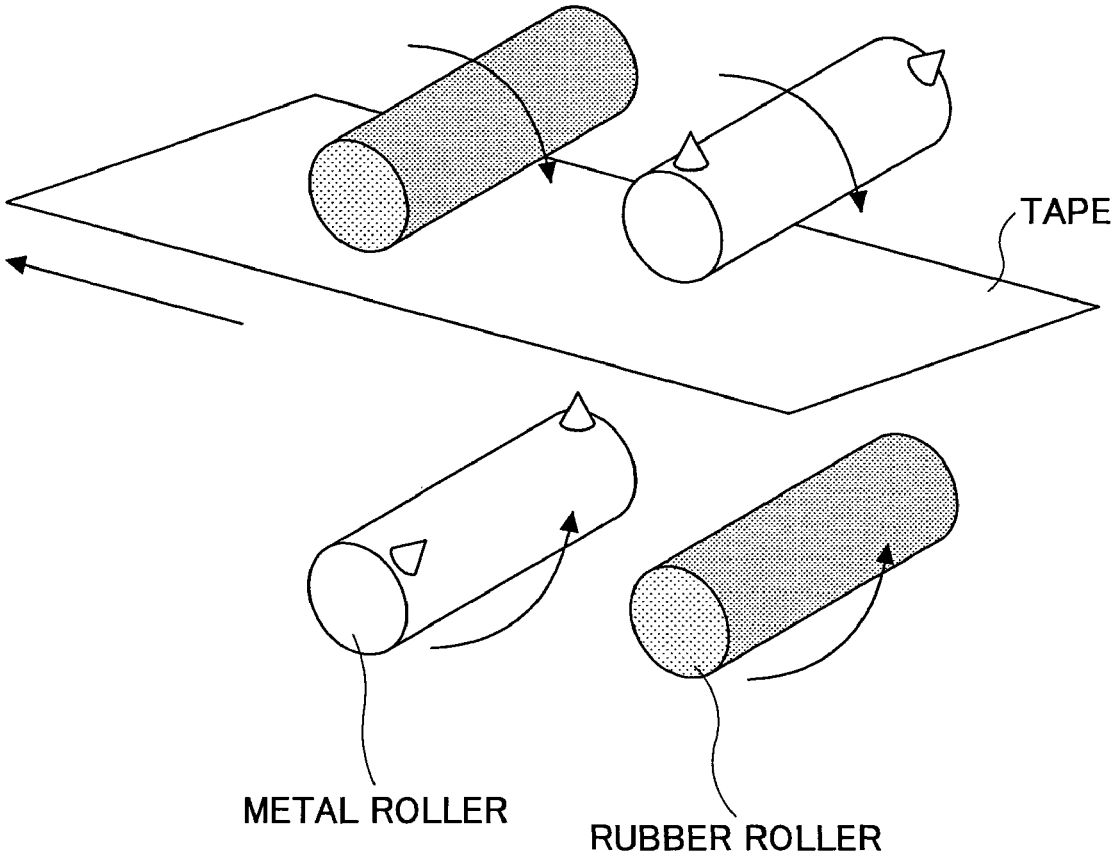
FIG. 64 is a diagram for explaining a method of producing the cleaning media of FIG. 63C.
Figure 65A:
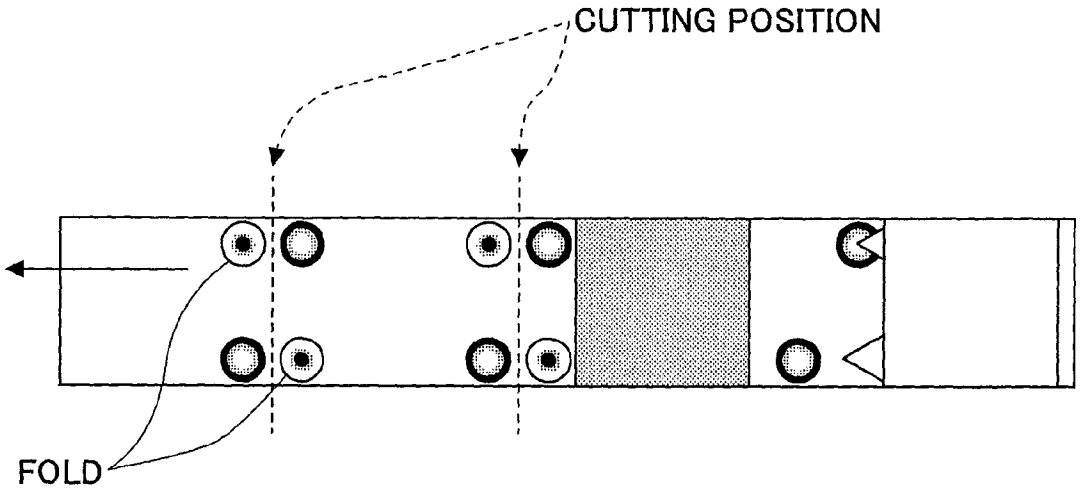
FIGS. 65A and 65B are diagrams for explaining the method of producing the cleaning medium of FIG. 63C.
Figure 65B:
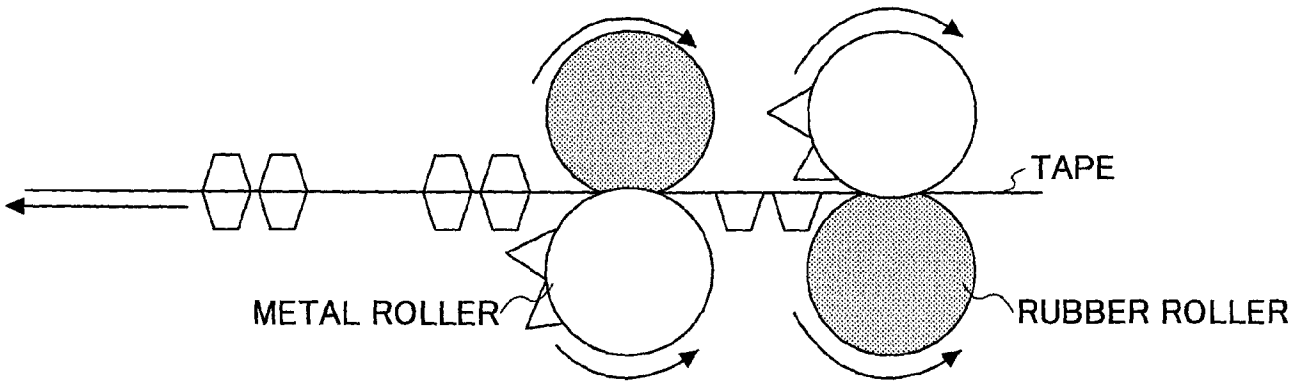

As shown in FIGS. 64, 65A and 65B, the cleaning medium M may be produced by passing a tape between molding rollers to form raised and recessed portions on both surfaces of the tape or punch the tape, and then cutting the tape by a tape cutter.

This production method is only an example, and any production method may be used that can produce the cleaning medium M including the raised and recessed portions on both surfaces. For example, the cleaning medium M may be produced by depositing droplets of an adhesive agent in some positions to form raised portions and then cutting the tape by a tape cutter.

With this configuration, in the cleaning process, even if the cleaning medium M is attached to the wall of the cleaning tank, there is a space where an air current can enter between the cleaning medium M and the wall of the cleaning tank.

Then, when an air current is generated to flow into the space and the force of the air current separating the cleaning medium M from the wall of the cleaning tank is greater than the electrostatic attraction force, the cleaning medium M is separated from the wall of the cleaning tank and thus can fly again.

Thus, it is possible to prevent a reduction in the amount of cleaning media M that contributes to cleaning, thereby maintaining a constant cleaning efficiency.

A corona discharging unit may be used in conjunction to provide ions on the surface of the cleaning medium M in contact with the wall of the cleaning tank so as to discharge the cleaning medium M, thereby enhancing the effect of making the cleaning medium M fly repeatedly.

In a process of removing the cleaning medium M from the cleaned object, even if the cleaning medium M is attached to the object, there is a space where an air current can enter between the cleaning medium M and the object.

Then, when an air current is generated to flow into the space and the force of the air current separating the cleaning medium M from object is greater than the electrostatic attraction force, the cleaning medium M is separated from the object and thus can easily be removed.

A corona discharging unit cleaning unit may be used in conjunction to provide ions on the surface of the cleaning medium M in contact with the object so as to discharge the cleaning medium M, thereby enhancing the cleaning efficiency.

Figures 63A, 63B, 63C, 63D, 63E, 63F:
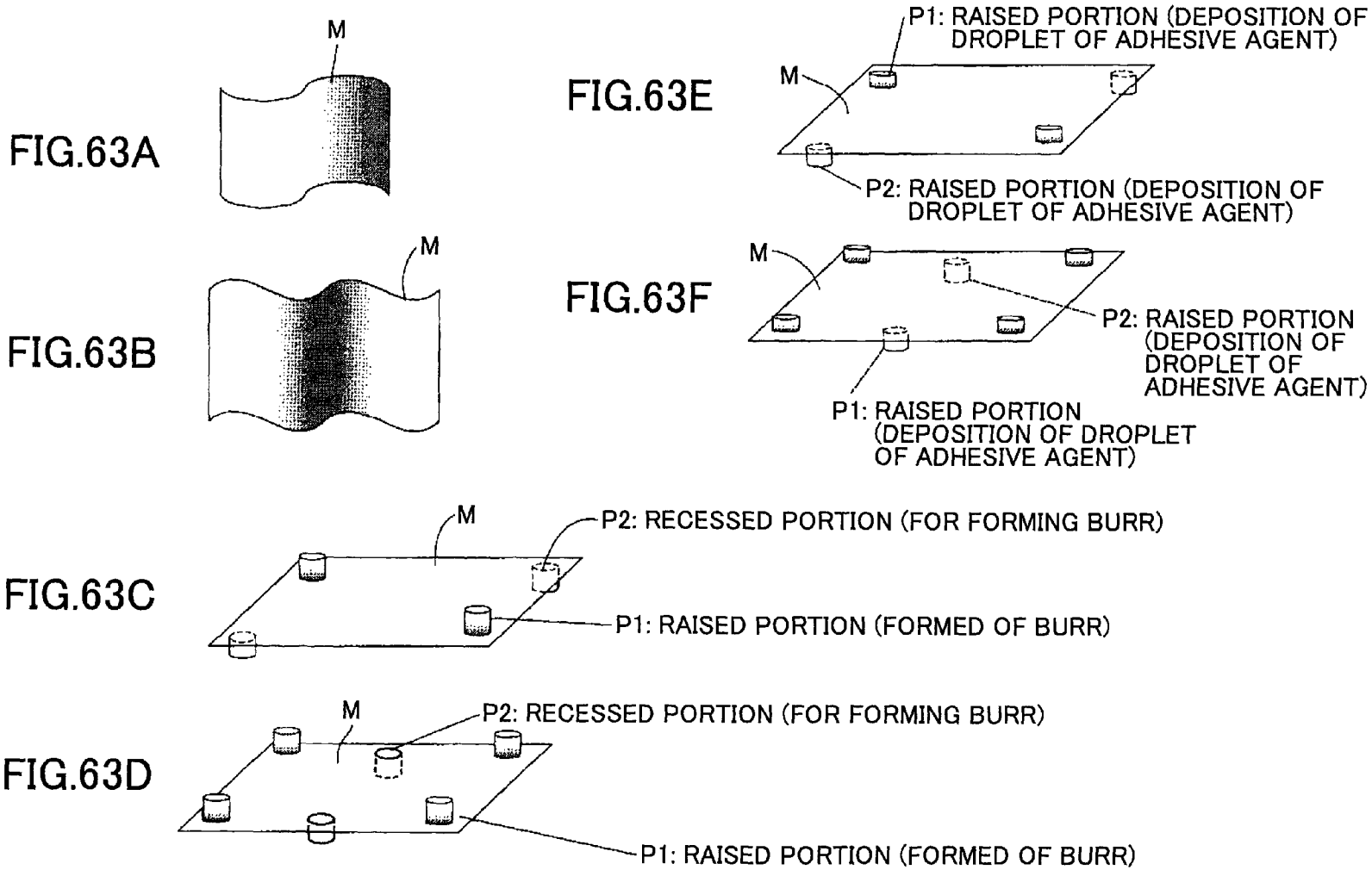
FIGS. 63A through 63F are diagrams showing still other examples of a cleaning medium according to an embodiment of the present invention.
Figure 66B:
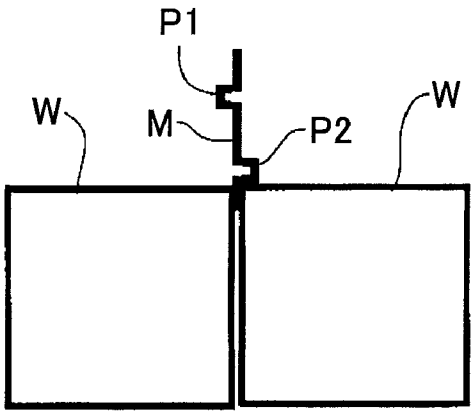
FIGS. 66A and 66B are diagrams for explaining the effect of the cleaning medium of FIGS. 63A through 63F.
Figure 66A:
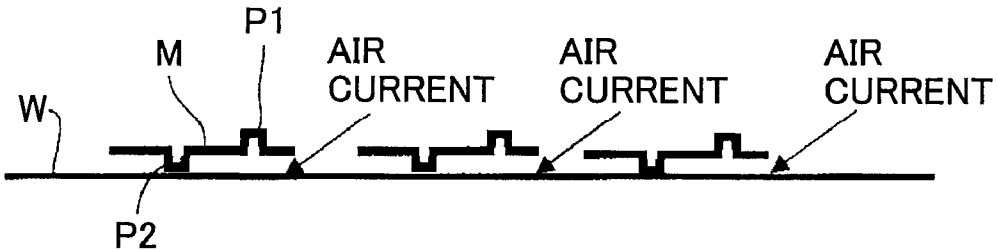
Figure 67A:
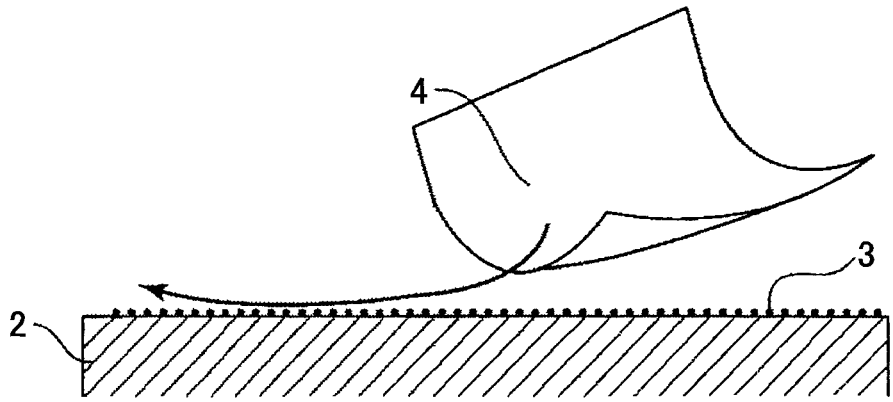
FIGS. 67A and 67B are diagrams for explaining how a cleaning medium removes extraneous substances adhering to an object to be cleaned.
Figure 67B:
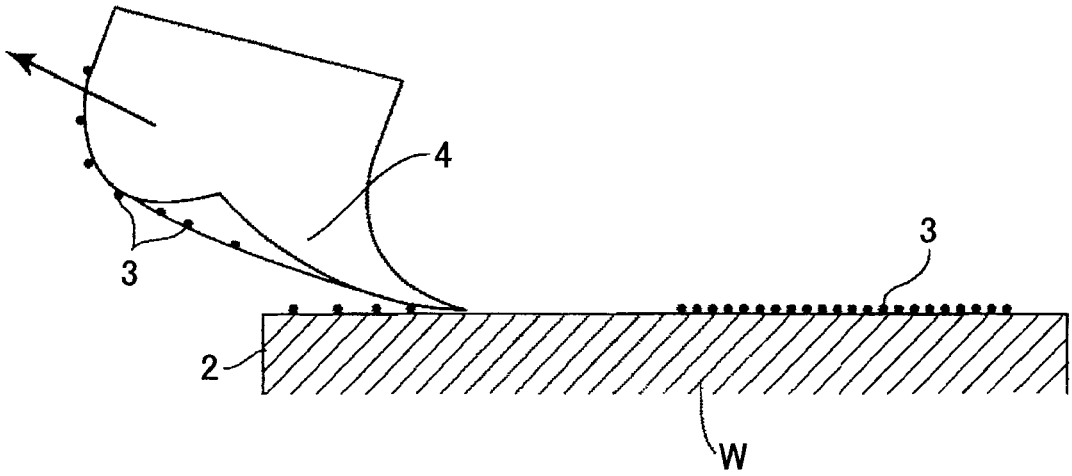

In the case of the surface shape including the raised and recessed portions on both surfaces, the cleaning medium M as shown for example in FIG. 63C is in point contact with the object to be cleaned or the wall of the cleaning tank when attached thereto as shown in FIG. 66A, the air current can flow onto the greater part of the surface in point contact with the object or the wall of the cleaning tank and thus can make the cleaning medium M fly easily.

It should be noted that the cleaning medium can be in surface contact with the object due to its bending motion upon collision during cleaning.

Further, as shown in FIG. 66B, even if there is a gap having the substantially same width as the width of the thin cleaning medium M at a joint or a seam in the object or a joint or a seam in the cleaning tank, the raised or recessed portion of the cleaning medium M prevents complete insertion of the cleaning medium M into the gap. The air current hits a part of the cleaning medium M exposed outside the gap to make the cleaning medium M fly again, thereby preventing accumulation of the cleaning media M.

Thus, in the cleaning process it is possible to prevent a reduction in the amount of the cleaning media M that contribute to cleaning and to allow new contact of the cleaning media M with the object due to prevention of accumulation of the cleaning media M in the gap in the object, thereby maintaining constant cleaning efficiency.

Further, in the process of removing the cleaning media M from the cleaned object, when an air current is generated to flow into the space to hit a part of the cleaning medium M exposed outside the gap, the cleaning medium M flies again and thus can easily be removed.

The cleaning medium M may preferably be made of or include an antistatic material.

To achieve effective antistatic performances the surface resistance of the cleaning medium M may preferably be $10^{10}$ Ω/sq. or less.

In the case where the cleaning medium M is made of metal, the cleaning medium M itself is antistatic. In the case where the cleaning medium M is made of resin, any of the above-described antistatic techniques used may be used as in the case of the cleaning media 1 and 1*a*.

The use of this cleaning medium M can prevent increase of charges due to friction and can reduce the electrostatic effect of making the cleaning medium M be attracted to the wall of the cleaning tank or the object to be cleaned.

Thus, the cleaning medium M can be separated from the wall of the cleaning tank or the object with reduced air current. This allows downsizing of the air current generation equipment and leads to reduction of energy consumption. A corona discharging unit may be used in conjunction to improve the effect of making the cleaning medium M fly repeatedly.

The above described dry cleaning apparatuses may use the cleaning medium M as well as the cleaning media 1 and 1*a*.

Experiment 7

The following shows experimental results based on the above-described embodiments.

First, for the purpose of obtaining the experimental results, in order to observe the effects of the adhesion force of the extraneous substances (toner) to be removed by dry cleaning, a toner cartridge of a copier with toner attached was heated for one hour, and thus three types of samples were prepared having the toner adhering thereto with different adhesion forces (low adhesion force, medium adhesion force, and high adhesion force). Each sample was cleaned for two minutes by using plural air nozzles SL-920A made by Silvent as an air blowing unit while maintaining a constant compressed air pressure of 0.2 MPa.

The following four types of flexible thin cleaning media as described in the above embodiments were used.

(1) polyethylene film having a thickness of 30 μm and sides of 5 mm by 5 mm (2) PET (polyethylene terephthalate) film having a thickness of 30 μm and sides of 5 mm by 5 mm (3) polyethylene film having a thickness of 100 μm and sides of 5 mm by 5 mm (4) PET film having a thickness of 100 μm and sides of 5 mm by 5 mm As comparative examples, performed were:

(5) dry cleaning by air blow without using cleaning media, and dry cleaning using the following types of granular cleaning media:

(6) nylon cube of 2 mm on a side (7) nylon ball having a diameter of 2 mm (8) urethane sponge ball having a diameter of 5 mm (9) non-flexible PET circular plate having a thickness of 2 mm and a diameter of 5 mm Table 7 shows the experimental results.

TABLE 7

| CLEANING MEDIUM | TONER ADHESION FORCE HIGH | TONER ADHESION FORCE MEDIUM | TONER ADHESION FORCE LOW | DAMAGE TO OBJECT | CLEANING UNIFORMITY (ADHESION FORCE MEDIUM) |
|---|---|---|---|---|---|
| EXPERIMENT 7 | | | | | |
| (1) polyethylene film, thickness: 30 μm, sides of 5 mm by 5 mm | ◎ | ◎ | ○ | NO | HIGH |
| (2) PET film, thickness: 30 μm, sides of 5 mm by 5 | ◎ | ○ | ○ | NO | HIGH |
| (3) polyethylene film, thickness: 100 μm, sides of 5 mm by 5 mm | ◎ | ○ | ○ | NO | HIGH |
| (4) PET film, thickness: 100 μm, sides of 5 mm by 5 | ◎ | ○ | Δ | NO | HIGH |

TABLE 7-continued

| CLEANING MEDIUM | TONER ADHESION FORCE HIGH | MEDIUM | LOW | DAMAGE TO OBJECT | CLEANING UNIFORMITY (ADHESION FORCE MEDIUM) |
|---|---|---|---|---|---|
| COMPARATIVE EXAMPLES | | | | | |
| (5) dry cleaning by air blow only, no cleaning media | X | X | X | NO | REMAIN UNCLEAN |
| (6) nylon cube, 2 mm on a side | ○ | Δ | Δ | YES | LOW |
| (7) nylon ball, diameter: 2 mm | ○ | Δ | Δ | YES | LOW |
| (8) urethane sponge ball, diameter 5 mm | Δ | Δ | X | NO | LOW |
| (9) non-flexible PET circular plate, thickness: 2 mm, diameter: 5 mm | ○ | Δ | Δ | YES | LOW |

As is understood from Table 7, the dry cleaning methods using the flexible thin cleaning media of the embodiments of the present invention exhibited better cleaning results than the related-art dry cleaning methods using granular cleaning media.

Among the flexible thin cleaning media 1, the higher the flexibility of the film, the better the cleaning result.

Experiment 8

The following shows experimental results of dry cleaning using the cleaning media repeatedly.

A toner cartridge of a copier with toner attached was heated for one hour, and thus samples were prepared having the toner adhering thereto with medium adhesion force. Each sample was cleaned for two minutes by using plural air nozzles SL-920A made by Silvent as an air blowing unit while maintaining a constant compressed air pressure of 0.2 MPa. The same cleaning media were continuously used without being replaced. Thus transitions of the cleaning results along with the increase of number of the cleaned samples were compared.

The following four types of flexible thin cleaning media as described in the above embodiments were used.

(1) polyethylene film having a thickness of 100 μm and sides of 5 mm by 5 mm (2) PET film having a thickness of 100 μm and sides of 5 mm by 5 mm (3) a piece of nylon cloth having a thickness of 100 μm and sides of 5 mm by 5 mm (4) a piece of paper cloth having a thickness of 100 μm and sides of 5 mm by 5 mm (5) a piece of aluminum foil having a thickness of 100 μm and sides of 5 mm by 5 mm Table 8 shows the experimental results.

TABLE 8

| CLEANING MEDIUM EXPERIMENT 8 | SAMPLE 1st | 10th | 50th | 100th |
|---|---|---|---|---|
| (1) polyethylene film, thickness: 100 μm, sides of 5 mm by 5 mm | ○ | ○ | ○ | ○ |
| (2) PET film, thickness: 100 μm, sides of 5 mm by 5 mm | ○ | ○ | ○ | ○ |
| (3) a piece of nylon cloth, thickness: 100 μm, sides of 5 mm by 5 mm | ○ | ○ | Δ frayed at the ends | X frayed at the ends |
| (4) a piece of paper cloth, thickness: 100 μm, sides of 5 mm by 5 mm | ○ | ○ | Δ frayed at the ends | X frayed at the ends |
| (5) a piece of aluminum foil, thickness: 100 μm, sides of 5 mm by 5 mm | ○ | X curled and incapable of cleaning | — | — |

As is understood from Table 8, the cleaning media made of resin materials exhibited better cleaning results in the case of repeated use.

In the above embodiments, the extraneous substances to be removed from the object to be cleaned was dry toner (average diameter in a range about 5 through 10 μm), which is used in electrophotographic apparatuses such as copiers and a laser printers. This is not a limiting example, and the present invention is applicable to cleaning for removing particles and dust in general attached to the object. The type (sizer shape, material, etc.) of the cleaning medium and the speed and volume of the air current are selected as appropriate in accordance with the characteristics of the object to be cleaned and the extraneous substances.

Experiment 9

(An Experiment Showing the Effects of the Embodiment of the Present Invention)

Table 9 shows an example of cleaning results.

In order to observe the difference in the cleaning performance, a toner cartridge of a copier with toner attached was heated for one hour, and thus samples were prepared having the toner adhering thereto with increased adhesion force (medium adhesion force). The cleaning apparatus having the configuration shown in FIG. 42 was used.

Each sample was cleaned for one minute by using plural air nozzles SL-920A made by Silvent as an air blowing unit while maintaining a constant compressed air pressure of 0.2 MPa.

The following flexible thin cleaning media M were used.

(1) PET film including bent portions as shown in FIGS. 53C-1 and 53C-2 and having a thickness of 30 μm and sides of 5 mm by 5 mm (2) PET film having a curved surface as shown in FIG. 60 and having a thickness of 30 μm and sides of 5 mm by 5 mm (3) PET film including raised and recessed portions on both surfaces as shown in FIG. 63C and having a thickness of 30 μm and sides of 5 mm by 5 mm As a comparative example, cleaning was performed using the following cleaning medium:

(4) PET film with no bent portions, having a thickness of 30 μm and sides of 5 mm by 5 mm As other comparative examples, performed were:

(5) dry cleaning by air blow without using cleaning media, and dry cleaning using the following types of granular cleaning media in place of the thin cleaning media M:

(6) nylon cube of 2 mm on a side (7) nylon ball having a diameter of 2 mm (8) urethane sponge ball having a diameter of 5 mm The following is an explanation of symbols used in Table 9.

TABLE 9

| CLEANING MEDIUM | TONER CLEANING RESULT | CLEANING UNIFORMITY | TONER REMAINING POINT DUE TO ATTACHED CLEANING MEDIA | AMOUNT OF CLEANING MEDIA ATTACHED TO TANK OR OBJECT | AMOUNT OF CLEANING MEDIA STUCK IN GAP IN TANK OR OBJECT |
|---|---|---|---|---|---|
| EXPERIMENT 9 | | | | | |
| (1) PET film including bent portions, thickness: 30 μm, sides of 5 mm by 5 mm | ○ | HIGH | NO | SMALL | SMALL |
| (2) PET film having a curved surface, thickness: 30 μm, sides of 5 mm by 5 mm | ◎ | HIGH | NO | SMALL | SMALL |
| (3) PET film including raised and recessed portions on both surfaces, thickness 30 μm, sides of 5 mm by 5 mm | ○ | HIGH | NO | NONE | NONE |
| COMPARATIVE EXAMPLES | | | | | |
| (4) PET film with no bent portions,, thickness: 30 μm, sides of 5 mm by 5 mm | Δ | HIGH | YES | LARGE | LARGE |

As is understood from Table 9, the dry cleaning methods using the thin cleaning media modified from the thin cleaning media to have three-dimensional shapes exhibited better cleaning results than the related-art cleaning methods.

The flexible thin cleaning media having different three-dimensional shapes showed good results in different evaluation items. Therefore, the cleaning medium having the shape that shows a good result in the item on which importance is placed may be selected so as to achieve the desired cleaning result. It is possible to use different three-dimensional shapes of the flexible thin cleaning media at the same time or to use different three-dimensional shapes of the cleaning media at different steps of the cleaning process.

The present application is based on Japanese Priority Application No. 2006-339126 filed on Dec. 15, 2006, Japanese Priority Application No. 2007-192888 filed on Jul. 25, 2007, and Japanese Priority Application No. 2007-297415 filed on Nov. 16, 2007, with the Japanese Patent Office, the entire contents of which are hereby incorporated by reference.

What is claimed is:

1. A dry cleaning apparatus that uses a cleaning medium, said dry cleaning apparatus comprising:

a circulating air current generating unit to generate a high-speed air current to cause a plurality of cleaning media to become airborne within a cleaning tank;

a cleaning media accelerating unit to deliver a high-speed air current to cause the airborne cleaning media to collide with an object to be cleaned so as to remove an extraneous substance such as dust or particles attached to the object;

a cleaning media regeneration unit to provide suction for removing any of the extraneous substance attached to the cleaning media;

wherein each of the plurality of cleaning media includes an outer surface that comes into contact with an object to be cleaned; and an inner surface that remains out of contact with the object;

wherein each of the plurality of cleaning media is flexible and formed in a shape that allows high-speed air current to flow from outside onto the inner surface of the cleaning medium, and wherein each of the plurality of cleaning media has a Young's modulus in a range between 0.2 GPa and 4 GPa.

2. The dry cleaning apparatus as claimed in claim 1, wherein the cleaning medium is formed in the shape of a tube.

3. The dry cleaning apparatus as claimed in claim 2, wherein the tube has a cylindrical shape.

4. The dry cleaning apparatus as claimed in claim 2, wherein the tube has a prismatic shape.

5. The dry cleaning apparatus as claimed in claim 2, wherein a side surface and at least an open end surface of the tube form an acute angle.

6. The dry cleaning apparatus as claimed in claim 2, wherein an opening of the tube has a smaller diameter than the diameter of the other opening.

7. The dry cleaning apparatus as claimed in claim 2, further comprising:

a fold on a side surface of the tube.

8. The dry cleaning apparatus as claimed in claim 2, further comprising:

a flexible thin piece on a side surface of the tube.

9. The dry cleaning apparatus as claimed in claim 1, wherein the cleaning medium is formed in the shape of a bag having an opening at one end.

10. The dry cleaning apparatus as claimed in claim 9, wherein the bag has a conical shape.

11. The dry cleaning apparatus as claimed in claim 9, wherein the bag has a pyramid shape.

12. The dry cleaning apparatus as claimed in claim 9, further comprising:

a fold on a side surface of the bag.

13. The dry cleaning apparatus as claimed in claim 1, wherein the cleaning medium is made of an antistatic material.

14. The dry cleaning apparatus as claimed in claim 1, wherein at least a part of the inner surface is covered with a ferromagnetic material.

15. The dry cleaning apparatus as claimed in claim 1, wherein the cleaning medium is made of a translucent material; and at least a part of the inner surface is covered with a luminescent material or a light reflection material.

16. The dry cleaning apparatus as claimed in claim 1, wherein the cleaning medium has a shape of a lateral area of 1 through 1000 $mm^2$ and a wall thickness of 1 to 500 μm.

* * * * *